US010283856B2

(12) United States Patent
Kim

(10) Patent No.: US 10,283,856 B2
(45) Date of Patent: May 7, 2019

(54) MONOPOLE ANTENNA

(71) Applicant: Mee Jeong Kim, Seoul (KR)

(72) Inventor: Mee Jeong Kim, Seoul (KR)

( * ) Notice: Subject to any disclaimer, the term of this patent is extended or adjusted under 35 U.S.C. 154(b) by 0 days.

(21) Appl. No.: 16/076,972

(22) PCT Filed: Feb. 13, 2017

(86) PCT No.: PCT/KR2017/001564

§ 371 (c)(1),
(2) Date: Aug. 9, 2018

(87) PCT Pub. No.: WO2017/138800

PCT Pub. Date: Aug. 17, 2017

(65) Prior Publication Data

US 2019/0044224 A1 Feb. 7, 2019

(30) Foreign Application Priority Data

Feb. 11, 2016 (KR) ..... 10-2016-0015897

(51) Int. Cl.

| | |
|---|---|
| ***H01Q 1/38*** | (2006.01) |
| ***H01Q 3/01*** | (2006.01) |
| ***H01Q 9/40*** | (2006.01) |
| ***H01Q 7/00*** | (2006.01) |
| ***H01Q 9/16*** | (2006.01) |
| ***H01Q 3/26*** | (2006.01) |

(52) U.S. Cl.

CPC ..... *H01Q 1/38* (2013.01); *H01Q 3/01* (2013.01); *H01Q 3/26* (2013.01); *H01Q 7/00* (2013.01); *H01Q 9/16* (2013.01); *H01Q 9/40* (2013.01)

(58) Field of Classification Search

CPC .. H01Q 1/38; H01Q 3/01; H01Q 3/26; H01Q 7/00; H01Q 9/16; H01Q 9/27; H01Q 9/40

See application file for complete search history.

(56) References Cited

U.S. PATENT DOCUMENTS

2009/0295658 A1* 12/2009 Xi ..... H01Q 9/27 343/742
2015/0054704 A1* 2/2015 Hwang ..... G06K 7/10336 343/788

FOREIGN PATENT DOCUMENTS

| | | | |
|---|---|---|---|
| JP | 2001-092942 | A | 4/2001 |
| JP | 2003-044810 | A | 2/2003 |
| JP | 2003-150916 | A | 5/2003 |
| KR | 10-0416883 | B1 | 2/2004 |
| KR | 10-2006-0008332 | A | 1/2006 |
| KR | 10-0660051 | B1 | 12/2006 |
| KR | 20-2014-0001842 | U | 3/2014 |

* cited by examiner

*Primary Examiner* — Hoang V Nguyen
(74) *Attorney, Agent, or Firm* — Novick, Kim & Lee, PLLC; Jae Youn Kim

(57) ABSTRACT

The present invention relates to a monopole antenna comprising: a radiator arranged in the center of a front surface of a dielectric substrate, and including a plurality of loops formed in a structure in which a Mobius strip is cut at least one time along the circumference; a first bridge for sequentially connecting one end of each loop; and a second bridge for connecting via-holes respectively formed at one end of the innermost loop and the outermost loop, thereby obtaining an effect of enabling an antenna, to which a quasi-Mobius strip and a via-hole structure are applied, to be miniaturized.

13 Claims, 58 Drawing Sheets

| | |
|---|---|
| Type | Surface Current (peak) |
| Monitor | h-field (f=3) [1] |
| Maximum-3D | 117.008 A/m at -1.785 / -12.8769 / 0.762 |
| Frequency | 3 |
| Phase | 0 degrees |

| | |
|---|---|
| Type | Farfield |
| Approximation | enabled (kR >> 1) |
| Monitor | Farfield (f=3.5) [1] |
| Component | Abs |
| Output | Realized Gain |
| Frequency | 3.5 |
| Rad. effic. | -0.07546 dB |
| Tot. effic. | -0.3786 dB |
| rlzd.Gain | 1.889 dB |

| | |
|---|---|
| Type | Farfield |
| Approximation | enabled (kR >> 1) |
| Monitor | farfield (f=4.5) [1] |
| Component | Abs |
| Output | Realized Gain |
| Frequency | 4.5 |
| Rad. effic. | -0.1268 dB |
| Tot. effic. | -0.3776 dB |
| rlzd.Gain | 2.487 dB |

Equivalent circuit of via-hole

| | |
|---|---|
| Type | Farfield |
| Approximation | enabled (kR >> 1) |
| Monitor | farfield (f=2.4) [1] |
| Component | Abs |
| Output | Directivity |
| Frequency | 2.4 |
| Rad. effic. | -1.100 dB |
| Tot. effic. | -1.656 dB |
| Dir. | 3.650 dBi |

| | |
|---|---|
| Type | Farfield |
| Approximation | enabled (kR >> 1) |
| Monitor | farfield (f=2.4) [1] |
| Component | Abs |
| Output | Directivity |
| Frequency | 2.4 |
| Rad. effic. | -0.0831 dB |
| Tot. effic. | -1.514 dB |
| Dir. | 3.397 dBi |

| | |
|---|---|
| Type | Farfield |
| Approximation | enabled (k8 >> 1) |
| Monitor | Farfield (f=2.4) [1] |
| Component | Abs |
| Output | Directivity |
| Frequency | 2.4 |
| Rad. effic. | -1.141 dB |
| Tot. effic. | -1.749 dB |
| Dir. | 3.638 dBi |

MONOPOLE ANTENNA

TECHNICAL FIELD

The present invention relates to a monopole antenna, and more particularly, to a monopole antenna applicable to a wireless communication system.

BACKGROUND ART

As wireless mobile communications evolve rapidly, various wireless communication systems such as 4G/5G mobile communication terminals, wireless control systems, Machine to Machine (M2M), and Internet of Things (IoT) require elements which are more lightweight, have a simple structure, and are miniaturized into a structure that facilitates integration.

Accordingly, various schemes for reducing a physical size of a circuit have been studied, and flat microwave elements and circuits have been widely developed and applied because they are easy to design and manufacture.

In particular, manufacturers of mobile communication terminals and wireless control systems in the world require a miniaturized, flexible, broadband, high-gain antenna which is operated at a low power with high radiation efficiency and has no spatial constraints when mounted in a circuit.

As miniaturization schemes for such an antenna, various schemes such as a scheme of applying a helical structure and a scheme of applying a meta-material and a stacked structure are applied.

Among the above schemes, since a resonance frequency is generated per one rotation around a circumference, the helical structure is not suitable for a scheme of miniaturizing an antenna having a single resonance frequency characteristic. In addition, schemes of applying the meta-material and the stacked structure have a disadvantage in that a configuration is complicated and a manufacturing cost is increased.

In addition, the technology utilizing a basic Moebius strip having a three-dimensional structure and the technology of a flat structure utilizing a characteristic of a Moebius strip have been proposed. However, the above flat structure is not a perfect flat structure, and a line coupling effect occurs at a low frequency.

An example of such broadband monopole antenna technology according to the related art is disclosed in Korean Patent Registration No. 10-0416883 (issued on Feb. 5, 2004), Korean Patent Registration No. 10-0660051 (issued on Dec. 22, 2006), etc.

DISCLOSURE

Technical Problem

However, a compact antenna according to the related art has a configuration of a low-cost printed patch antenna including a metal ground, a substrate with a high dielectric constant, and a radiator.

When such a printed patch antenna is applied to a reception module, a ceramic material having a high dielectric constant lowers radiation efficiency of a reception antenna, and an electromagnetic interference (EMI) occurs, thereby degrading reception sensitivity of a receiver.

In addition, the compact antenna according to the related art is limited in that an antenna installation space has to be ensured.

To solve the problems described above, an object of the present invention is to provide a miniaturized monopole antenna capable of operating at a low power by using an electrode pattern on a flexible substrate, and improving the radiation efficiency.

In addition, another object of the present invention is to provide a monopole antenna in which the antenna is miniaturized by using a quasi-Moebius strip structure, and high-performance antenna characteristics, which are wideband and high-gain characteristics, are implemented.

Still another object of the present invention is to provide a monopole antenna capable of controlling directivity of a radiation pattern of the antenna by adjusting a rotation angle of a ring.

Technical Solution

To achieve the objects described above, according to the present invention, there is provided a monopole antenna including: a radiator arranged on a center of a front surface of a dielectric substrate, and including a plurality of loops formed in a structure in which a quasi-Moebius strip is cut at least one time along a circumference; a first bridge for sequentially connecting one end of each of the loops; and a second bridge for connecting via-holes respectively formed at one end of an innermost loop and an outermost loop.

Advantageous Effects

As described above, according to the monopole antenna of the present invention, an ultra-wideband antenna (UWB antenna) employing a quasi-Moebius strip and a via-hole structure can be miniaturized.

In other words, according to the present invention, a length of a physical circumference is reduced by 1/(N+1) times as compared with a conventional ring antenna. While a resonance frequency is generated per one rotation around a circumference, the present invention can obtain an ultra-wideband characteristic ranging from about 2 GHz to 10 GHz by employing the quasi-Moebius strip and the via-hole.

In addition, according to the present invention, a radiation pattern in a far-field exhibits omni-directional characteristics similar to a typical monopole antenna, and directivity can be controlled by adjusting a rotation angle of each ring provided in a radiator.

Further, according to the present invention, the resonance frequency and a reflection coefficient are adjustable by varying three parameters of the quasi-Moebius strip, that is, a thickness of a ring line of the quasi-Moebius strip, a width of a bridge, and a radius and a position of the via-hole, and simulation results show that the quasi-Moebius strip having the via-hole structure can be applied to a matching network.

In addition, according to the present invention, the thickness of the ring line and a size and the position of the via-hole affect an inductance (L), and the width of the bridge and the size and position of the via-hole affect a capacitance (C), so that the three parameters of the quasi-Moebius strip can be applied to a matching circuit.

In other words, according to simulation and measurement results, the resonance frequency of a quasi-Moebius strip antenna is within a 2.4 GHz band, a peak value of a reflection coefficient S11 is 17.3 dB in the simulation result, and 27.65 dB in the measurement result.

Therefore, according to the present invention, an optimized quasi-Moebius strip is applied to the antenna so that the antenna is configured as a plurality of ring lines having mutually different radii, but the antenna can have a single resonance frequency characteristic.

In addition, according to the present invention, when a miniaturized UWB antenna is applied to a multiple-input multiple-output antenna (MIMO antenna), an envelope correlation coefficient value (ECC value) indicating correlation between antennas is 0.02 or less in a frequency range of 3 GHz to 8 GHz, so that spectrum efficiency can be improved.

Further, according to the present invention, the quasi-Moebius strip having the via-hole structure can be applied to RF passive elements such as an oscillator and a resonator as well as the UWB antenna, thereby miniaturizing the RF passive elements.

BEST MODE

Mode for Invention

Hereinafter, a monopole antenna according to a preferred embodiment of the present invention will be described in detail with reference to the accompanying drawings.

1 Miniaturization of Monopole Antenna

Figure 1:
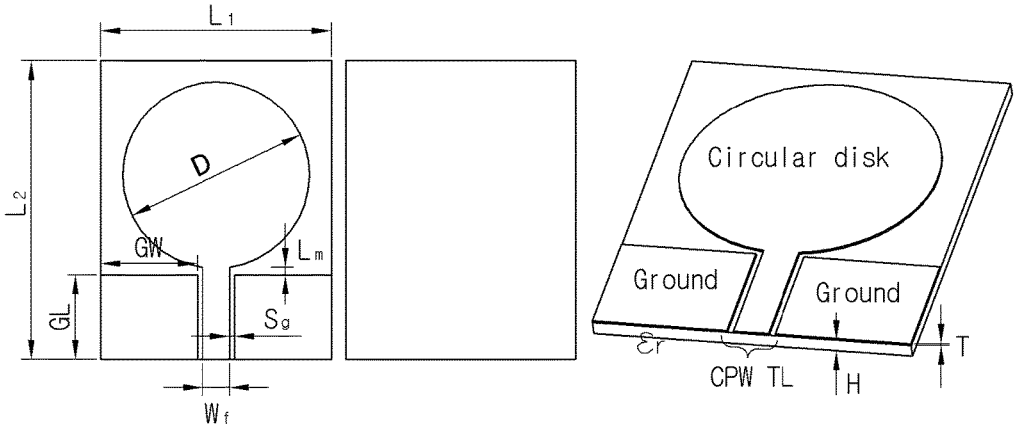
FIG. 1 is a block diagram showing a circular disc-shaped monopole antenna having a coplanar waveguide transmission line implemented on a dielectric substrate.

FIG. 1 is a block diagram showing a circular disc-shaped monopole antenna having a coplanar waveguide transmission line (hereinafter referred to as "CPW TL") implemented on a dielectric substrate.

Electrical characteristics of the dielectric substrate are expressed by a dielectric constant $\varepsilon_r$ of a dielectric, a dielectric thickness H, a copper foil thickness T, and a loss tangent value (tan δ). In this embodiment, the dielectric substrate a dielectric constant $\varepsilon_r$=2.2, a dielectric thickness H=30 mils (0.762 mm), a copper foil thickness T=0.5 oz. (0.018 mm), and a loss tangent value (tan δ)=0.001 (@ 5 GHz) is used.

In a coplanar waveguide line structure, as shown in FIG. 1, values of a slot width $S_g$ and a center strip line width $W_f$ are varied in a CPW TL feeding structure having strip transmission lines coplanar with two ground planes formed on both sides of a center strip line to adjust a desired characteristic impedance value.

Figure 2A:
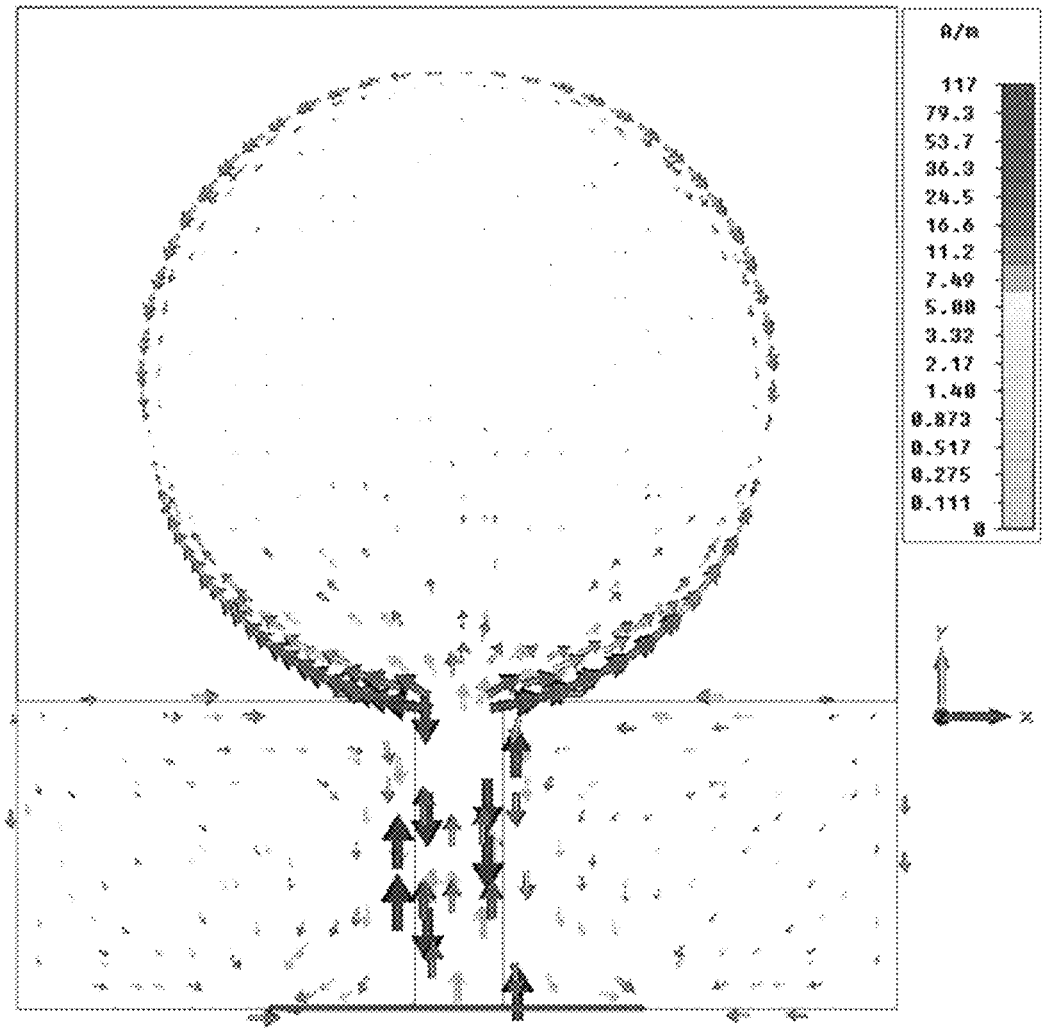
FIGS. 2A to 2C are conceptual diagrams showing surface current distribution for each operating frequency of the circular disc monopole antenna at a feeding phase of 0°.
Figure 2B:
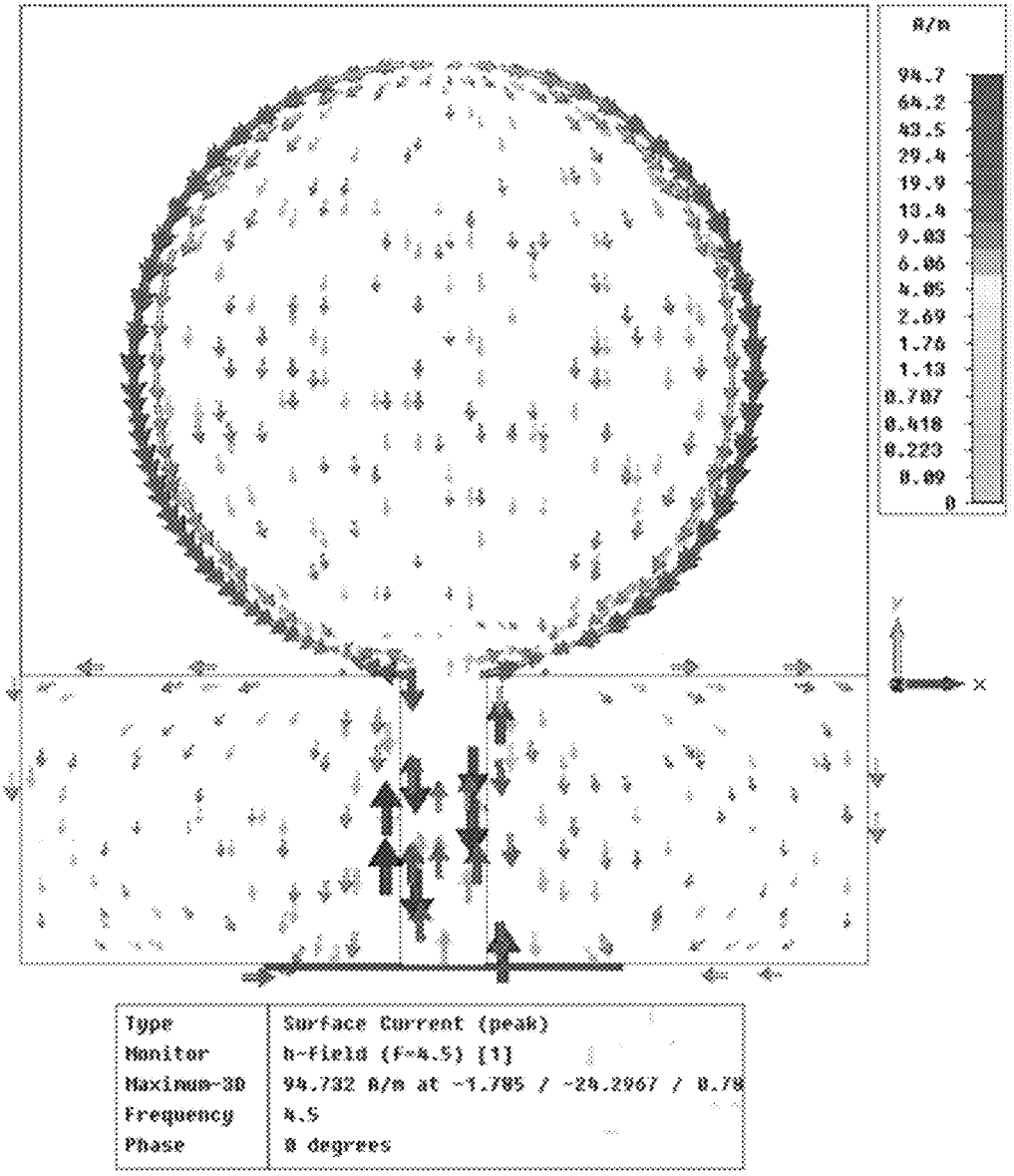
Figure 2C:
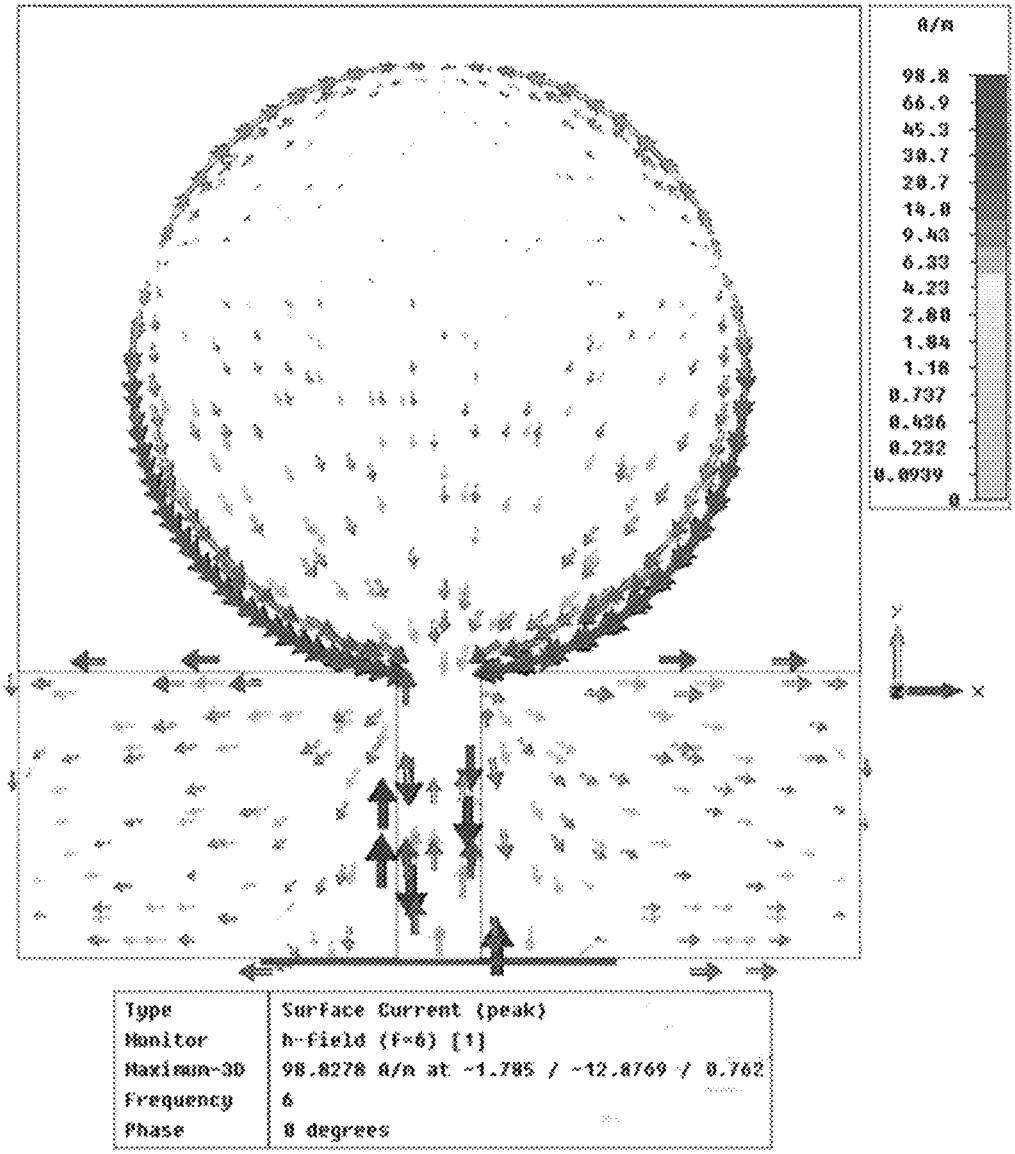

FIGS. 2A to 2C are conceptual diagrams showing surface current distribution for each operating frequency of the circular disc monopole antenna at a feeding phase of 0°.

It can be seen that a surface current flows mainly on an outer periphery of a circular disc, and the current flows rarely in a center portion of the circular disc. Therefore, it is considered that the center portion can be partially removed to form an annular monopole antenna structure, which will be utilized in further miniaturization studies using a multiple closed-loop monopole antenna structure.

The surface current distributions at 3.0 GHz and 4.5 GHz are directed in an identical direction in a circular disc structure, whereas a radiator forms higher-order mode current distribution at 6.0 GHz because 6.0 GHz is greater than an operating frequency, so that the radiation pattern of an azimuth direction may be degraded because the radiation pattern having a horizontal omni-directional characteristic may be shifted to have a directivity of slightly offset vertically upward.

The miniaturization of the antenna affects radiation pattern characteristics such as directivity, gain, and radiation efficiency, so that careful attention has to be paid during a design process.

Figure 3:
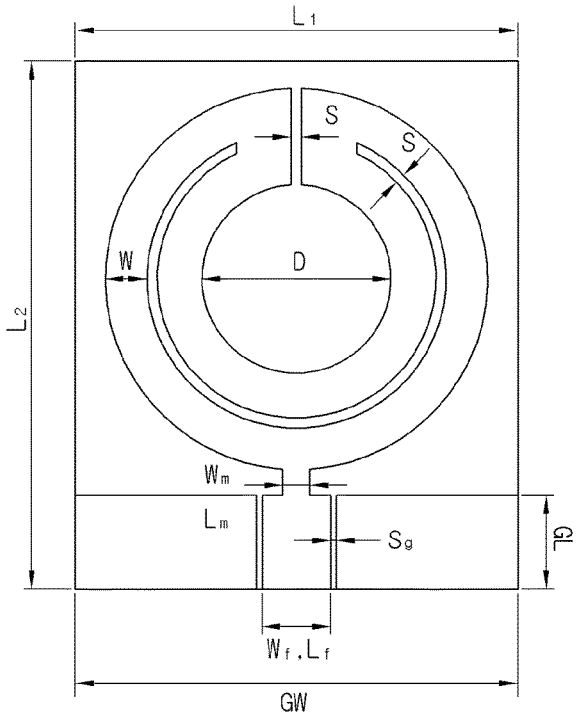
FIG. 3 is a block diagram showing a circular double-closed-loop monopole antenna for miniaturizing a structure of the circular disc monopole antenna.

FIG. 3 is a block diagram showing a circular double-closed-loop monopole antenna (hereinafter referred to as "type 1") for miniaturizing a structure of the circular disc monopole antenna.

The circular double-closed-loop monopole antenna shown in FIG. 3 is designed by using a dielectric substrate with a dielectric constant $\varepsilon_r$=2.2, a dielectric thickness H=30 mils (0.762 mm), a copper foil thickness T=0.5 oz. (0.018 mm), and a loss tangent value (tan δ)=0.001 (@ 5 GHz), and has a CPW feeding structure.

Since a size of a CPW feeding unit affects an input impedance and the radiation pattern, the size of the CPW feeding unit is selected to be suitable for a circular double-closed-loop monopole structure.

Optimized design parameters for a structure of the circular double-closed-loop monopole antenna are disclosed in Table 1.

TABLE 1

| Design Parameter | Note for Design Parameter | Design Value | Note |
|---|---|---|---|
| $W_f$ | Center strip line width | 3.57 mm | Determines input |
| $L_f$ | Center strip line length | 5.20 mm | characteristic |
| $S_g$ | Slot interval (Interval between center strip and ground plane) | 0.20 mm | impedance (No relation to $L_f$) |
| D | Inner diameter of circular double closed loop | 16.00 mm | Determines impedance, |
| W | Width of closed loop line | 2.50 mm | and relates to |
| S | Interval between loops (Slot width) | 0.50 mm | impedance-matching |
| $W_m$ | Feed matching line width | 1.50 mm | inductance $L_m$ |
| $L_m$ | Feed matching length | 1.33 mm | and capacitance GL |

TABLE 1-continued

| Design Parameter | Note for Design Parameter | Design Value | Note |
|---|---|---|---|
| GW | Ground plane width | 24.00 mm | |
| GL | Ground plane length | 5.20 mm | |
| $L_1$ | Total width of antenna | 24.00 mm (=0.36 $\lambda_o$) | Total area of antenna ($\lambda_o$ is wave- |
| $L_2$ | Total length of antenna | 29.00 mm (=0.44 $\lambda_o$) | length at center frequency) |

(*) Comparison at a center operating frequency (4.5 GHz)

Figure 4A:
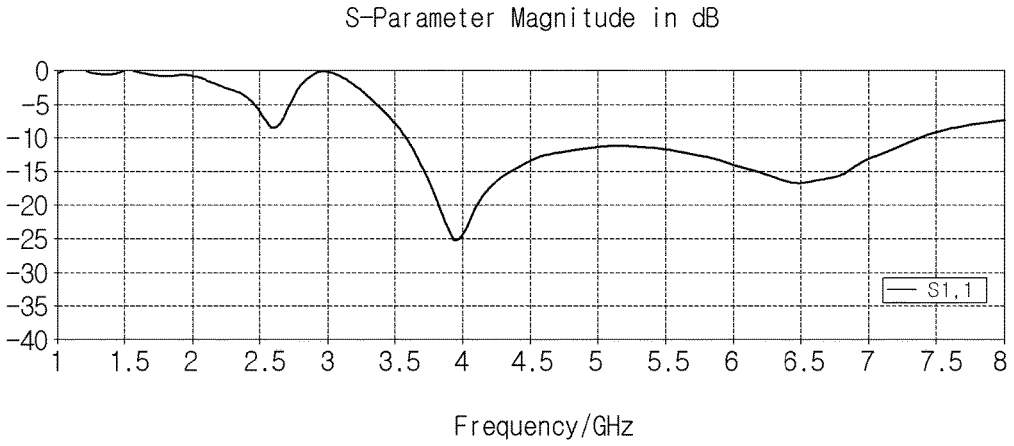
FIGS. 4A and 4B are views showing input matching characteristics of the circular double-closed-loop monopole antenna which is subject to a simulation for optimization.
Figure 4B:
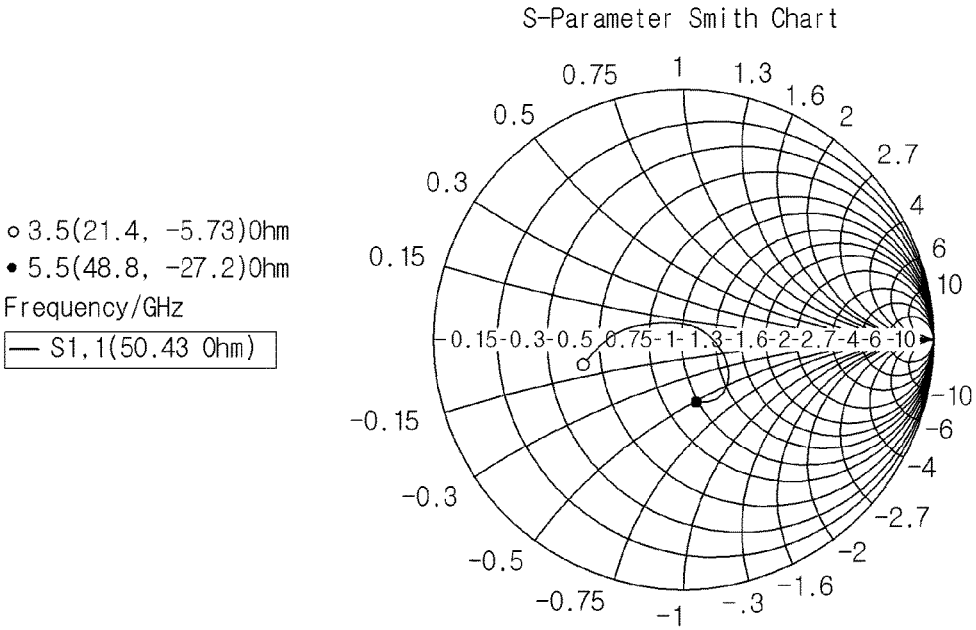

FIG. 4 is a view showing input matching characteristics of the circular double-closed-loop monopole antenna which is subject to a simulation for optimization.

The input matching characteristics within an operating band are affected by a size of an outer loop, a line width of a closed loop, a feed matching length, and a size of a ground plane.

It can be seen that an operating bandwidth is reduced because an antenna input impedance characteristic is degraded at a low-frequency band due to an attempt to miniaturize a circular double closed loop.

In other words, an input return loss characteristic at a reference of 10 dB, which is simulated based on the optimized design parameters in Table 1, operates within a band ranging from about 3.6 GHz to 7.3 GHz.

Figure 5:
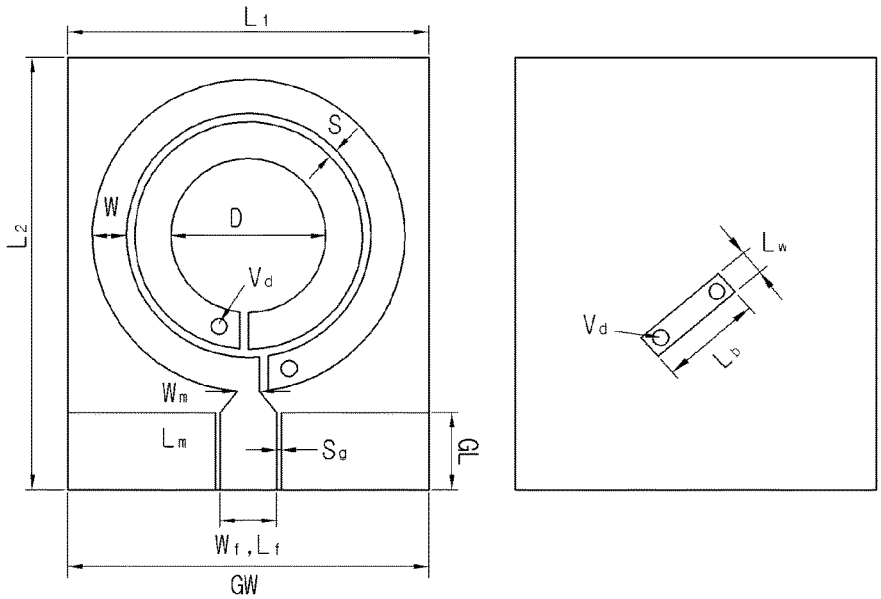
FIG. 5 is a block diagram showing a quasi-Moebius monopole antenna.

FIG. 5 is a block diagram showing a quasi-Moebius monopole antenna (hereinafter referred to as "type2"), in which design parameters of the antenna and a structure of the quasi-Moebius monopole antenna for miniaturizing the structure of the circular disc monopole antenna are shown.

The quasi-Moebius monopole antenna is designed by using a dielectric substrate with a dielectric constant $\varepsilon_r$=2.2, a dielectric thickness H=30 mils (0.762 mm), a copper foil thickness T=0.5 oz. (0.018 mm), and a loss tangent value (tan δ)=0.001 (@ 5 GHz), and has the CPW feeding structure. Since the size of the CPW feeding unit affects the input impedance and the radiation pattern, the size of the CPW feeding unit is selected to be suitable for the structure of the quasi-Moebius monopole antenna.

Figure 6A:
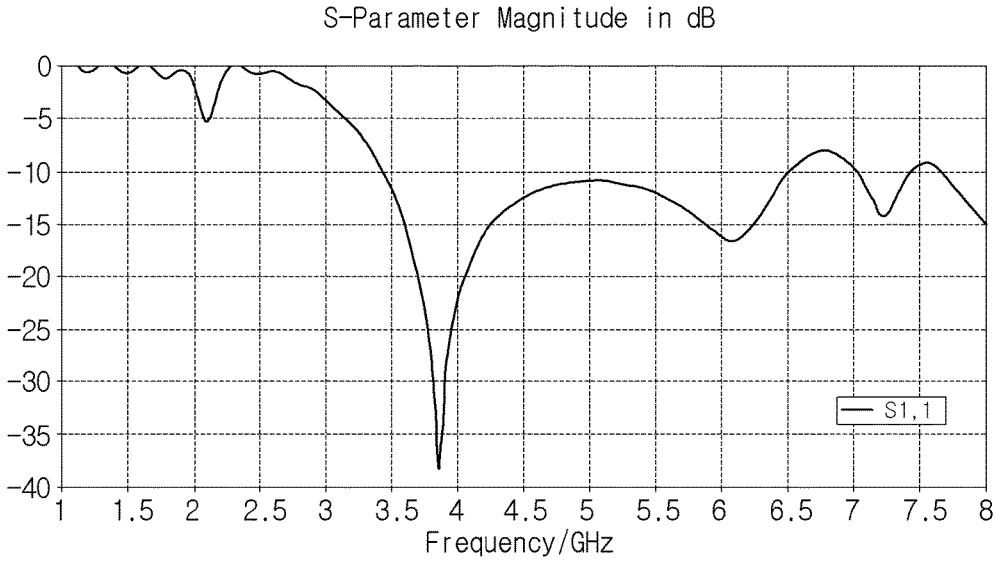
FIGS. 6A and 6B are views showing input matching characteristics of the quasi-Moebius monopole antenna which is subject to a simulation for optimization.
Figure 6B:
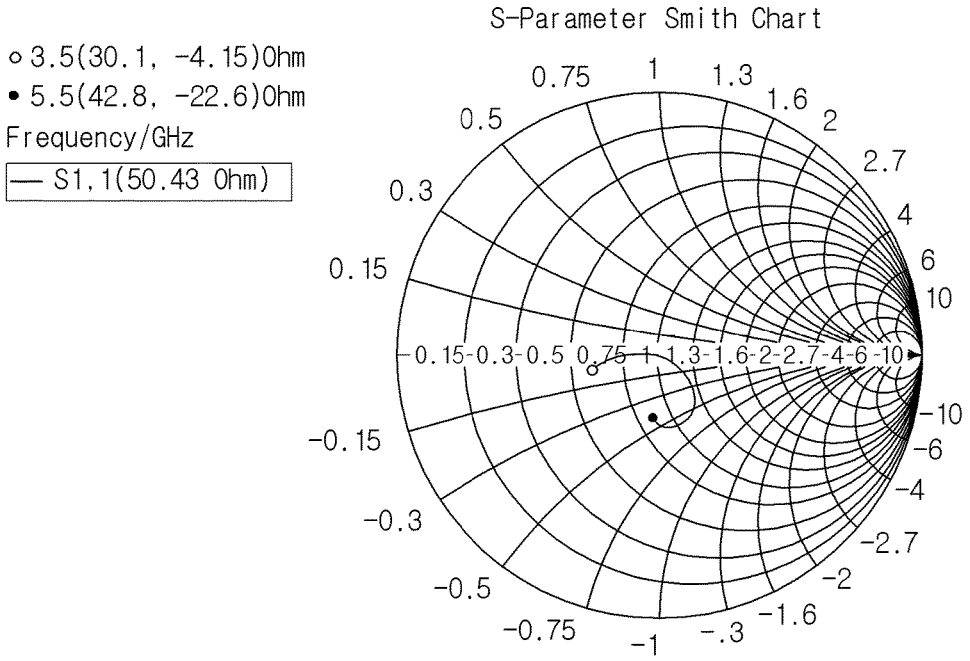

Table 2 shows design parameters of the quasi-Moebius monopole antenna, and FIG. 6 is a view showing input matching characteristics of the quasi-Moebius monopole antenna which is subject to a simulation for optimization.

TABLE 2

| Design Parameter | Note for Design Parameter | Design Value | Note |
|---|---|---|---|
| $W_f$ | Center strip line width | 3.57 mm | Determines input |
| $L_f$ | Center strip line length | 5.53 mm | characteristic |
| $S_g$ | Slot interval (Interval between center strip and ground plane) | 0.20 mm | impedance (No relation to $L_f$) |
| D | Inner diameter of circular double closed loop | 16.00 mm | Determines impedance, and |
| W | Width of closed loop line | 2.50 mm | relates to impedance- |
| S | Interval between loops (Slot width) | 0.50 mm | matching inductance $L_m$ and |
| $W_m$ | Feed matching line width | 1.54 mm | capacitance GL |
| $L_m$ | Feed matching length | 1.00 mm | |
| GW | Ground plane width | 24.00 mm | |
| GL | Ground plane length | 5.53 mm | |
| $V_d$ | Diameter of via-hole | 1.00 mm | Quasi-Moebius |
| $L_W$ | Line width of rear surface connection line | 1.50 mm | connection line |
| $L_b$ | Length of rear surface connection line | 6.00 mm | |

TABLE 2-continued

| Design Parameter | Note for Design Parameter | Design Value | Note |
|---|---|---|---|
| $L_1$ | Total width of antenna | 24.00 mm (=0.36 $\lambda_o$) | Total area of antenna ($\lambda_o$ is wavelength at center frequency) |
| $L_2$ | Total length of antenna | 29.00 mm (=0.44 $\lambda_o$) | |

The input matching characteristics within the operating band are affected by a size of a quasi-Moebius loop, the line width, a feed matching length, and the size of the ground plane. The operating bandwidth is slightly reduced because the antenna input impedance characteristic is degraded at the low-frequency band due to an attempt to miniaturize the antenna through quasi-Moebius cross connection.

The input return loss characteristic at the reference of 10 dB, which is simulated based on the optimized design parameters in Table 2, operates within a band ranging from about 3.4 GHz to 6.5 GHz.

Figure 7:
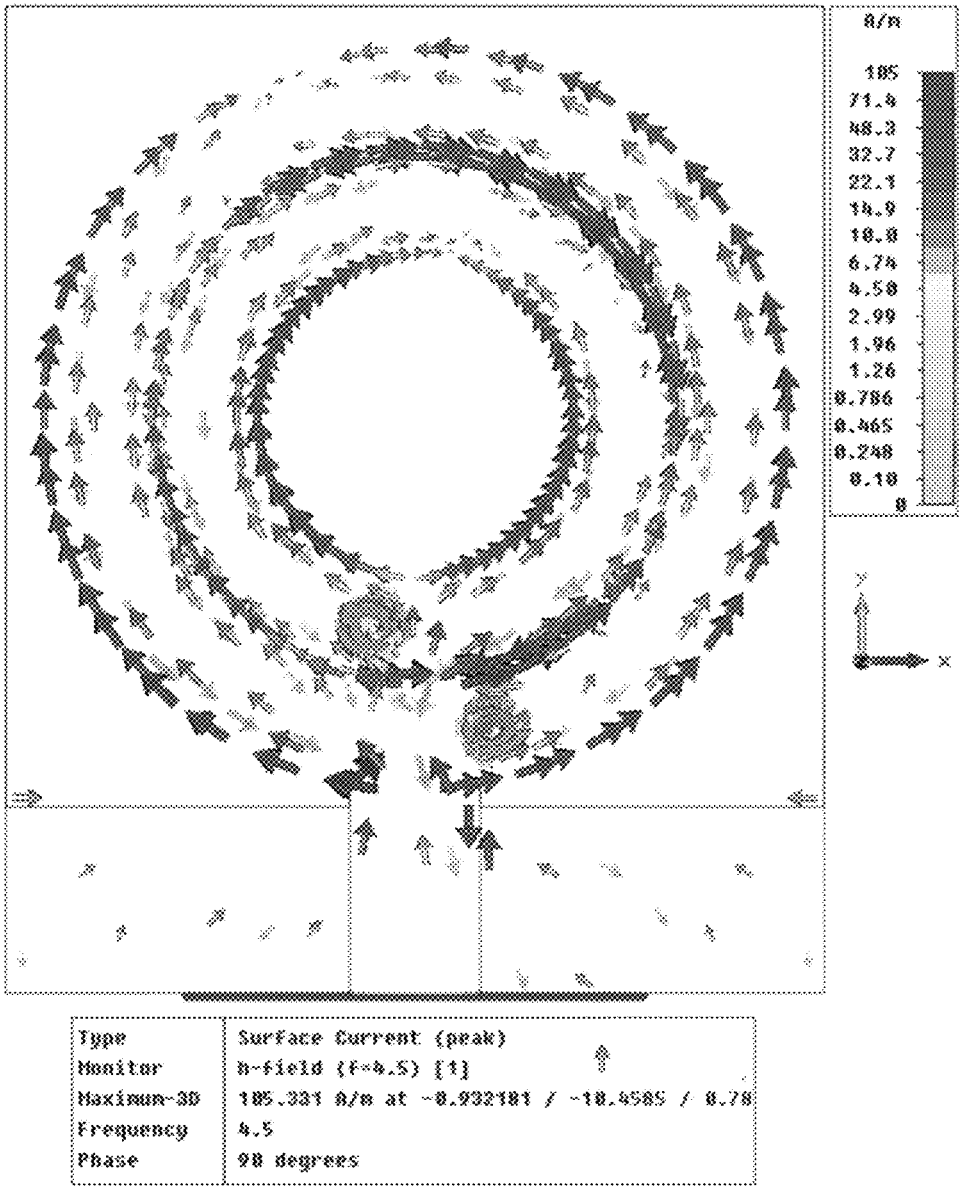
FIG. 7 is a view showing surface current distribution for a center frequency of the quasi-Moebius monopole antenna at a feeding phase of 90°.

FIG. 7 is a view showing surface current distribution for a center frequency (4.5 GHz) of the quasi-Moebius monopole antenna at a feeding phase of 90°.

It can be seen that the surface current flows mainly on an edge of a quasi-Moebius closed loop, and if a current is determined to be induced in an identical direction on an inner loop, the structure of the monopole antenna according to the present embodiment is analyzed to be less effective in reducing an antenna resonance length.

FIGS. 8A and 8B and FIGS. 9A to 9C are views showing two-dimensional radiation patterns and three-dimensional radiation patterns which are simulated for optimization at three frequencies of 3.5 GHz, 4.5 GHz, and 5.5 GHz within the operating band of the quasi-Moebius monopole antenna, respectively.

Figure 8A:
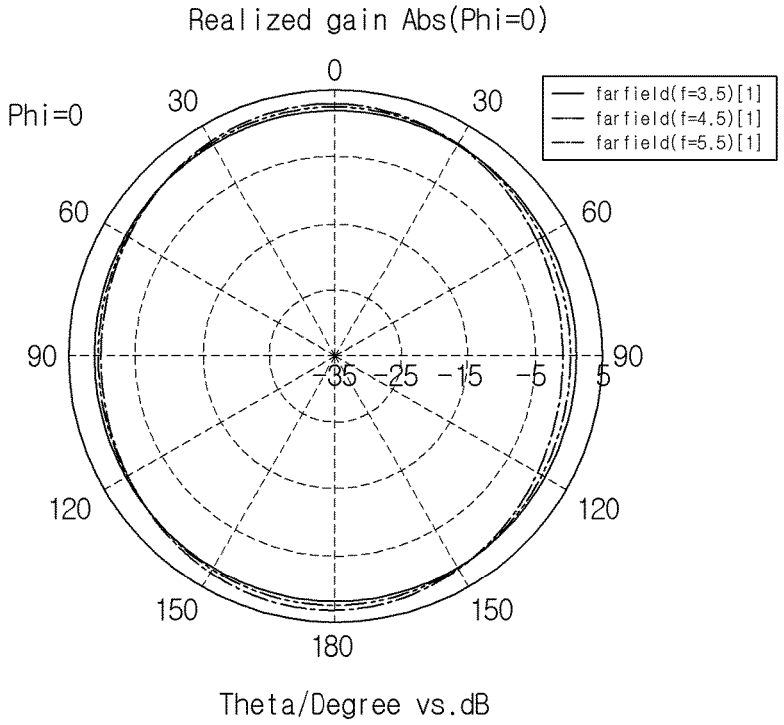
FIG. 8 and FIGS. 9A to 9C are views showing two-dimensional radiation patterns and three-dimensional radiation patterns which are simulated for optimization at three frequencies of 3.5 GHz, 4.5 GHz, and 5.5 GHz within an operating band of the quasi-Moebius monopole antenna, respectively.
Figure 8B:
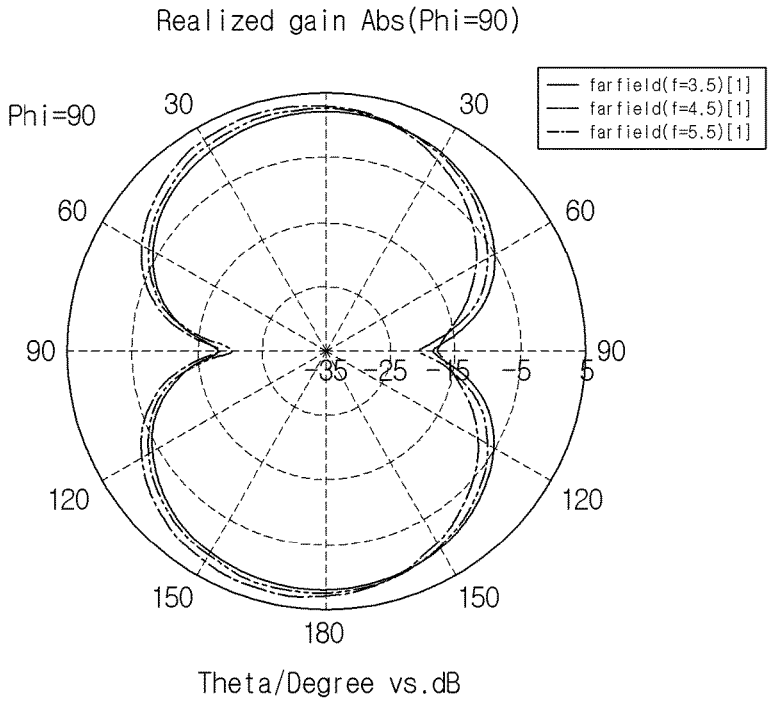
Figure 9A:
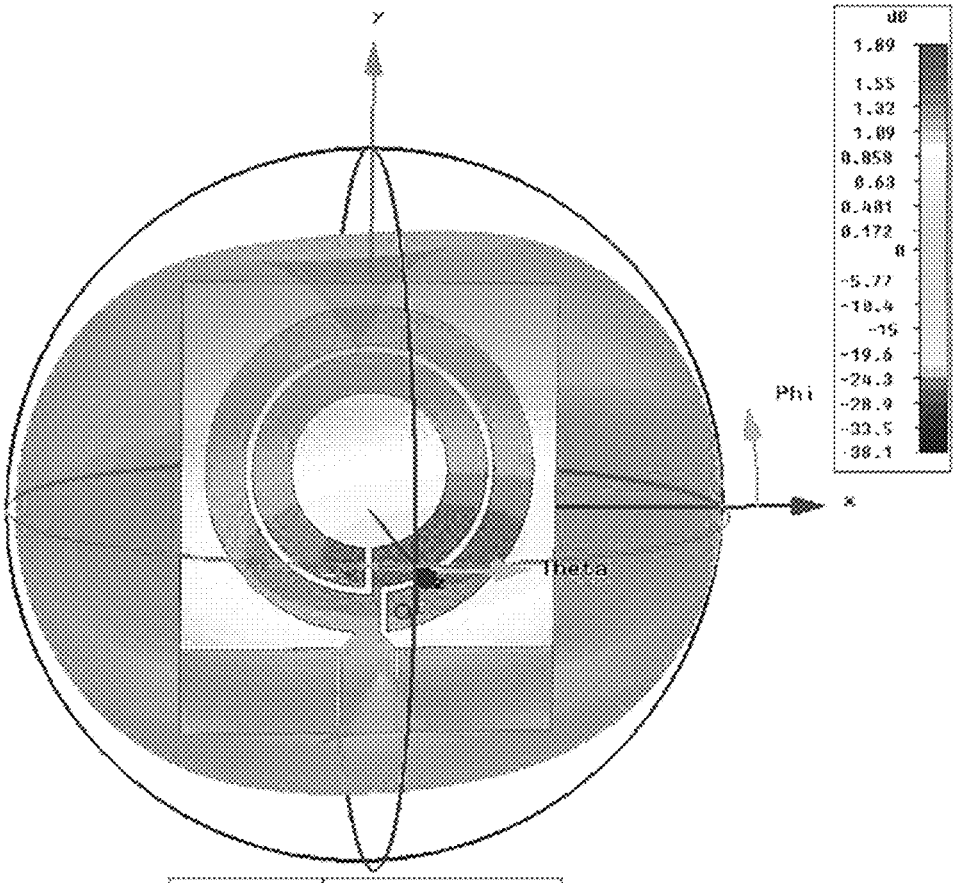
Figure 9B:
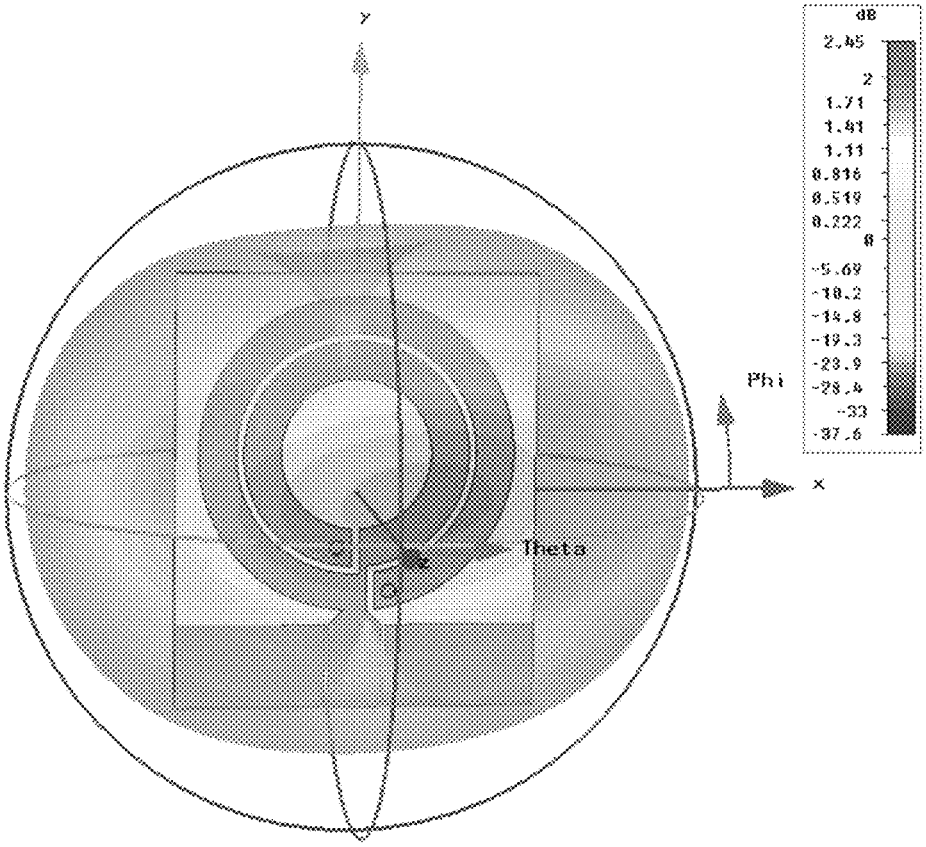
Figure 9C:
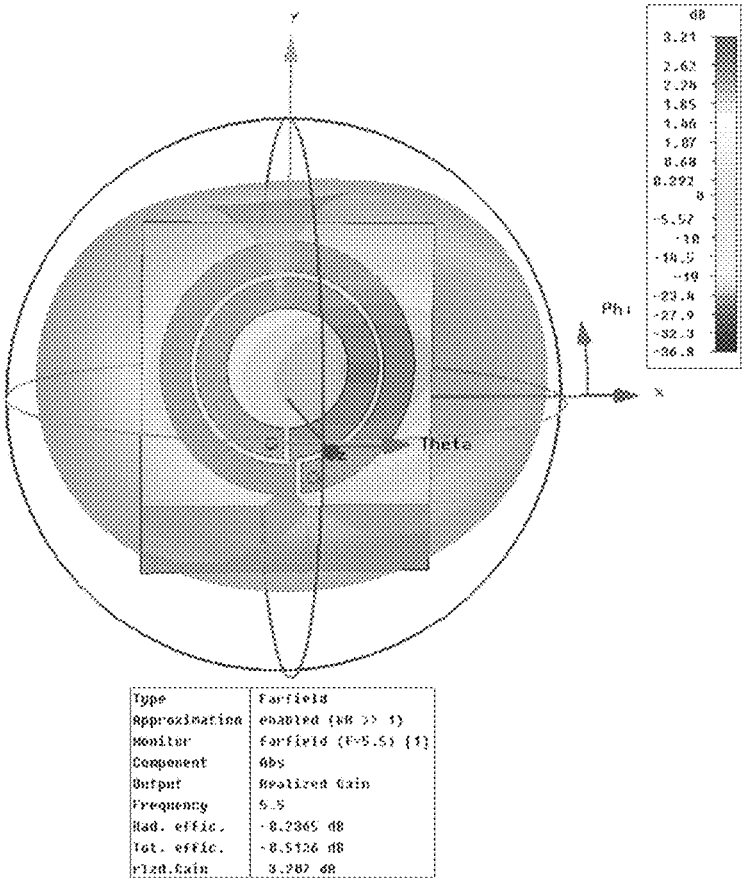

FIG. 8A shows an azimuth pattern ((p=0°), and FIG. 8B shows an elevation angle pattern ((p=90°).

In addition, Table 3 shows electrical radiation patterns at each frequency.

TABLE 3

| Classification | Operating Frequency 3.5 GHz | 4.5 GHz | 5.5 GHz |
|---|---|---|---|
| Antenna directivity | 2.3 dBi | 2.8 dBi | 3.7 dBi |
| Antenna efficiency (Radiation efficiency + Input matching efficiency) | 91.8% | 91.7% | 88.8% |
| Antenna gain | 1.9 dBi | 2.4 dBi | 3.2 dBi |
| 3-dB beam width @ elevation angle | 84.4° | 79.2° | 73.2° |

The radiation pattern exhibits excellent characteristics of vertical linearly polarized waves, an antenna gain exhibits an omni-directional radiation characteristic in a range of about 1.9 dBi within the operating band, and a characteristic of 8-shaped radiation with a 3-dB beam width in a range of 73.2° to 84.4° is exhibited at an elevation angle.

Figure 10:
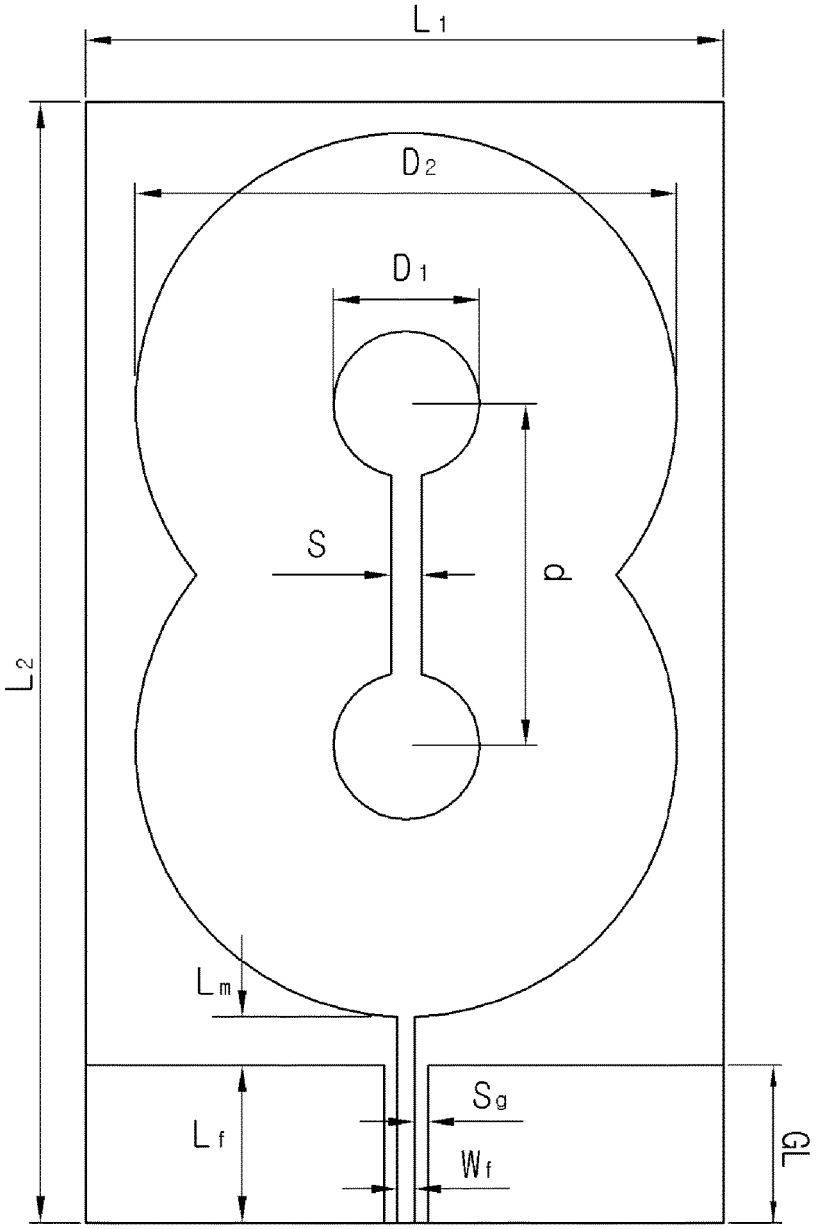
FIG. 10 is a block diagram showing a double circular ring monopole antenna for miniaturizing a structure of the circular disc monopole antenna.

FIG. 10 is a block diagram showing a double circular ring monopole antenna (hereinafter referred to as "type 3") for miniaturizing the structure of the circular disc monopole antenna.

As shown in FIG. 10, the double circular ring monopole antenna is designed by using a dielectric substrate with a dielectric constant $\varepsilon_r$=2.2, a dielectric thickness H=30 mils (0.762 mm), a copper foil thickness T=0.5 oz. (0.018 mm), and a loss tangent value (tan δ)=0.001 (@ 5 GHz), and has the CPW feeding structure.

Since the size of the CPW feeding unit affects the input impedance and the radiation pattern, the size of the CPW feeding unit is selected to be suitable for the structure of the double circular ring monopole antenna, and Table 4 shows optimized design parameters.

TABLE 4

| Design Parameter | Note for Design Parameter | Design Value | Note |
|---|---|---|---|
| $W_f$ | Center strip line width | 0.8 mm | Corresponds to |
| $L_f$ | Center strip line length | 4.9 mm | 75 Ω input |
| $S_g$ | Slot interval (Interval between center strip and ground plane) | 0.20 mm | characteristic impedance |
| $D_1$ | Inner diameter of circular ring | 4.50 mm | Determines impedance, |
| $D_2$ | Outer diameter of circular ring | 16.50 mm | and relates to impedance- |
| d | Distance between center points of double ring | 10.50 mm | matching inductance $L_m$ |
| S | Double ring connection slot width | 1.00 mm | and capacitance GL |
| $L_m$ | Feed matching length | 1.61 mm | |
| GW | Ground plane width | 19.50 mm | |
| GL | Ground plane length | 5.20 mm | |
| $L_1$ | Total width of antenna | 19.50 mm (=0.29 $\lambda_o$) | Total area of antenna ($\lambda_o$ is |
| $L_2$ | Total length of antenna | 34.50 mm (=0.52 $\lambda_o$) | wavelength at center frequency) |

The antenna size (or antenna length) in a lateral direction can be reduced by a double circular ring structure arranged in a longitudinal direction, which fundamentally allows to provide an excellent omni-directional radiation pattern in the azimuth direction.

As a result of simulating the antenna having the type 3 structure, it can be confirmed that electric characteristics similar to the input return loss characteristic of the circular disc monopole antenna, which serves as a reference of the antenna size, can be obtained.

The input return loss characteristic at the reference of 10 dB, which is simulated based on the optimized design parameters, operates within a band ranging from about 2.9 GHz to 6.5 GHz.

Figure 11:
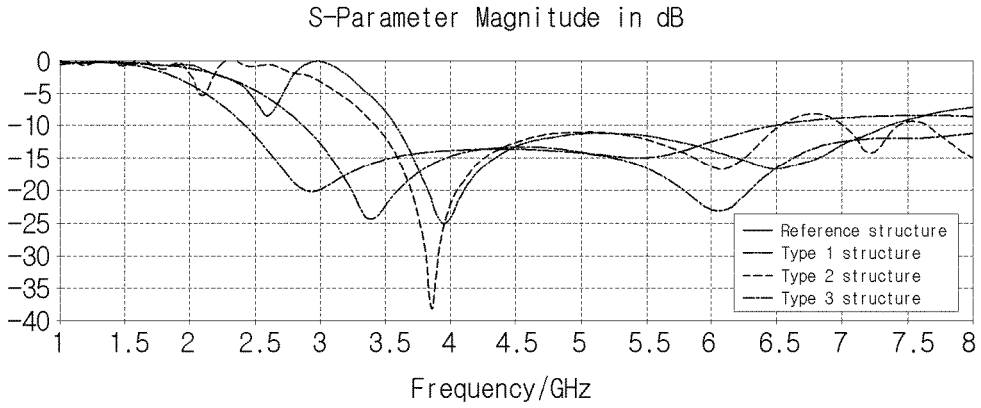
FIG. 11 is a graph showing input matching characteristics of circular disc monopole antennas and type 1 to type 3 antennas.

FIG. 11 is a graph showing input matching characteristics of circular disc monopole antennas and type 1 to type 3 antennas.

In the design parameter optimization process, it can be seen that the input return loss characteristic in a high-frequency band tends to be relatively easy to match, but impedance matching is not smoothly performed in a frequency band lower than 3.5 GHz. This generally indicates that an impedance operating bandwidth is degraded due to miniaturization of the antenna.

FIG. 11 is a view showing two-dimensional radiation pattern characteristics of compared monopole antenna structures.

Miniaturized structures compared to a reference antenna exhibit relatively better omni-directional characteristics in the azimuth direction at the center frequency (4.5 GHz), and a radiation pattern of a reference antenna structure is similar to radiation patterns of the type 1 and type 2 structures in the elevation angle (wave angle) direction. However, the type 3 structure is analyzed to exhibit relatively more directivity because a radiation length is longer in the longitudinal direction.

Table 5 shows electrical and physical characteristics of the reference antenna structure in comparison with electrical and physical characteristics of the type 1 to type 3 structures.

TABLE 5

| Classification | | Circular Disc Structure (based on physical size) | Type 1 Structure | Type 2 Structure | Type 3 Structure |
|---|---|---|---|---|---|
| Electrical Characteristics | Operating impedance bandwidth (based on @ 10 dB) | 2.4~8.0 GHz | 3.6~7.3 GHz | 3.4~6.5 GHz | 2.9~6.5 GHz |
| | Partial bandwidth ratio (%) | 107.7% | 67.9% | 62.6% | 76.6% |
| | Antenna directivity(*) | 3.3 dBi | 2.7 dBi | 2.8 dBi | 3.1 dBi |
| | Antenna efficiency(*) | 86.8% | 92.1% | 91.7% | 92.9% |
| | Antenna gain(*) | 2.7 dBi | 2.3 dBi | 2.4 dBi | 2.7 dBi |
| | 3-dB beam width(*) (@ elevation angle) | 72.2° | 78.8° | 79.2° | 71.0° |
| Physical Characteristics | Antenna size (area) | 37 × 42 mm (0.55 × 0.63 $\lambda_o$) | 24 × 29 mm (0.36 × 0.44 $\lambda_o$) | 24 × 29 mm (0.36 × 0.44 $\lambda_o$) | 19.5 × 34.5 mm (0.29 × 0.52 $\lambda_o$) |
| | Miniaturization ratio against reference (%) | 100% | 44.8% | 44.8% | 43.3% |

(*)Comparison at a center operating frequency (4.5 GHz)

Although the miniaturization structure of type 1 to type 3 structures has a disadvantage in that the operating bandwidth is reduced in comparison with the reference antenna structure, type 1 to type 3 miniaturization structures are analyzed to exhibit similar antenna directivity, antenna efficiency, antenna gains, and 3-dB beam width characteristics, and remarkably effective antenna miniaturization can be achieved with a miniaturization ratio of 42% or less compared to the reference antenna.

2. Quasi-Moebius Monopole Antenna

The Moebius strip has a phase difference of 180° between an inner space and an outer space thereof. In other words, the inner space and the outer space are not separated from each other, but are connected to each other so as to form an open space.

Therefore, the Moebius strip is not divided into two strips when cut along a circumference thereof, but becomes a single strip having a circumferential length twice as longer as the circumferential length of the Moebius strip before the cutting.

In other words, the Moebius strip has no topological beginning and has one surface. In addition, the Moebius strip is similar to a cylinder, but is a surface having a boundary other than a typical surface. Further, the Moebius strip is not a three-dimensional closed space, but a two-dimensional open space.

Table 6 shows results according to the number of times the Moebius strip has been cut along the circumference.

TABLE 6

| Half Twist Number | Number of Cuts | Result |
|---|---|---|
| 1 | 1 | 1 band length 2 |
| 1 | 2 | 2 bands length 2 |
| 1 | 3 | 3 bands length 2 |
| 2 | 1 | 2 bands length 1 |
| 2 | 2 | 3 bands length 1 |
| 2 | 3 | 4 bands length 1 |

When the Moebius strip is twisted once according to the result of Table 6, Equations 1 and 2 can be derived as follows.

$$M(t, s) = \left[R + s \cdot \cos\left(\frac{1}{2}t\right)\right] \cdot \cos(t), \text{ for } 0 \le t \le \pi \quad \text{[Equation 1]}$$

$$M(t, s) = \left[R + s \cdot \cos\left(\frac{1}{2}t\right)\right] \cdot \sin(t), \text{ for } \pi \le t \le 2\pi \quad \text{[Equation 2]}$$

wherein $s \in [-\omega, \omega]$, $t \in [0, 2\pi]$, R=the radius of the Moebius strip, and N=Number of cuts of Moebius strip.

The term cos(t) in Equation 1 and the term sin(t) in Equation 2 cause a phase difference of 180°. Therefore, the function M(t, s) indicates that an end of one side is fixed and rotated by 180° to meet on an opposite side.

Figure 12:
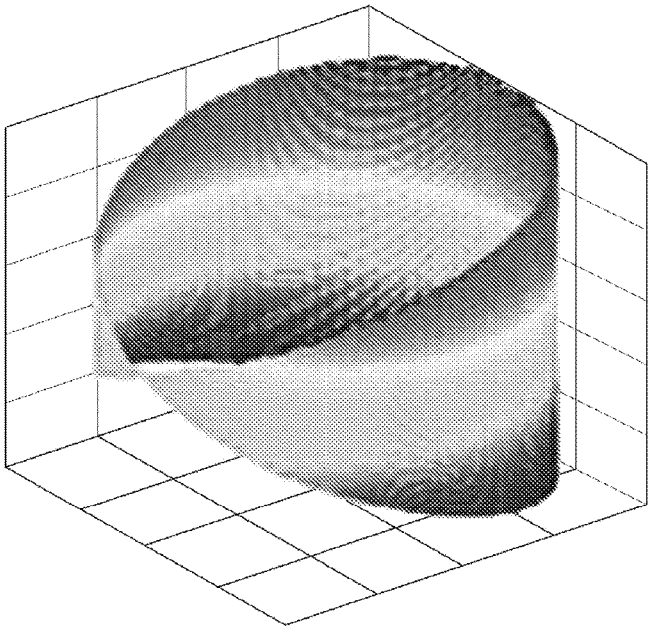
FIG. 12 is a view showing a simulation of a Moebius strip.

FIG. 12 is a view showing a simulation of a Moebius strip with reference to Equations 1 and 2.

A total circumferential length l of the Moebius strip can be derived as shown in Equation 3.

$$l = \pi \times (N+1) \times R \quad \text{[Equation 3]}$$

Figure 13:
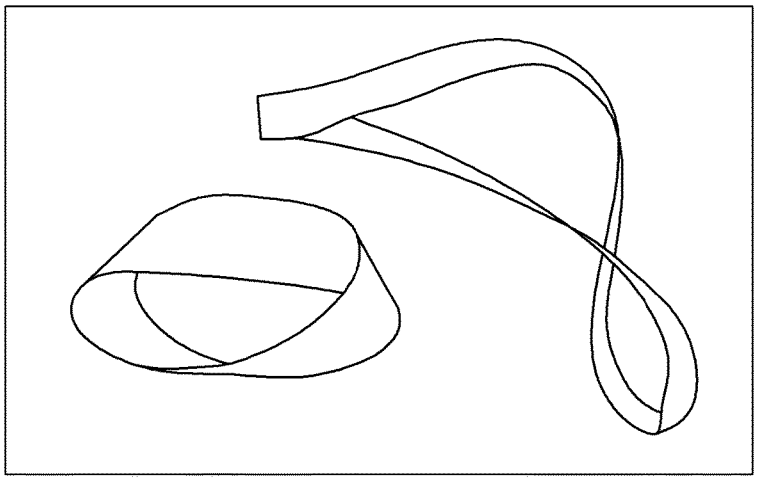
FIG. 13 is a view showing a comparison between the Moebius strip and a strip formed by cutting the Moebius strip along a circumference thereof.

FIG. 13 is a view showing a comparison between the Moebius strip and a strip formed by cutting the Moebius strip along a circumference thereof.

As shown in FIG. 13, the Moebius strip having the inner space and the outer space with a phase difference of 180° can formed into a strip having a longest circumference when cut along the circumference.

Therefore, the present invention can miniaturize RF passive elements such as an antenna, an oscillator, and a resonator by utilizing the above characteristics of the Moebius strip.

Meanwhile, the applicant has succeeded in miniaturization of the monopole antenna by applying a flat Moebius strip utilizing the characteristic of the Moebius strip as disclosed in "Miniaturized Antenna Using a Planar Moebius Strip Bisected Along The Circumferential Direction", IEED Eunc-S. Int. Sym, Proceedings, M. J. Kim, C. S. Cho, and J. Kim, pp. 827-830, October 2006, etc. However, various problems are caused due to an imperfect structure of the flat Moebius strip.

Figure 14A:
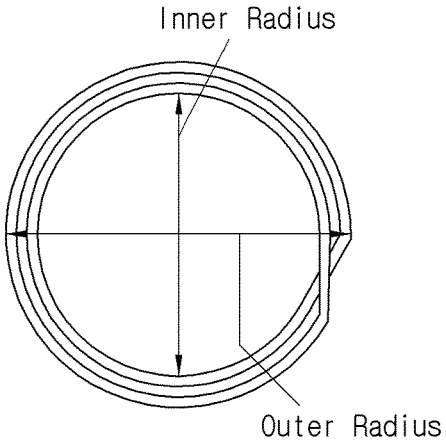
FIGS. 14A and 14B are block diagrams showing a flat Moebius strip according to the related art.
Figure 14B:
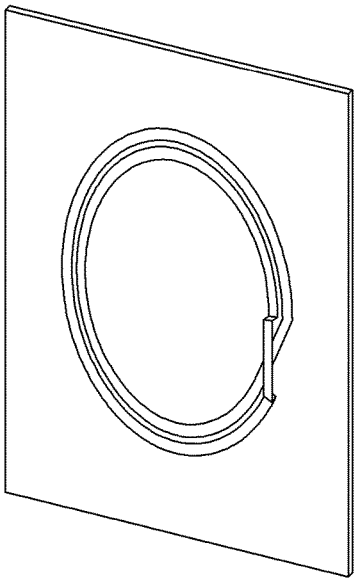

FIGS. 14A and 14B are block diagrams showing a flat Moebius strip according to the related art.

As shown in FIG. 14, a three-dimensional connection bridge at a portion where two rings are connected to each other causes a line coupling effect at a low frequency, so that the three-dimensional connection bridge is not suitable for application to an RF circuit having a single resonance frequency characteristic. In addition, the flat Moebius strip according to the related art does not have a perfect two-dimensional structure, but has a three-dimensional structure, so that there is a limitation in applying the flat Moebius strip to an integrated circuit such as a monolithic microwave integrated circuit (MMIC).

In other words, the flat Moebius strip according to the related art has a three-dimensional bridge for connecting the inner space to the outer space, which causes an electromagnetic interference, so that it is difficult to apply the flat Moebius strip to an RF passive element having a single resonance frequency characteristic.

Accordingly, the present invention provides a monopole antenna to which a quasi-Moebius strip having a via-hole structure is applied in order to minimize a line coupling effect due to structural characteristics of the flat Moebius strip according to the related art and to maximize miniaturization.

In other words, the present invention maintains the same physical length of the Moebius strip while increasing the number of times the Moebius strip is cut along the circumference for the purpose of miniaturization.

In this case, a total circumferential length of the Moebius strip cut along the circumference is twice the circumferential length of the typical Moebius strip.

In addition, when the quasi-Moebius strip cut along the circumference is applied to an RF circuit design, the total circumferential length can be shortened while maintaining the resonance frequency.

Figure 15:
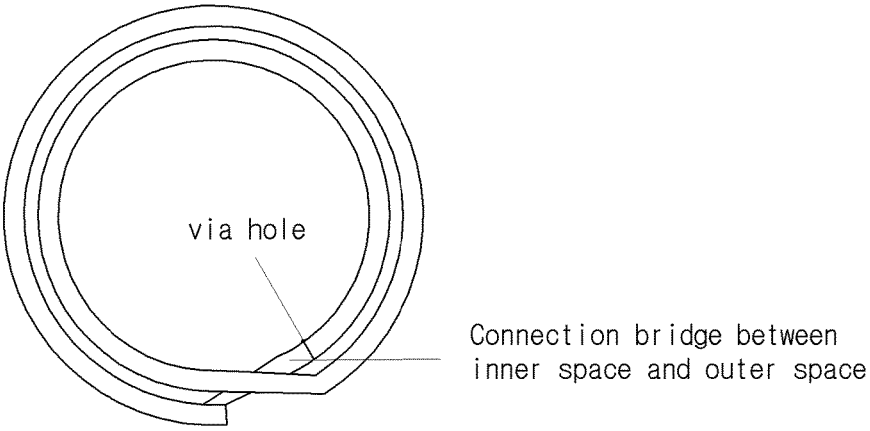
FIG. 15 is a front view showing a quasi-Moebius strip.
Figure 16:
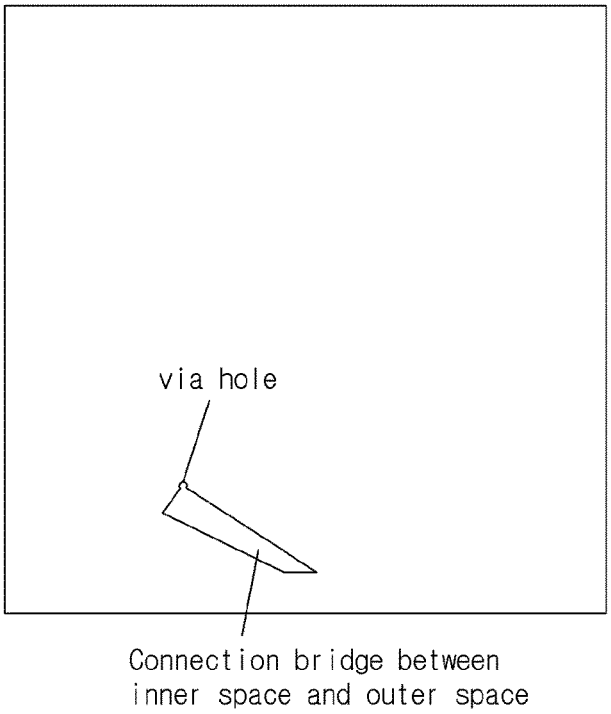
FIG. 16 is a rear view showing the monopole antenna shown in FIG. 15.

FIG. 15 is a front view showing a quasi-Moebius strip, and FIG. 16 is a rear view showing the monopole antenna shown in FIG. 15.

As shown in FIGS. 15 and 16, the quasi-Moebius strip includes: a radiator arranged on a center of a front surface of a dielectric substrate, and including a plurality of loops formed in a structure in which the quasi-Moebius strip is cut at least one time along a circumference; a first bridge for sequentially connecting one end of each of the loops; and a second bridge for connecting via-holes respectively formed at one end of an innermost loop and an outermost loop.

In other words, in order to minimize the line coupling effect, which is a problem of the flat Moebius strip according to the related art, the bridges connecting the inner space and the outer space where the two rings intersect with each other are physically separated into front and rear surfaces of the substrate, and connected to each other by the via-holes.

As the quasi-Moebius strip structure is applied, the present invention can minimize the line coupling effect at a low frequency and the electromagnetic interference that may occur severely as the RF circuit is miniaturized at an identical resonance frequency.

The quasi-Moebius strip may be derived as shown in Equations 4 and 5 when N is an even number.

$$M(t, s) = \left[R + s \cdot \cos\left(\frac{1}{2}t\right)\right] \cdot \cos(t), \quad \text{for } 0 \le t \le \pi, \ldots, 2N\pi \le t \le (2N+1)\pi \qquad \text{[Equation 4]}$$

$$M(t, s) = \left[R + s \cdot \cos\left(\frac{1}{2}t\right)\right] \cdot \sin\left(t + N \times \frac{1}{2}\pi\right), \quad \text{for } \pi \le t \le 2\pi, \ldots, (2N+1)\pi \le t \le 2(N+1)\pi \qquad \text{[Equation 5]}$$

wherein s∈[−ω∩], t∈[0, 2(N+1)π], R=Radius of the Quasi-Moebius strip, and N=Number of cuts of the Quasi-Moebius strip.

Meanwhile, the quasi-Moebius strip may be derived as shown in Equations 6 and 7 when N is an odd number.

$$M(t, s) = \left[R + s \cdot \cos\left(\frac{1}{2}t\right)\right] \cdot \cos(t), \quad \text{for } 0 \le t \le \pi, \ldots, 2N\pi \le t \le (2N+1)\pi \qquad \text{[Equation 6]}$$

$$M(t, s) = \left[R + s \cdot \cos\left(\frac{1}{2}t\right)\right] \cdot \sin\left(t + N \times \frac{1}{2}\pi\right), \quad \text{for } \pi \le t \le 2\pi, \ldots, (2N+1)\pi \le t \le 2(N+1)\pi \qquad \text{[Equation 7]}$$

In addition, the quasi-Moebius strip may be derived as shown in Equations 8 and 9 when N=2.

$$M(t, s) = \left[R + s \cdot \cos\left(\frac{1}{2}t\right)\right] \cdot \cos(t), \quad \text{for } 0 \le t \le \pi, \ldots, 4\pi \le t \le 5\pi \qquad \text{[Equation 8]}$$

$$M(t, s) = \left[R + s \cdot \cos\left(\frac{1}{2}t\right)\right] \cdot \sin\left(t + N \times \frac{1}{2}\pi\right), \quad \text{for } \pi \le t \le 2\pi, \ldots, 5\pi \le t \le 6\pi \qquad \text{[Equation 9]}$$

Figure 17:
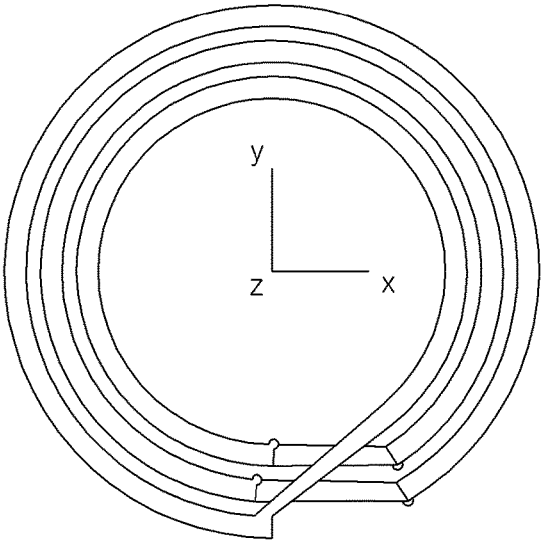
FIG. 17 is a front view showing the quasi-Moebius strip when N=2.

FIG. 17 is a front view showing the quasi-Moebius strip when N=2.

As described above, when the number N of cutting the quasi-Moebius strip along the circumference thereof is increased, it can be seen that the total circumferential length is increased by (N+1) times. Therefore, the miniaturization of the quasi-Moebius strip can be achieved by increasing N under a condition of the identical resonance frequency.

Accordingly, in this embodiment, miniaturized circuits and systems can be designed at the identical resonance frequency by applying the quasi-Moebius strip in which N is increased to the RF circuit design.

In this embodiment, when the phase difference between the inner space and the outer space of the quasi-Moebius strip is 180°, the quasi-Moebius strip can be miniaturized by increasing the number N of cutting the quasi-Moebius strip along the circumference.

Figure 18A:
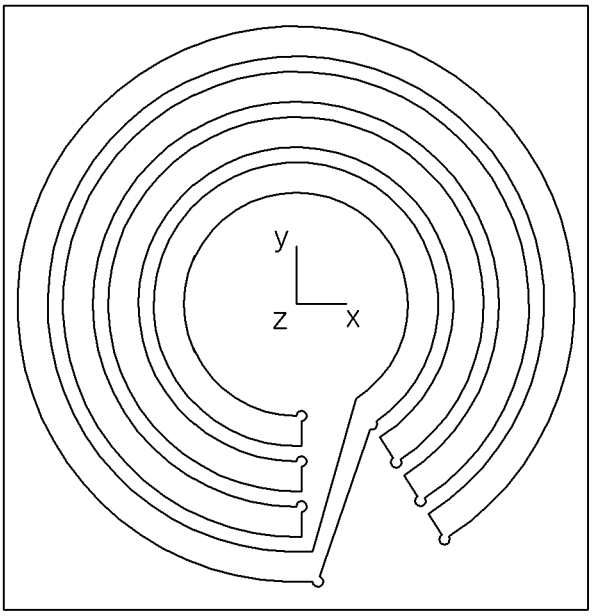
FIGS. 18A and 18B are a front view and a rear view showing the quasi-Moebius strip when N=3, respectively.
Figure 18B:
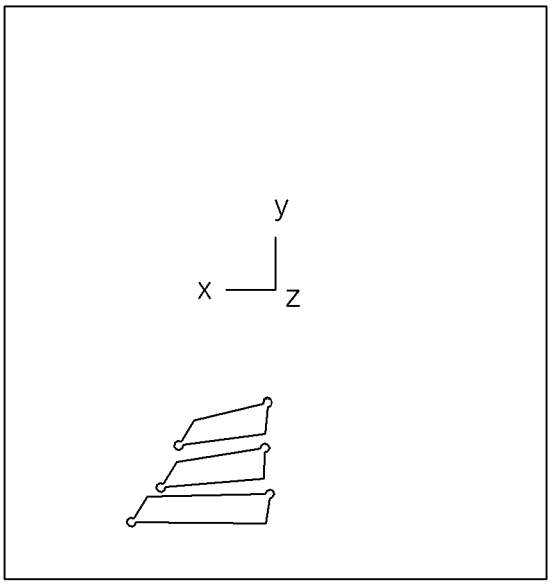

In addition, FIGS. 18A and 18B are a front view and a rear view showing the quasi-Moebius strip when N=3, respectively.

When N=3, the total circumferential length becomes 87c, and an odd-numbered ring and an even-numbered ring are designed in a flat shape on the substrate with the phase difference of 180°.

As shown in FIGS. 18A and 18B, in order to minimize the electromagnetic interference, a connection bridge for a ring 1 and a ring 4 are designed on the front surface of the substrate, connection bridges for the ring 1 and a ring 2, the ring 2 and a ring 3, and the ring 3 and the ring 4 are designed on the front surface of the substrate and connected to each other by the via-holes.

3. Impedance Matching of Quasi-Moebius Strip by Parameter Sweep

When the number N of cutting the quasi-Moebius strip along the circumference thereof is increased, the total circumferential length is increased by (N+1) times, so that the miniaturization can be achieved by increasing N of the quasi-Moebius strip.

The quasi-Moebius strip having the via-hole structure does not resonate with a designed resonance frequency without optimization of a position of the via-hole and the structure of the quasi-Moebius strip.

Hereinafter, an impedance matching process optimized for a designed resonance frequency through a parameter sweep will be described based on variations in the position and a size of the via-hole of the quasi-Moebius strip having the via-hole structure, and a thickness of a ring of the quasi-Moebius strip, and the width of the bridge.

Three parameters of the parameter sweep for the impedance matching of the quasi-Moebius strip are a thickness of a ring line of the quasi-Moebius strip, the width of the bridge, and a variation in the position and a radius of the via-hole.

Therefore, a process in which the resonance frequency and the impedance matching vary will be described as the thickness of the ring line of the quasi-Moebius strip is changed among the three parameters.

Figure 19:
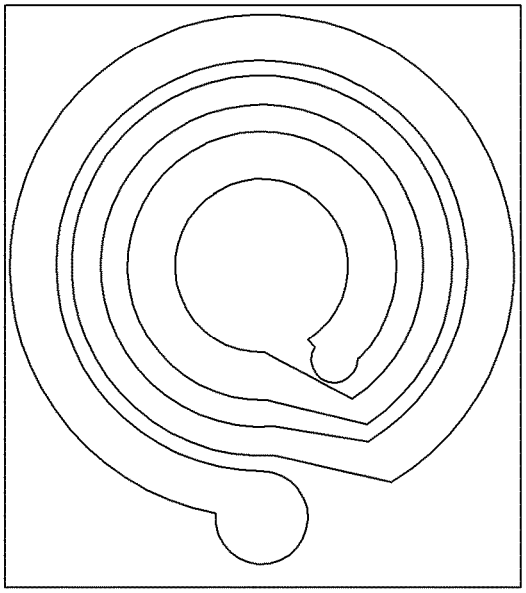
FIG. 19 is a front view showing an optimized quasi-Moebius strip.
Figure 20:
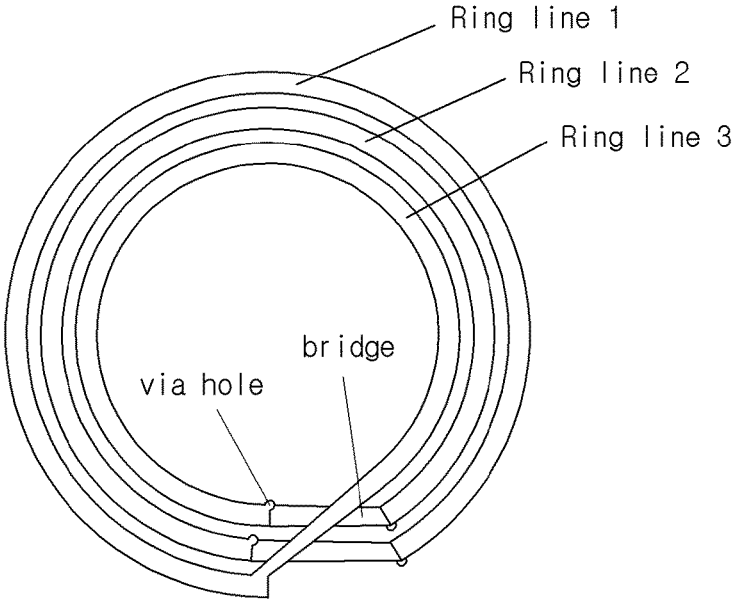
FIG. 20 is a view showing parameters of the quasi-Moebius strip.

Table 7 shows the resonance frequency and a return loss according to a variation in the thickness of the ring line of the quasi-Moebius strip, FIG. 19 is a front view showing an optimized quasi-Moebius strip, and FIG. 20 is a view showing parameters of the quasi-Moebius strip.

TABLE 7

| Thickness of ring line | | Primary | |
|---|---|---|---|
| Helical line number (1, 2, 3) | Thickness (mm) | resonance frequency (GHz) | $S_{11}$(dB) |
| 1, 2, 3 | 0.6 | 2.430 | −15.350 |
| 1, 2, 3 | 0.7 | 2.430 | −15.210 |
| 1, 2, 3 | 0.8 | 2.430 | −15.416 |
| 1, 2, 3 | 0.9 | 2.440 | −16.181 |
| 1, 2, 3 | 1 | 2.505 | −17.550 |
| 3 | 1 | 2.415 | −15.151 |
| 1, 2 | 0.6 | | |
| 1 | 1 | 2.455 | −16.211 |
| 2, 3 | 0.6 | | |
| 2 | 1 | 2.340 | −13.405 |
| 1, 3 | 0.6 | | |
| 1 | 0.6 | 2.720 | −28.006 |
| 2, 3 | 1 | | |
| 2 | 0.6 | 2.49 | −17.0226 |
| 1, 3 | 1 | | |
| 3 | 0.6 | 2.435 | −15.6295 |
| 1, 2 | 1 | | |

As disclosed in Table 7, the thickness of the ring line having a best return loss characteristic while approaching to the designed resonance frequency of 2.4 GHz is achieved when ring lines 1 and 3 have a thickness of 1 mm, and a ring line 2 has a thickness of 0.6 mm.

Figure 21:
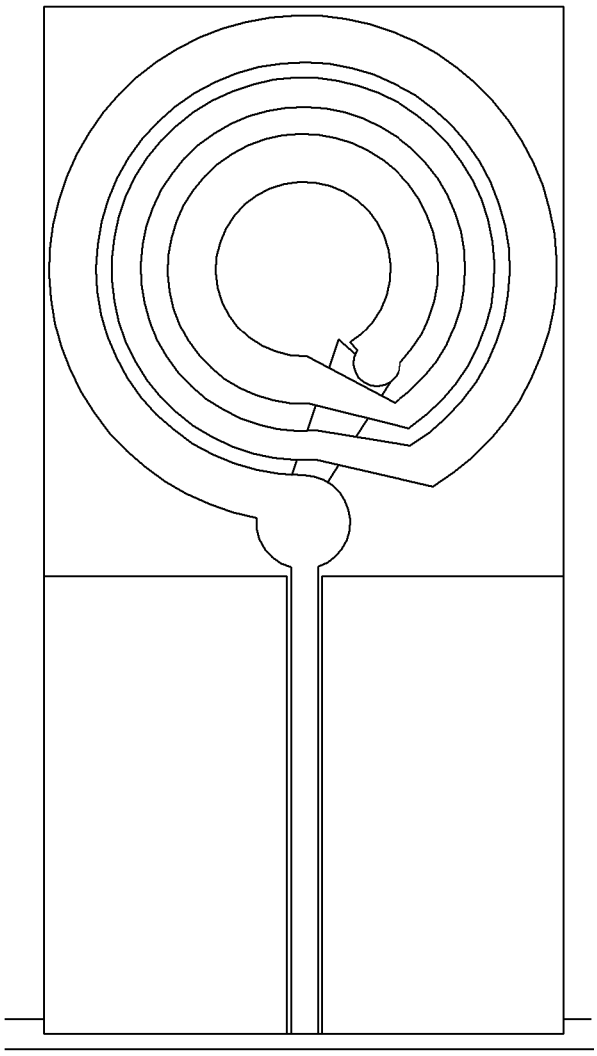
FIG. 21 is a block diagram showing a monopole antenna to which the quasi-Moebius strip is applied.

FIG. 21 is a block diagram showing a monopole antenna to which the quasi-Moebius strip is applied.

As shown in FIG. 21, a monopole antenna to which the quasi-Moebius strip is applied can be optimized by varying the three parameters of the Moebius strip, that is, the thickness of the ring line, the width of the bridge, and the position and radius of the via-hole.

Figure 22:
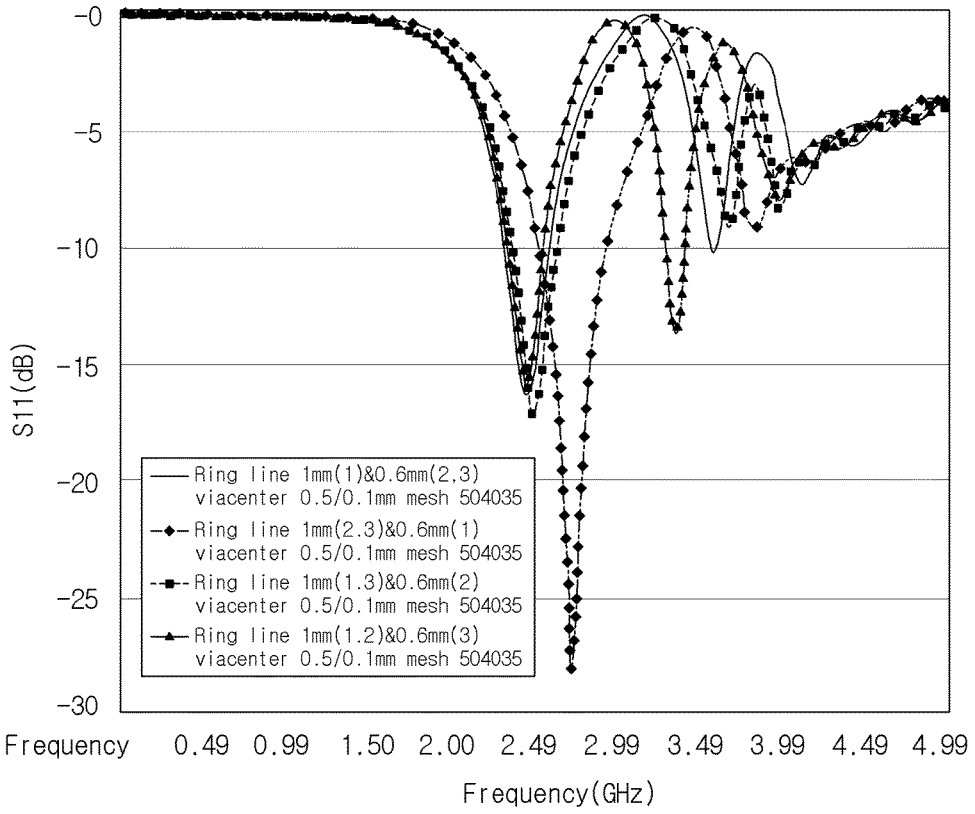
FIG. 22 is a graph showing a result of simulation for a resonance frequency and a return loss according to a thickness variation of a ring line.

FIG. 22 is a graph showing a result of simulation for a resonance frequency and a return loss according to a thickness variation of a ring line.

Next, a process of optimizing the resonance frequency and the impedance matching by varying the position and radius of the via-hole of the quasi-Moebius strip among the three parameters of the quasi-Moebius strip will be described.

The thickness of the ring line of the quasi-Moebius strip is optimized when the thickness of the ring lines 1 and 3 is 1 mm in, and the thickness of the ring line 2 is 0.6 mm.

Therefore, the optimization can be achieved by varying the position and the radius of the via-hole under the above conditions.

Table 8 shows the resonance frequency and the return loss according to the variation in the position and radius of the via-holes of the quasi-Moebius strip.

TABLE 8

| Position and radius of via-hole | | Resonance | |
|---|---|---|---|
| Position | Radius (mm) | frequency (GHz) | $S_{11}$(dB) |
| center | 0.5(H) | 2.445 | −15.348 |
| center | 0.5(L) | | |
| center | 0.8(H) | 2.460 | −15.94 |
| center | 0.8(L) | | |
| center | 1(H) | 2.475 | −16.92 |
| center | 1(L) | | |
| center | 0.5(H) | 2.490 | −17.023 |
| center | 1(L) | | |
| center | 1(H) | 2.445 | −15.436 |
| center | 0.5(L) | | |
| edge | 0.5(H) | 2.450 | −15.9027 |
| edge | 0.5(L) | | |
| edge | 0.8(H) | 2.465 | −16.66 |
| edge | 0.8(L) | | |
| edge | 1(H) | 2.490 | −17.15 |
| edge | 1(L) | | |
| edge | 0.5(H) | 2.470 | −16.631 |
| edge | 1(L) | | |
| edge | 1(H) | 2.470 | −16.51 |
| edge | 0.5(L) | | |

As disclosed in Table 8, the position and radius of the via-hole having the best return loss characteristic while approaching to the designed resonance frequency of 2.4 GHz are achieved when a via-hole located on an upper side about a y axis has a radius of 0.5 mm, and a via-hole located on a lower side has a radius of 1 mm.

Next, a process of optimizing the resonance frequency and the impedance matching by varying the width of the bridge among the three parameters of the quasi-Moebius strip will be described.

The resonance frequency and the return loss can be optimized by varying the width of the bridge of the quasi-Moebius strip under the condition of the optimized thickness of the ring line, and the optimized position and radius of the via-hole of the quasi-Moebius strip.

Figure 23:
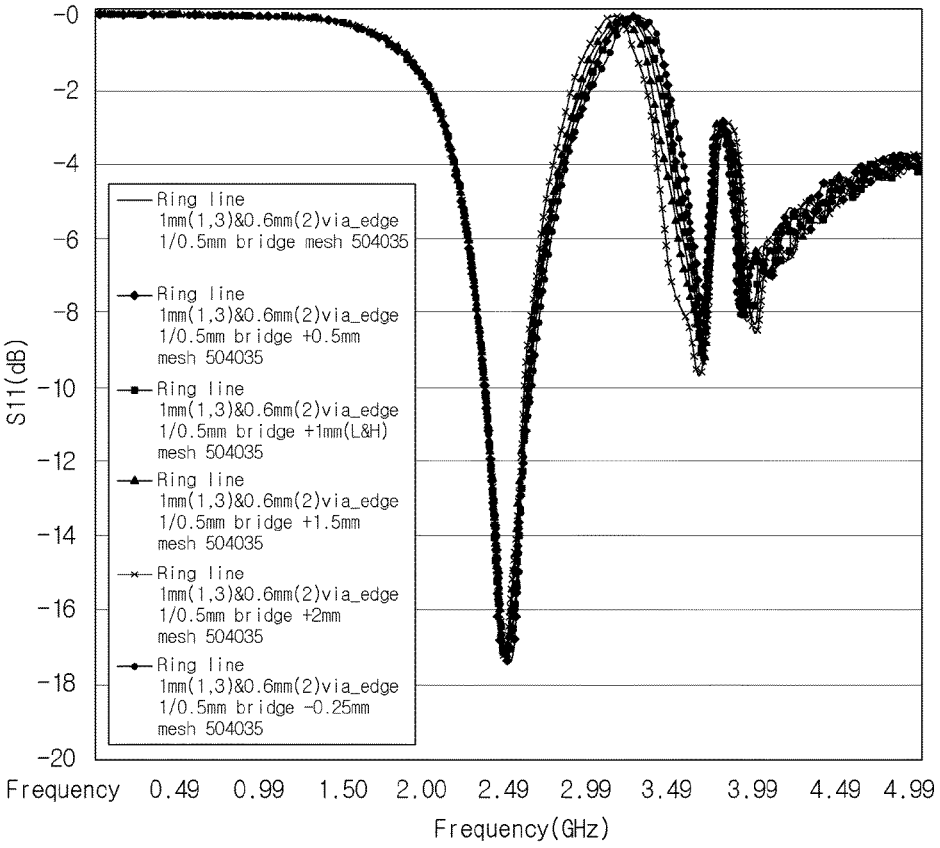
FIG. 23 is a graph showing a result of measurement for the resonance frequency and the return loss according to a width variation of a bridge.

Table 9 shows the resonance frequency and the return loss according to a width variation of the bridge, and FIG. 23 is a graph showing a result of measurement for the resonance frequency and the return loss according to the width variation of the bridge.

TABLE 9

| Position and area of bridge | | Primary resonance | |
|---|---|---|---|
| Position | Area (mm) | frequency (GHz) | $S_{11}$ (dB) |
| center | 0 | 2.495 | −17.21 |
| center | +0.5 | 2.490 | −17.2663 |
| center | 1 | 2.490 | −17.0826 |
| center | 1.5 | 2.485 | −17.1833 |
| center | 2 | 2.475 | −17.079 |
| center | −0.25 | 2.495 | −17.2586 |

According to Table 9, the width of the bridge having an excellent return loss characteristic while approaching to the designed resonance frequency of 2.4 GHz is achieved when the width of the bridge is about 0.5 mm wide as shown in FIG. 23.

Finally, it is possible to design an optimized quasi-Moebius strip with the excellent return loss characteristic while approaching to the designed resonance frequency of 2.4 GHz by varying the three parameters of the quasi-Moebius strip.

According to the simulation results, it is confirmed that the return loss of the quasi-Moebius strip is optimized when the thickness of the ring lines 1 and 3 is 1 mm, the thickness of the ring line 2 is 0.6 mm, the via-hole located on the upper side about the y axis has the radius of 0.5 mm, and the via-hole located on the lower side has the radius of 1 mm.

Finally, the width of the bridge of the quasi-Moebius strip is optimized when the width of the bridge is about 0.5 mm wide.

Meanwhile, it is confirmed from the simulation results that ring antennas having three modified ring lines constituting the quasi-Moebius strip and having mutually different radii do not form the resonant frequency.

Figure 24:
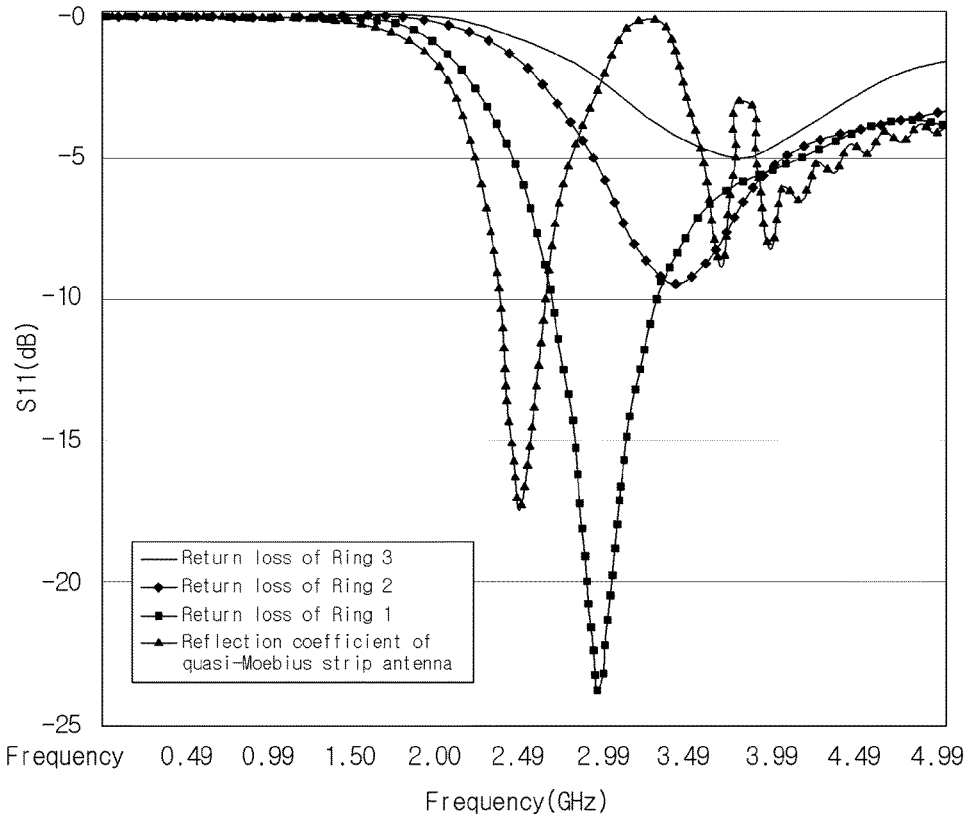
FIG. 24 is a graph showing a result of comparing return losses of ring 1, 2, 3 antennas having mutually different radii with the return loss of the quasi-Moebius strip antenna.

FIG. 24 is a graph showing a result of comparing return losses of ring 1, 2, 3 antennas having mutually different radii with the return loss of the quasi-Moebius strip antenna.

According to the simulation result, the resonance frequency of the quasi-Moebius strip antenna is formed in the 2.4 GHz band, and the peak value of the return loss (S11) is 17.3 dB.

According to simulation and measurement results, the antenna applied with the quasi-Moebius strip optimized in the present embodiment is formed of three ring lines having mutually different radii, but has a characteristic of a single resonant frequency.

In addition, when compared with the conventional ring antenna having the same resonance frequency, the size of the antenna applied with the quasi-Moebius strip is miniaturized to about ⅓.

4. Via-Hole Equivalent Circuit

Figure 25:
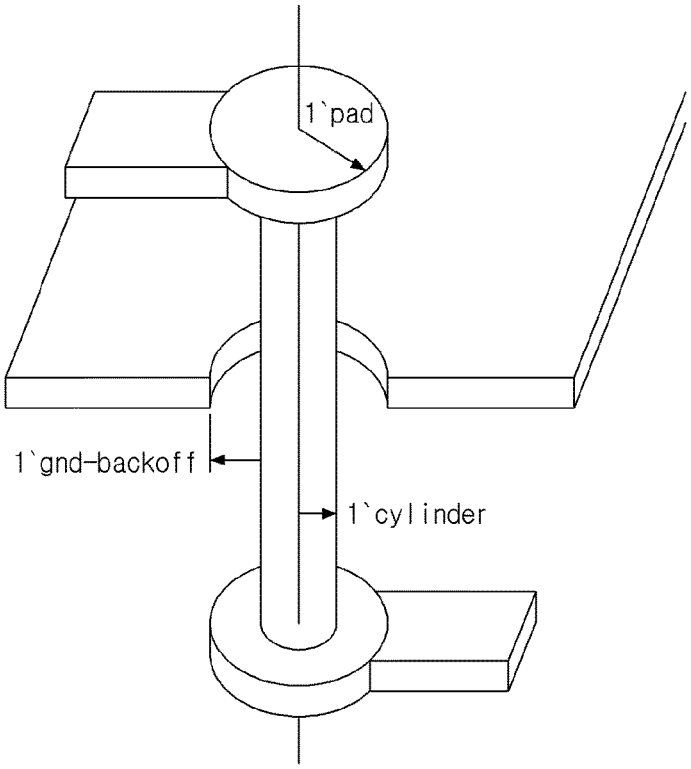
FIG. 25 is a view showing a via-hole structure connecting two microstrip lines.

FIG. 25 is a view showing a via-hole structure connecting two micro-strip lines.

As shown in FIG. 25, the via-hole may be formed of two pads and one cylinder.

Figure 26:
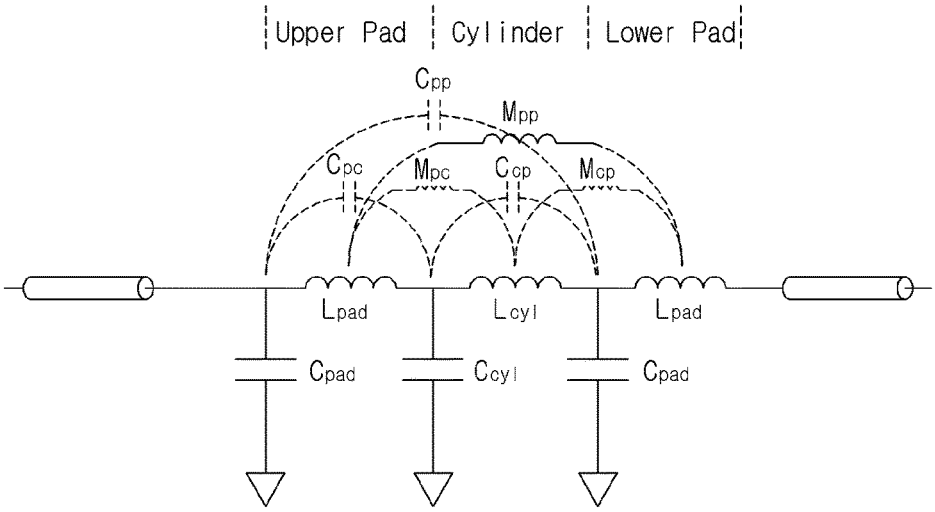
FIGS. 26 to 29 are equivalent circuit diagrams of a via-hole.

The complicate via-hole equivalent circuit can be simplified depending on the frequency and the bandwidth, and FIG. 26 is an equivalent circuit diagram of the most accurate but complex via-hole.

The equivalent circuit shown in FIG. 26 includes three distributed constant elements in a lossless transmission line. The three elements are an upper pad, a cylinder, and a lower pad, and there is a coupling capacitance between the elements. The mutual capacitance C between the elements exists between conductor elements. In addition, in the equivalent circuit shown in FIG. 26, the mutual inductance M is also present.

The mutual inductance M is generated by a magnetic flux generated by a change of a magnetic field according to the time between the coupled conductor elements. The equivalent circuit can be applied accurately regardless of the frequency, but the circuit is complicated and the simulation time may be long.

Figure 27:
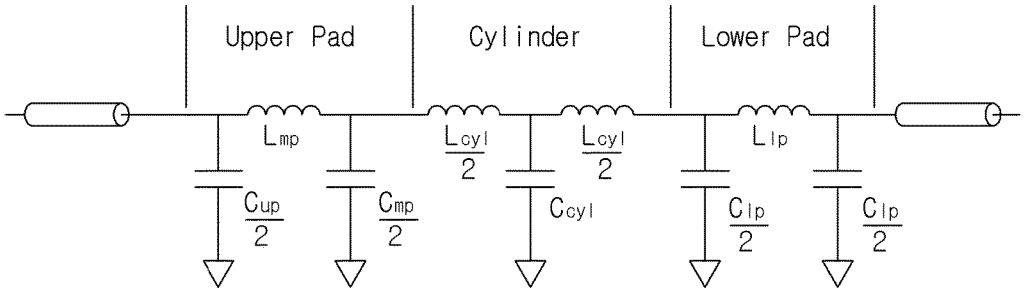

FIG. 27 is a distributed constant via equivalent circuit diagram which can be practically applied as compared with FIG. 26.

In FIG. 27, as the frequency becomes higher, there is a clear influence between the respective elements. As the diameter of the cylinder of the via-hole decreases, the upper pad and the lower pad become capacitive and the cylinder becomes inductive.

Therefore, the distributed constant via equivalent circuit shown in FIG. 27 excludes a coupling phenomenon between the respective elements, so that it is difficult to accurately apply the distributed constant via equivalent circuit at high frequencies.

Figure 28:
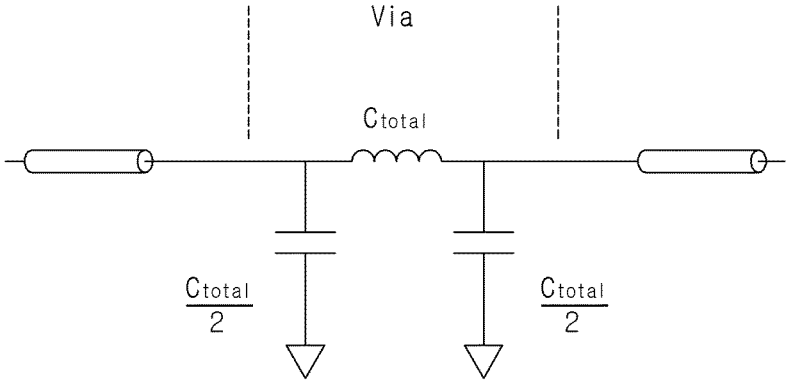

FIG. 28 is a lumped via equivalent circuit diagram.

The via-hole equivalent circuit shown in FIG. 28 is the simplest among the three via equivalent circuits, and can be practically applied when the resonance frequency is less than 3.5 GHz.

In the via-hole equivalent circuit, since the size of the via-hole is relatively small compared to the wave length at the low frequency, the energy radiated from the via-hole can be ignored. Therefore, the via-hole is interpreted as a lumped element.

However, in the high frequency, there is a strong interaction between the magnetic and electrical energies, resulting in non-negligible electromagnetic radiation. Therefore, the via-hole is interpreted as a full wave method or a n-type equivalent circuit including L (Inductor) and C (Capacitor).

When the target frequency is 2.4 GHz, since 2.4 GHz is a relatively low frequency, the via-hole is interpreted as a lumped element.

Figure 29:
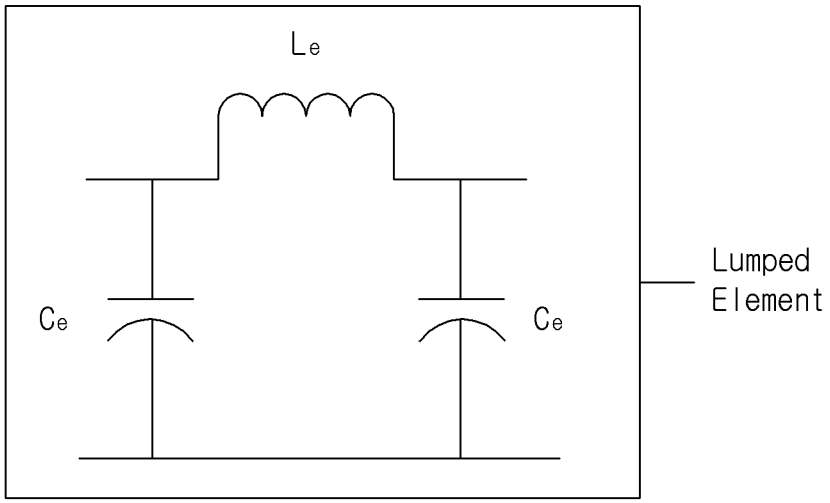
Figure 30A:
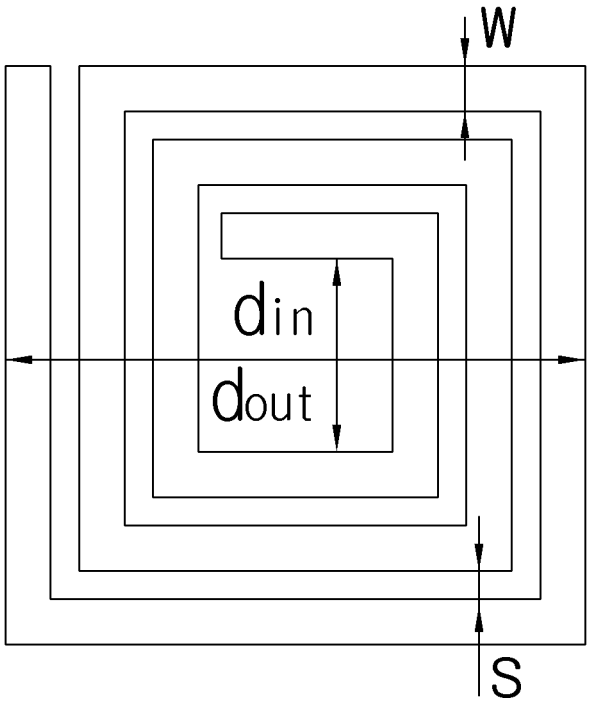
FIGS. 30A to 30D show examples of inductors implemented on a substrate.
Figure 30B:
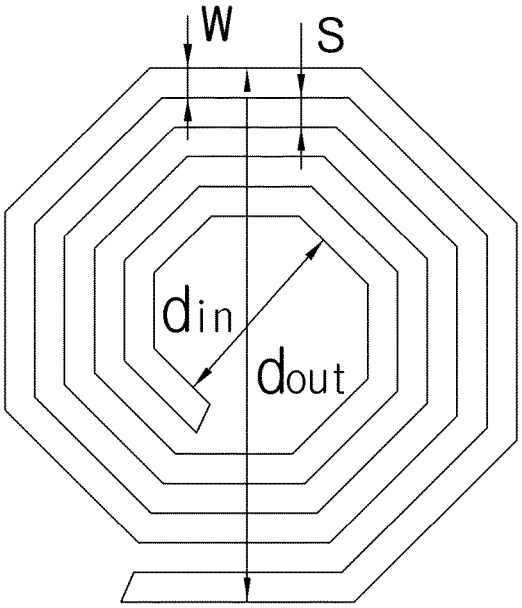
Figure 30C:
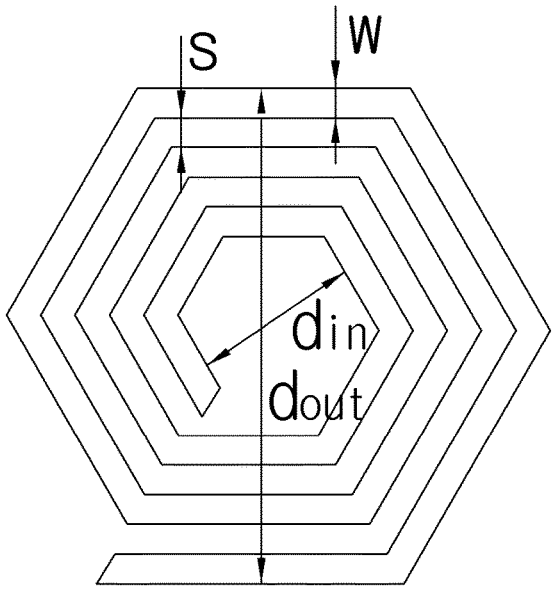
Figure 30D:
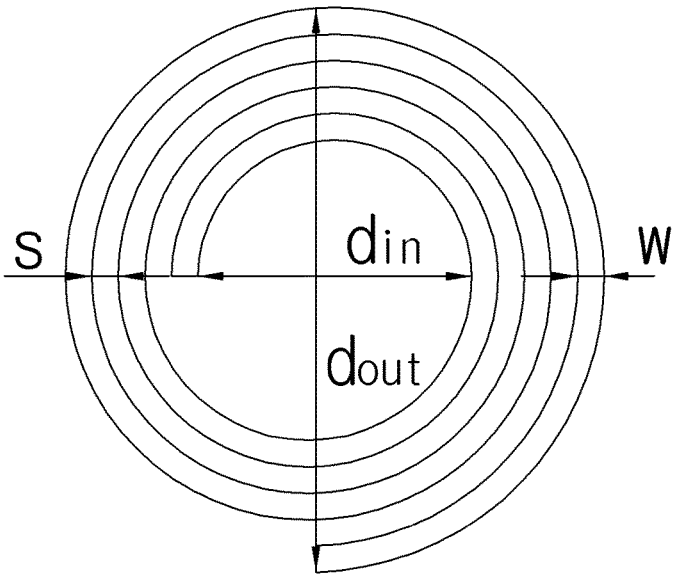

FIG. 29 is a via-hole equivalent circuit applied in this embodiment.

One via-hole is connected to one inductance L connected in series and two capacitances C connected in parallel. It can be deduced that the equivalent circuit of the entire quasi-Moebius strip varies depending on the radius and position of the via-hole from the via-hole equivalent circuit.

Meanwhile, the quasi-Moebius strip is formed of an inductance L component and a capacitance C component which increase according to the number of times of cutting.

The quasi-Moebius strip includes n ring lines and bridges.

FIGS. 30A to 30D show examples of inductors implemented on a substrate and Table 10 is a coefficient current sheet of an inductance L.

According to Table 10, since the shape of the ring line of the quasi-Moebius strip according to the present embodiment is a circle shape, c1, c2, c3, and c4 are 1.00, 2.46, 0.00, and 0.20, respectively.

TABLE 10

| Layout | $c_1$ | $c_2$ | $c_3$ | $c_4$ |
|---|---|---|---|---|
| Square | 1.27 | 2.07 | 0.18 | 0.13 |
| Hexagonal | 1.09 | 2.23 | 0.00 | 0.17 |
| Octagonal | 1.07 | 2.29 | 0.00 | 0.19 |
| Circle | 1.00 | 2.46 | 0.00 | 0.20 |

The impedance matching condition is obtained when the relationship between the characteristic impedance $Z_0$ and the load impedance $Z_L$ is a complex conjugate.

That is, to find L and C that meet the impedance matching condition of the quasi-Moebius strip antenna according to the present embodiment, it is necessary to derive L and C that satisfy the relation $Z_0=Z_L^*$, where $Z_0$=characteristic impedance=50Ω and $Z_L$=load impedance.

The total inductance L and the total capacitance C of the quasi-Moebius strip antenna are derived as shown in Equation (10) and Equation (11).

$$L_{total} = \sum_{i=0}^{M} L_{i+1} \approx \frac{\mu_0 M^2 d_{avg} c_1}{2}\left[\ln\left(\frac{c_2}{\rho}\right) + c_3\rho + c_4\rho^2\right], \quad \rho = \frac{d_{out} - d_{inner}}{d_{out} + d_{inner}} \qquad \text{[Equation 10]}$$

$$C_{total} = \sum_{i=0}^{M} \frac{1}{C_i}, \quad C_i = \varepsilon\frac{A}{H} = \varepsilon\frac{W \cdot L}{H} \qquad \text{[Equation 11]}$$

wherein W=longitudinal length (m) of conductor, L=transverse length (m) of conductor, and H=interval (m) between upper conductor and lower conductor.

Hereinafter, the equivalent circuit of the quasi-Moebius strip antenna will be explained by using the total L and C satisfying the impedance matching condition of the quasi-Moebius strip antenna derived from Equations (10) and (11), and the simulation results will be compared and analyzed to represent different points.

Figure 31:
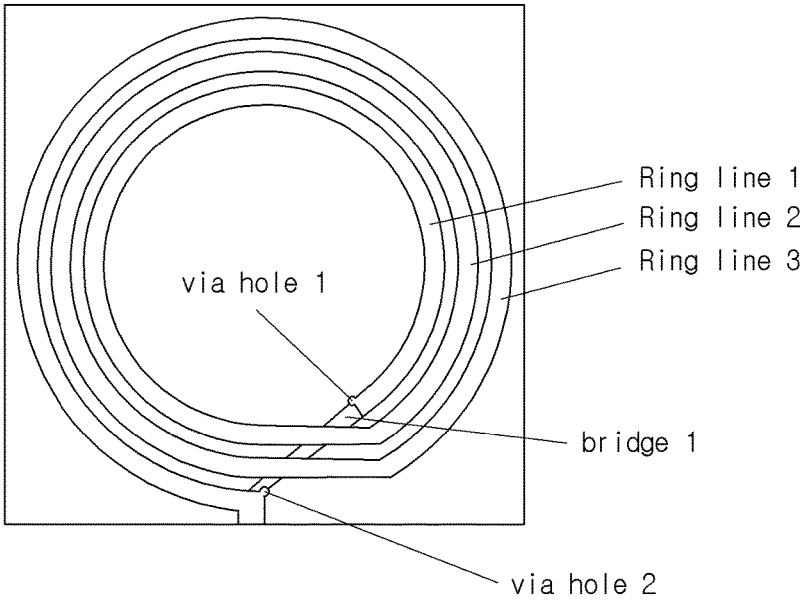
FIGS. 31 and 32 are block diagrams showing first and second quasi-Moebius strips, respectively.
Figure 32:
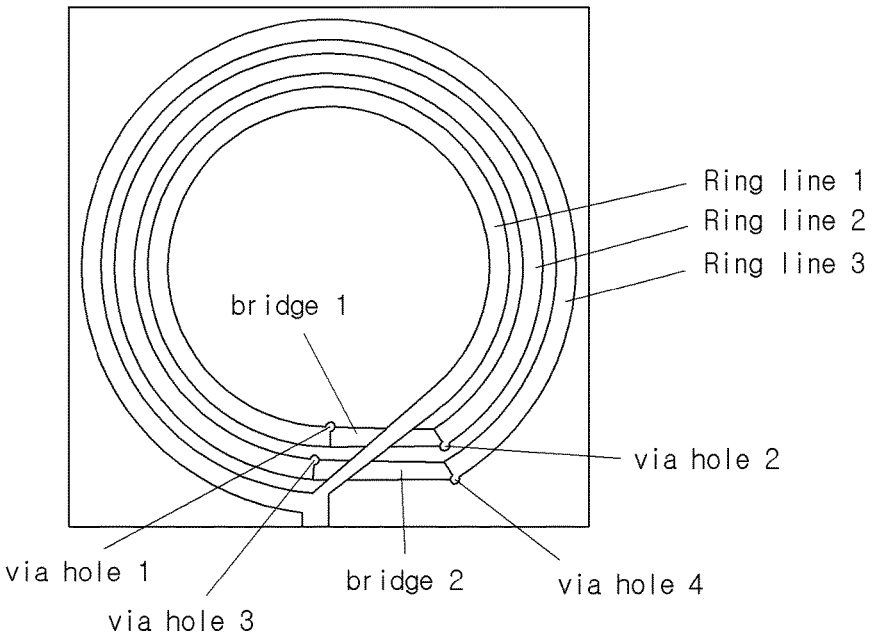

FIGS. 31 and 32 are block diagrams showing first and second quasi-Moebius strips (hereinafter referred to as "first type and second type"), respectively.

The first type quasi-Moebius strip is implemented as an open strip that is connected without the beginning and the end, which is the characteristic of the Moebius strip, by forming ring lines 1, 2, 3 by rotating ring lines having mutually different radii from 0° to 325° and connecting the ring lines 1, 2, 3 to each other at the front and rear surfaces of the substrate. That is, the first type quasi-Moebius strip is formed by connecting the ring line 1 having a radius of 3 mm to the ring line 2 having a radius of 3.75 and connecting the ring line 3 having a radius of 4.5 mm to the ring line 2 at the front surface of the substrate. In addition, the ring line 1 is connected to the ring line 3 via the bridge 1 at the rear surface of the substrate.

The second type quasi-Moebius strip is implemented as an open strip that is connected without the beginning and the end, which is the characteristic of the Moebius strip, by forming ring lines 1, 2, 3 by rotating ring lines having mutually different radii from 0° to 325° and connecting the ring line 1 to the ring line 3 at the front surface of the substrate and connecting the ring line 1 to the ring line 2 and connecting the ring line 2 to the ring line 3 at the rear surface of the substrate.

Figure 33:
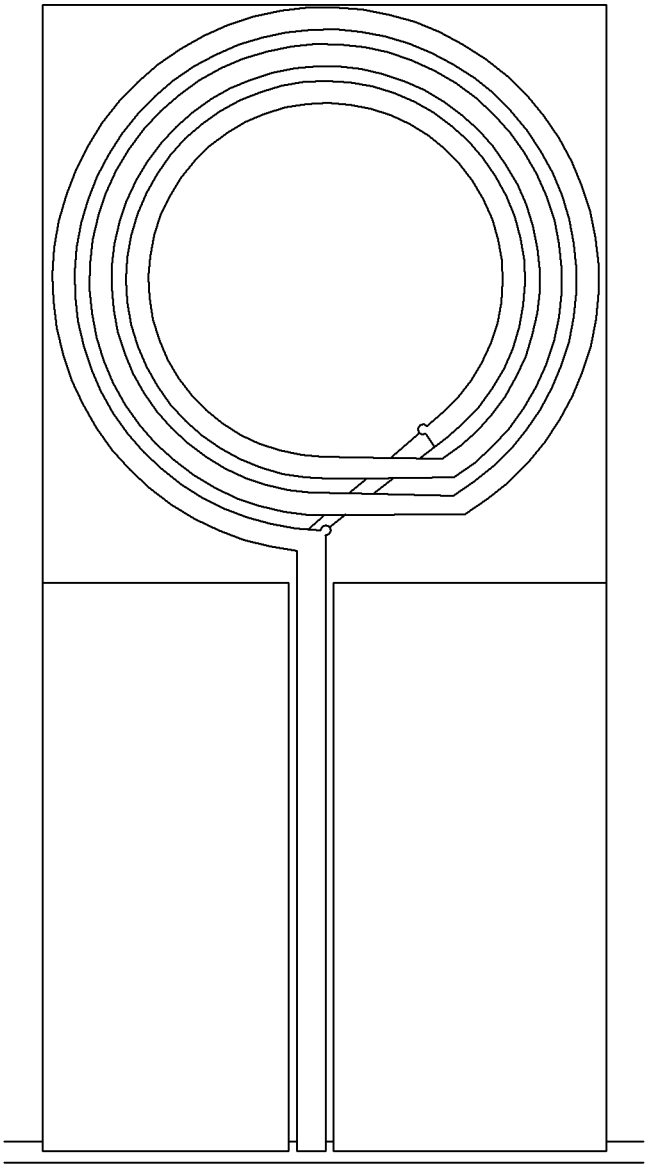
FIGS. 33 and 34 are block diagrams showing first and second quasi-Moebius strip antennas, respectively.
Figure 34:
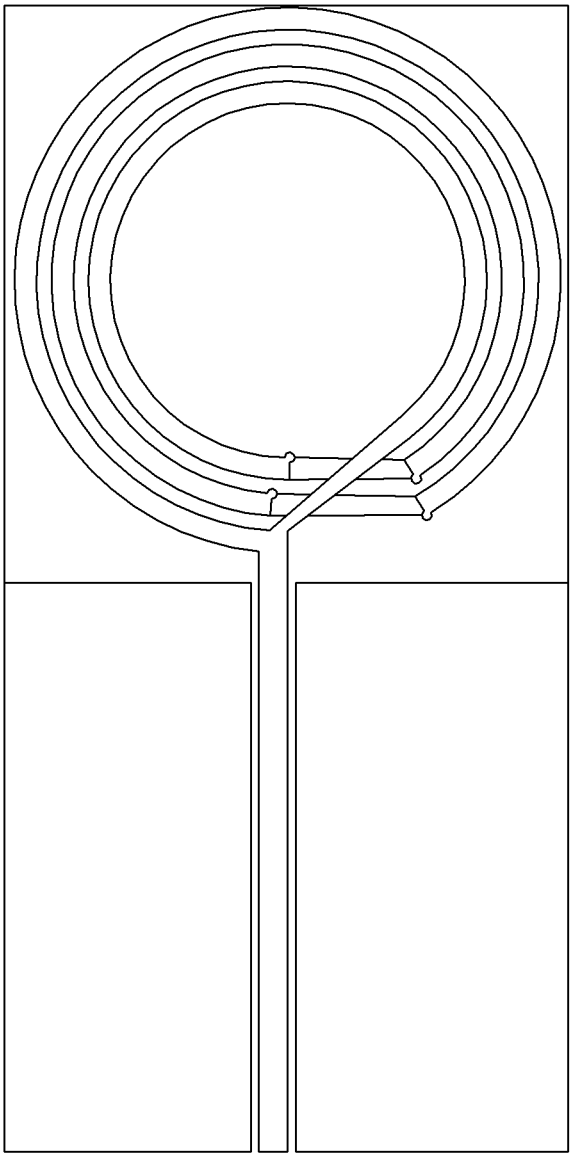

FIGS. 33 and 34 are block diagrams showing first and second quasi-Moebius strip antennas, respectively.

When N=2, the antenna to which the first type quasi-Moebius strip is applied has one bridge and two via-holes. The antenna to which the second type quasi-Moebius strip is applied has two bridges and four via-holes.

That is, since the C and L components of the equivalent circuit vary depending on the number of via-holes and the number of bridges, the equivalent circuit of the antenna to which the first type quasi-Moebius strip is applied is different from the equivalent circuit of the antenna to which the second type quasi-Moebius strip is applied.

According to the simulation result, the difference in the return loss characteristic proportionally increases as the first type quasi-Moebius strip antenna and the second type quasi-Moebius strip antenna are miniaturized (as N increases).

Particularly, according to the simulation result obtained when N=3, the first type quasi-Moebius strip antenna has a wide bandwidth of about 1.5 GHz to 5 GHz based on −10 dB. However, the resonance frequency rarely occurs in the second type quasi-Moebius strip antenna.

Accordingly, the first type quasi-Moebius strip antenna is applied to the present invention.

Figure 35:
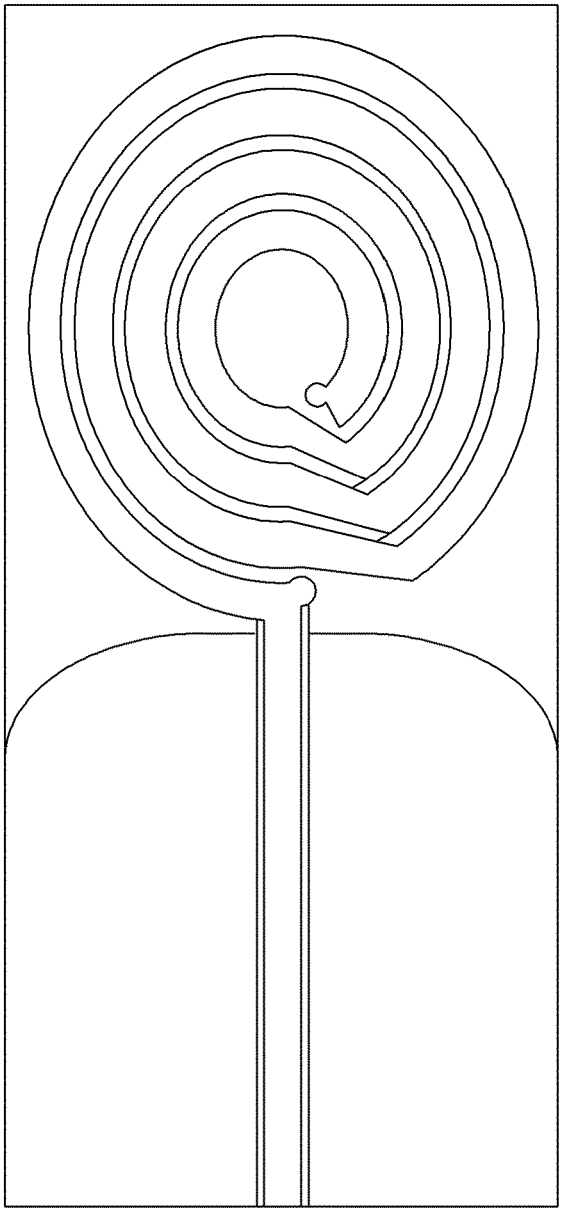
FIGS. 35 and 36 are a front view and a rear view showing an antenna to which a quasi-Moebius strip is applied according to a preferred embodiment of the present invention.
Figure 36:
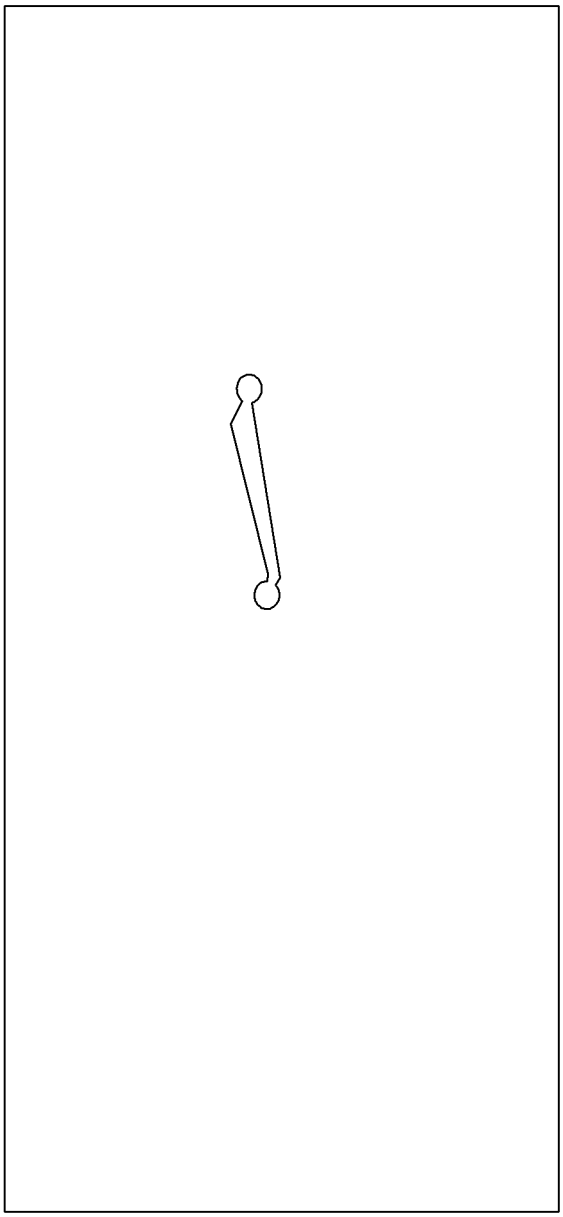

FIGS. 35 and 36 are a front view and a rear view showing an antenna to which a quasi-Moebius strip is applied according to a preferred embodiment of the present invention.

In the quasi-Moebius strip according to the preferred embodiment of the present invention, as shown in FIGS. 35 and 36, when N=3, the ring 1 and the ring 4 are connected to each other through the bridge 1, the ring 3 and the ring 4 are connected to each other through the bridge 2, the ring 2 and the ring 3 are connected to each other through the bridge 3, and the ring 1 and the ring 2 are connected to each other through the bridge 4.

In order to increase the miniaturization effect in the present embodiment, the distance of the ring 1, the ring 2, the ring 3, and the ring 4 may be set to a radius r, 1.68 mm, which is 0.5 times of 3.36 mm.

In addition, in order to minimize the electromagnetic wave interference phenomenon and increase the miniaturization effect in the present embodiment, the bridge 1 may be provided on the rear surface of the substrate, and the bridge 2, the bridge 3, and the bridge 4 may be provided on the front surface of the substrate.

However, the present invention is not limited thereto, and the bridge 1 may be provided on the front surface of the substrate, and the bridge 2 to the bridge 4 may be provided on the rear surface of the substrate.

As the antenna using the quasi-Moebius strip described in the present embodiment is miniaturized, that is, as the N (number of cuts) increases, the number of rings (=helical lines) constituting the quasi-Moebius strip, the number of bridges, and the number of via-holes increase proportionally.

That is, as the antenna to which the quasi-Moebius strip is applied is miniaturized, the equivalent circuit is changed due to the change and increase of the inductance L and the capacitance C, so the corresponding impedance matching method can be applied.

5. Simulation and Measurement Results

Figure 37:
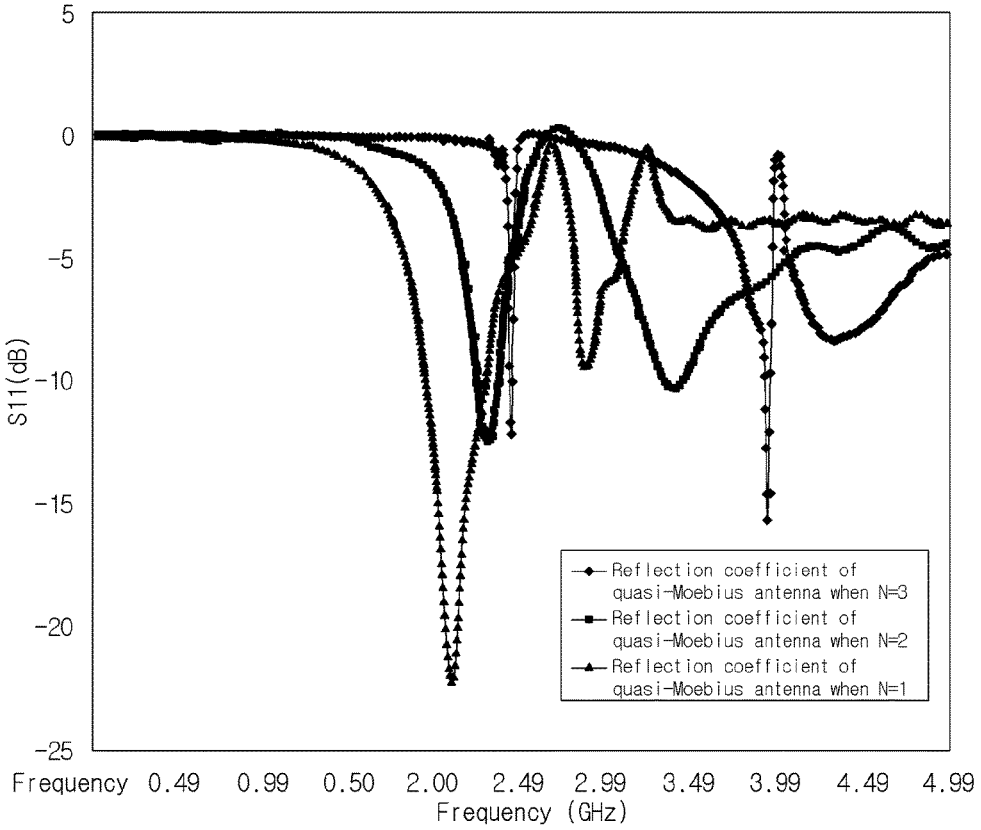
FIG. 37 is a graph showing simulation results in which, when N=1, 2, and 3, return losses and resonance frequencies of a first type quasi-Moebius strip antenna are compared with each other.

FIG. 37 is a graph showing the simulation results in which, when N=1, 2, and 3, return losses and resonance frequencies of a first type quasi-Moebius strip antenna are compared with each other.

The simulation results show that as the quasi-Moebius strip antenna is miniaturized, the return loss characteristic deteriorates, the line coupling effect increases, and the resonance frequency increases.

That is, as the number of N of the quasi-Moebius strip increases, an impedance matching method and a procedure to be applied to a miniaturized quasi-Moebius strip antenna are required.

Accordingly, there is a need to perform an impedance matching process optimized for the resonance frequency, which is designed through the parameter sweep according to the position and size of the via-hole of the quasi-Moebius strip, the ring line thickness of the quasi-Moebius strip, and the size of the bridge.

Figure 38:
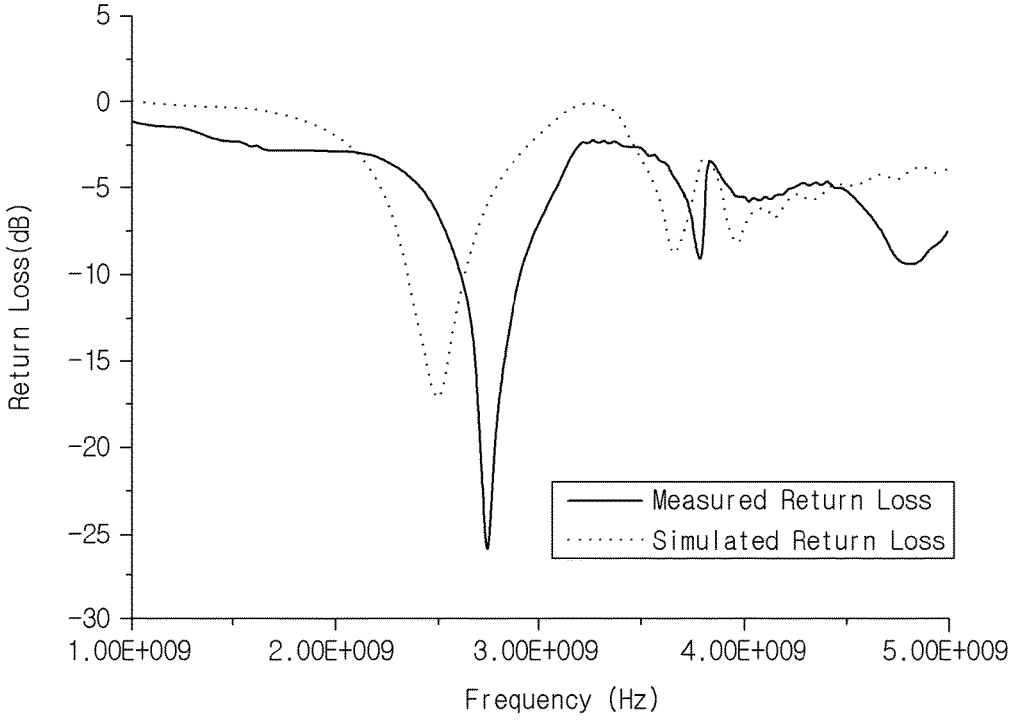
FIG. 38 is a graph in which simulation results of the return loss of the optimized quasi-Moebius strip antenna are compared with measurement results thereof.
Figure 39A:
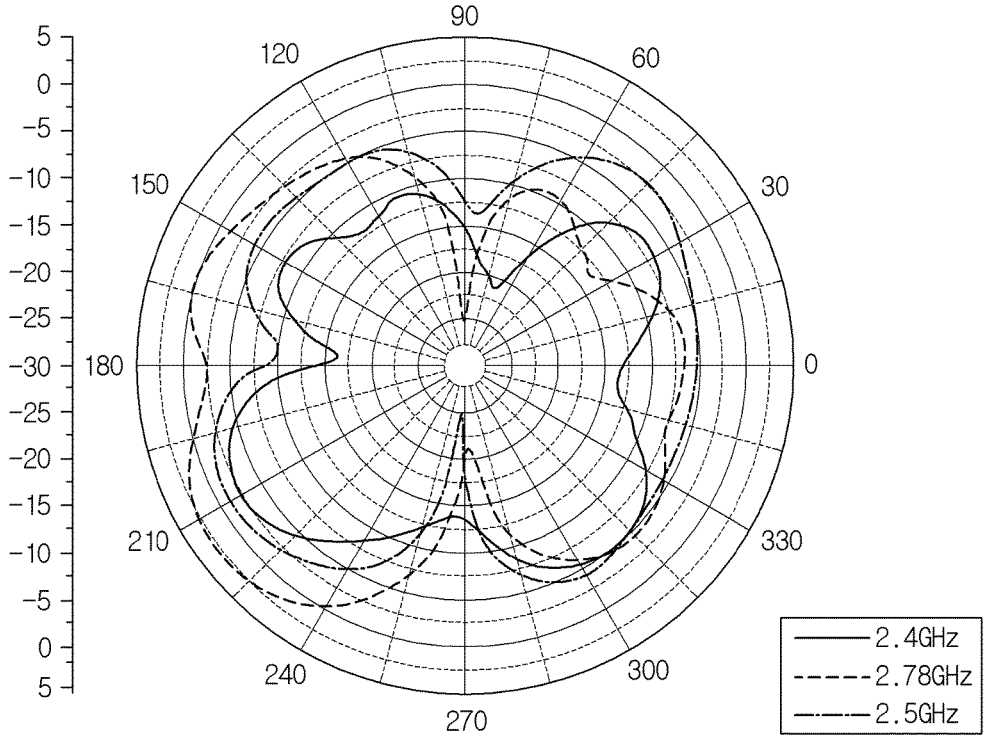
FIGS. 39A and 39B and FIGS. 40A and 40B are graphs showing measurement results of radiation patterns of the optimized quasi-Moebius strip antenna and the quasi-Moebius strip antenna, respectively.
Figure 39B:
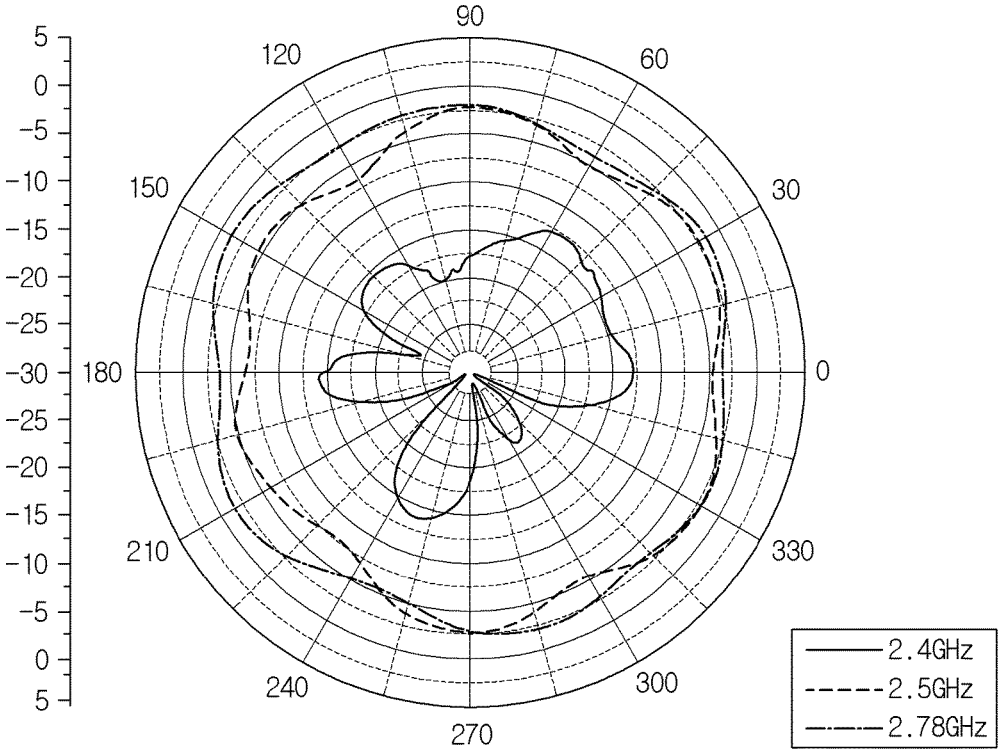
Figure 40A:
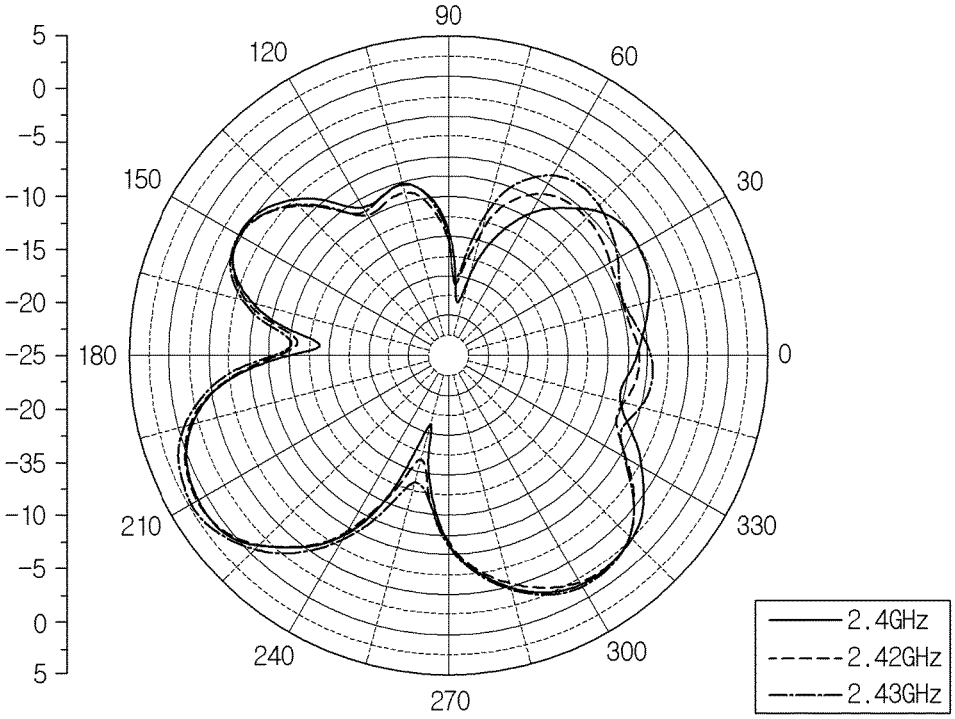
Figure 40B:
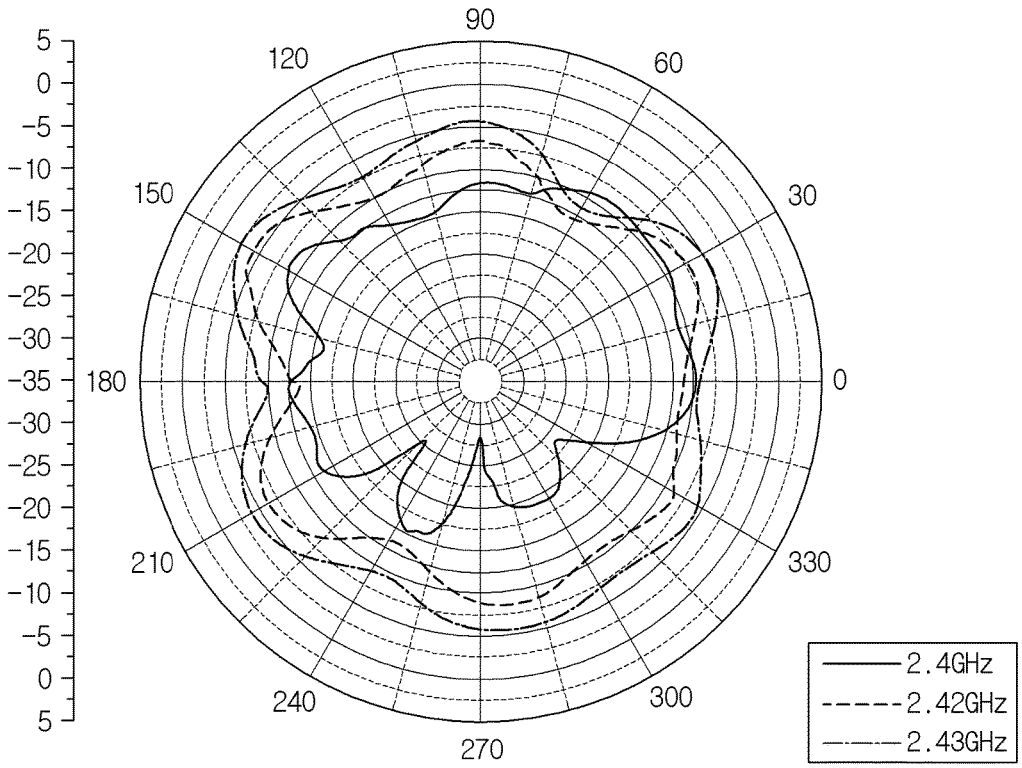

FIG. 38 is a graph in which simulation results of the return loss of the optimized quasi-Moebius strip antenna are compared with measurement results thereof.

Referring to FIG. 38, when compared to the simulation result, the resonance frequency is shifted toward about 300 MHz, and the reflection coefficient is sharply dropped to 27 dB.

The resonance frequency designed in the present embodiment is 2.4 GHz, but the actual resonance frequency according to the measurement result of FIG. 38 is 2.78 GHz, so the radiation pattern was measured at 2.4 GHz, 2.5 GHz and 2.78 GHz.

FIGS. 39A and 39B and FIGS. 40A and 40B are graphs showing measurement results of radiation patterns of the optimized quasi-Moebius strip antenna and the quasi-Moebius strip antenna (N=1), respectively.

In FIG. 39, the omni-directional characteristics can be confirmed at frequencies of 2.5 GHz and 2.78 GHz when $\varphi=90°$ similar to a far-field monopole antenna.

In FIG. 40, the omni-directional characteristics can be confirmed at frequencies of 2.5 GHz, 2.42 GHz and 2.43 GHz when φ=90° similar to a far-field monopole antenna.

Especially, when comparing FIG. 39 with FIG. 40, the peak gain and the average gain of the radiation pattern increase at the resonance frequency of 2.78 GHz as shown in Table 11 even when the miniaturization is achieved due to the increase of N.

TABLE 11

| N = 1 | | | N = 2 | | |
|---|---|---|---|---|---|
| Frequency (GHz) | Peak Gain (dBd) | Average Gain (dBd) | Frequency | Peak Gain (dBd) | Average Gain (dBd) |
| 2.4 | 1.99 | −3.94 | 2.4 | −2.36 | −8.20 |
| 2.42 | 2.17 | −4.16 | 2.5 | −1.14 | −5.00 |
| 2.43 | 2.68 | −3.62 | 2.78 | 2.93 | −3.35 |

That is, even if the quasi-Moebius strip antenna is miniaturized, the reflection coefficient and the gain can be optimized by varying the ring line thickness, the position and the radius of the via-hole, and the width of the bridge.

5. Quality Factor and Bandwidth Control

Figure 41:
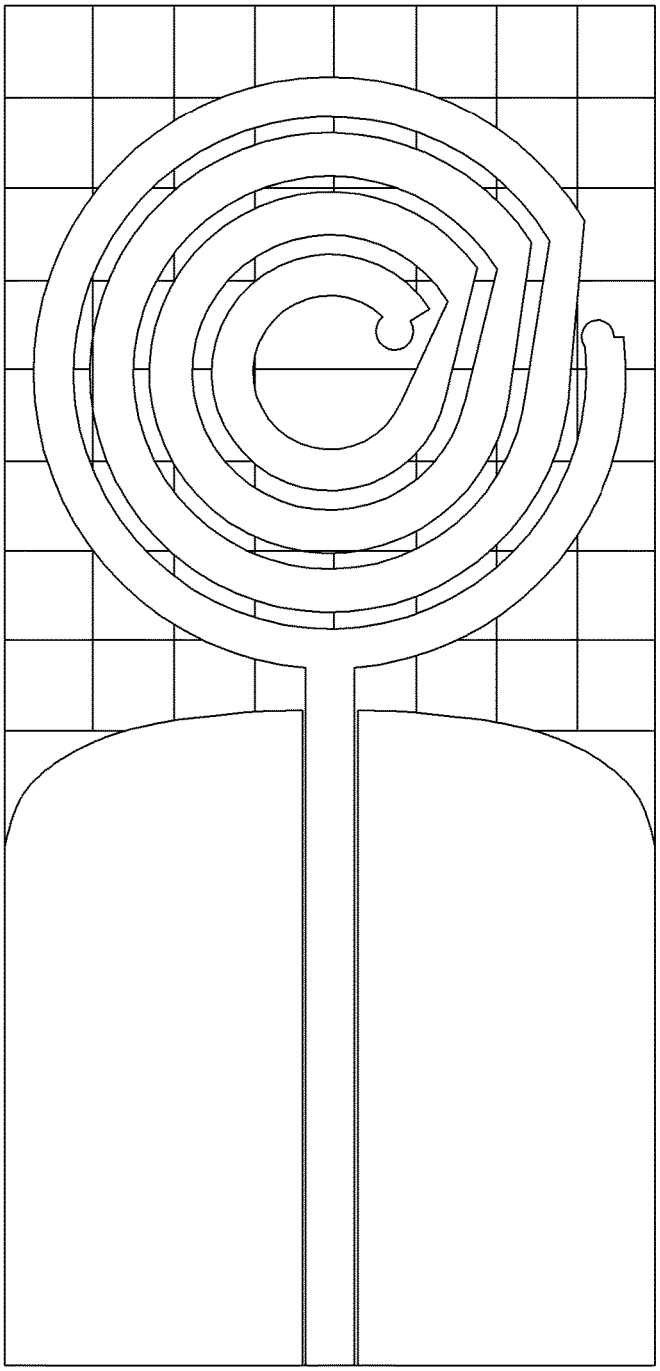
FIGS. 41 to 43 are views showing states in which a radiator of a UWB antenna shown in FIG. 35 is rotated by 90°, 180°, and 330°, respectively.
Figure 42:
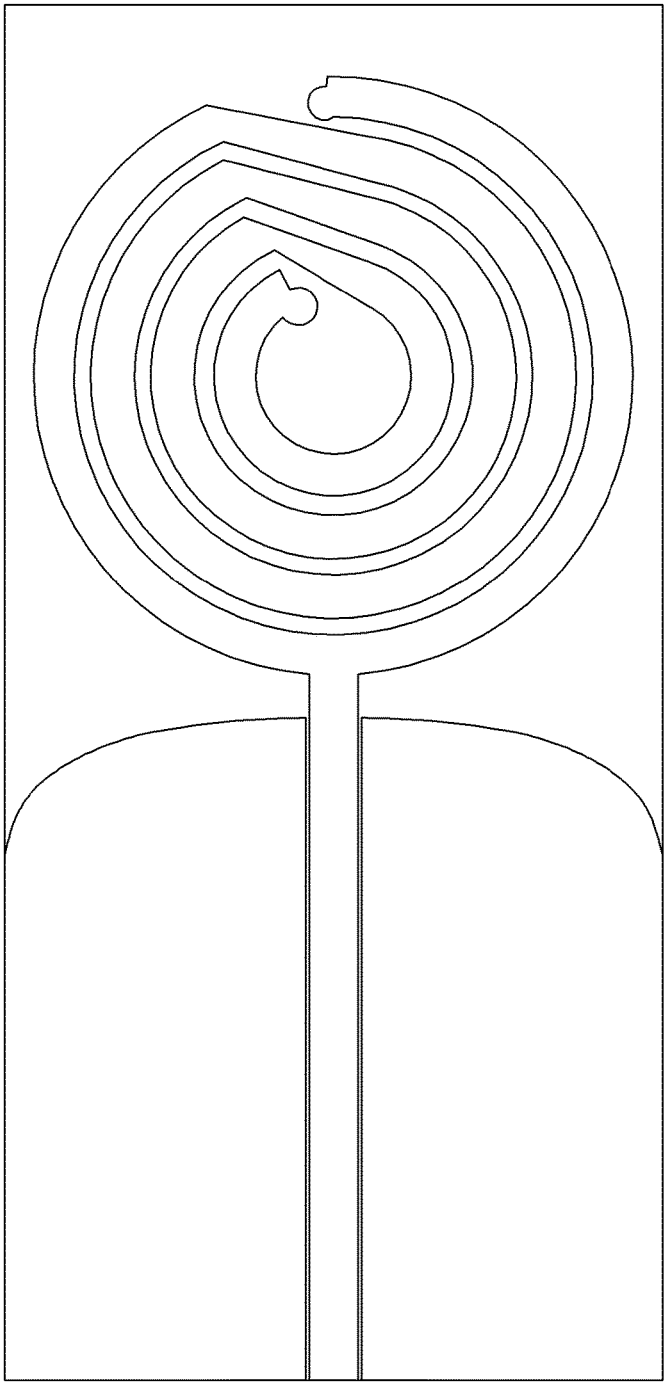
Figure 43:
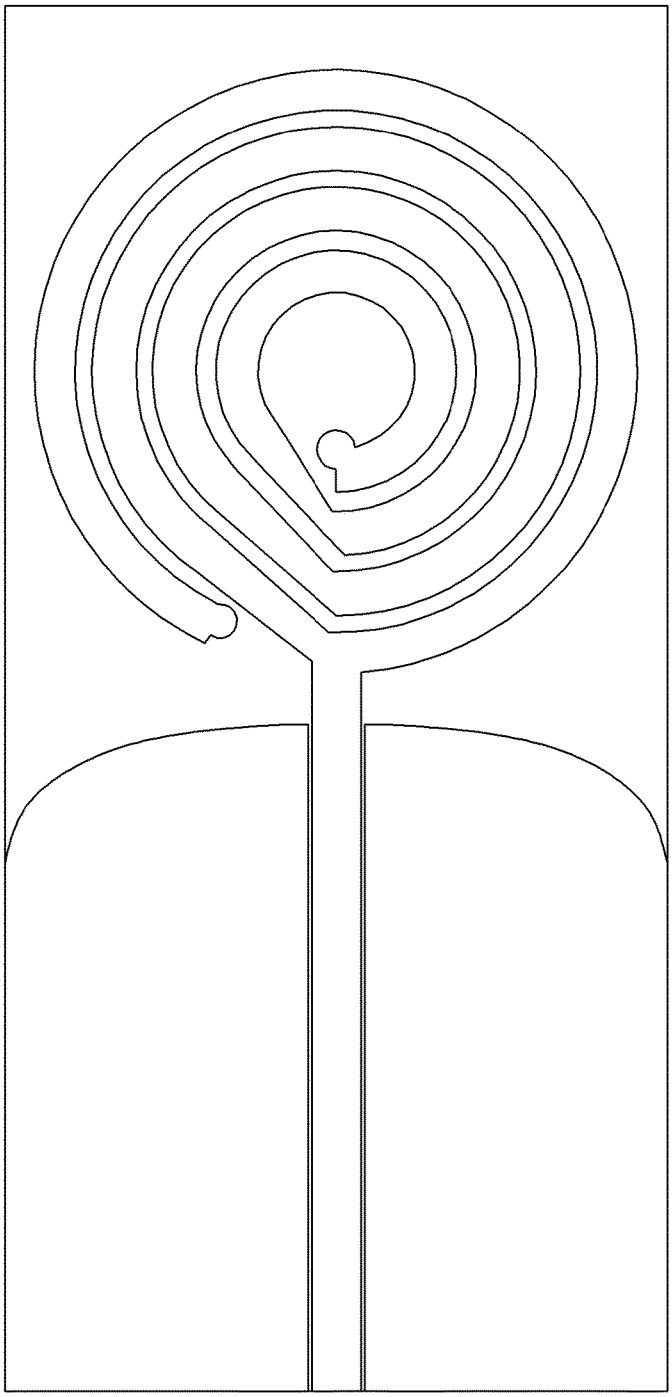
Figure 44:
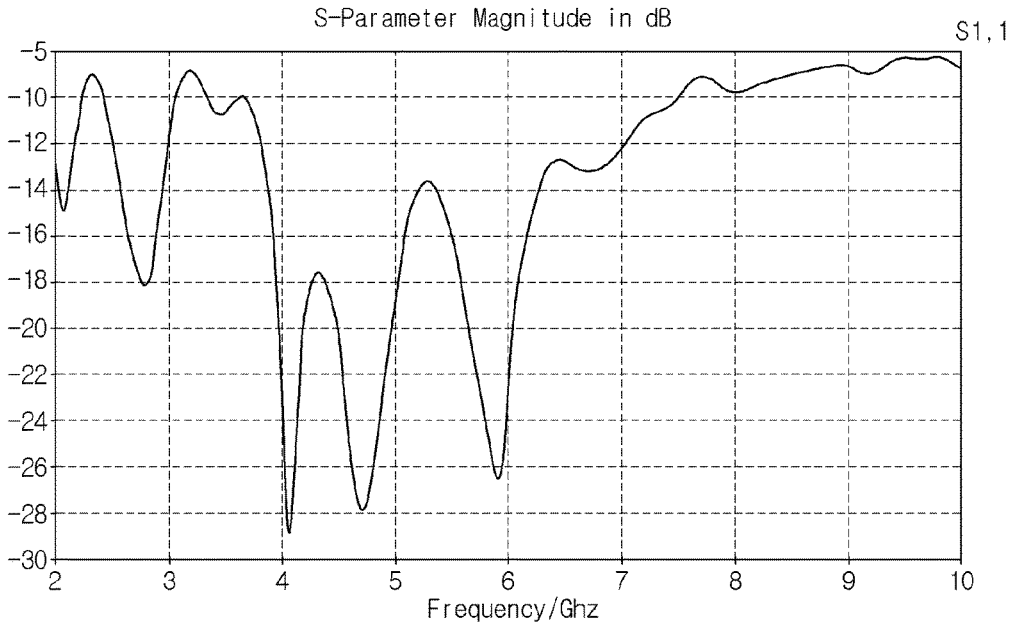
FIGS. 44 to 47 are graphs showing measured return losses of the antennas shown in FIG. 35 and FIGS. 41 to 43, respectively.
Figure 45:
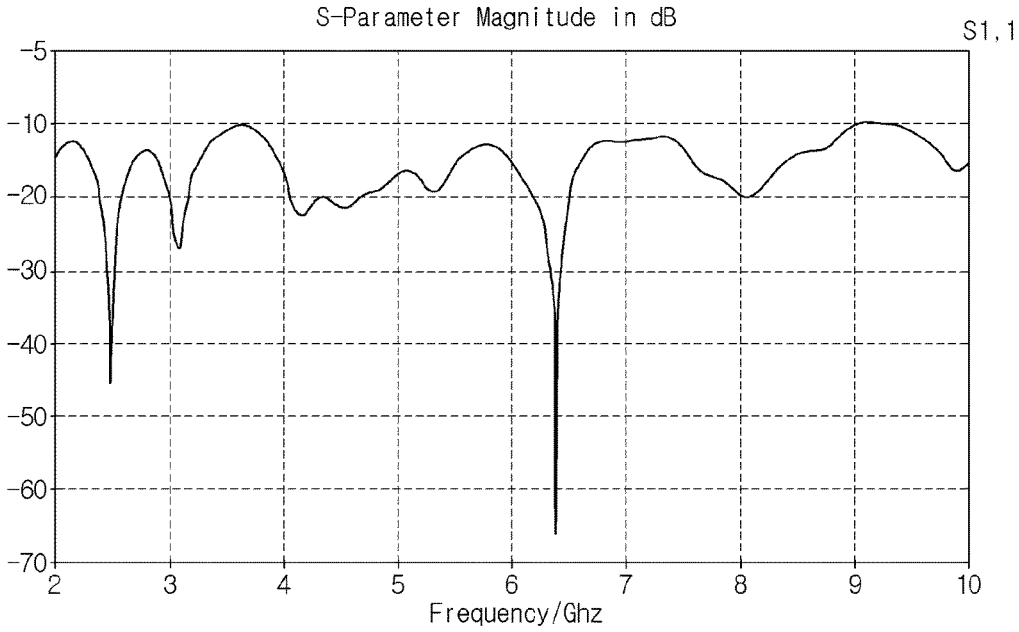
Figure 46:
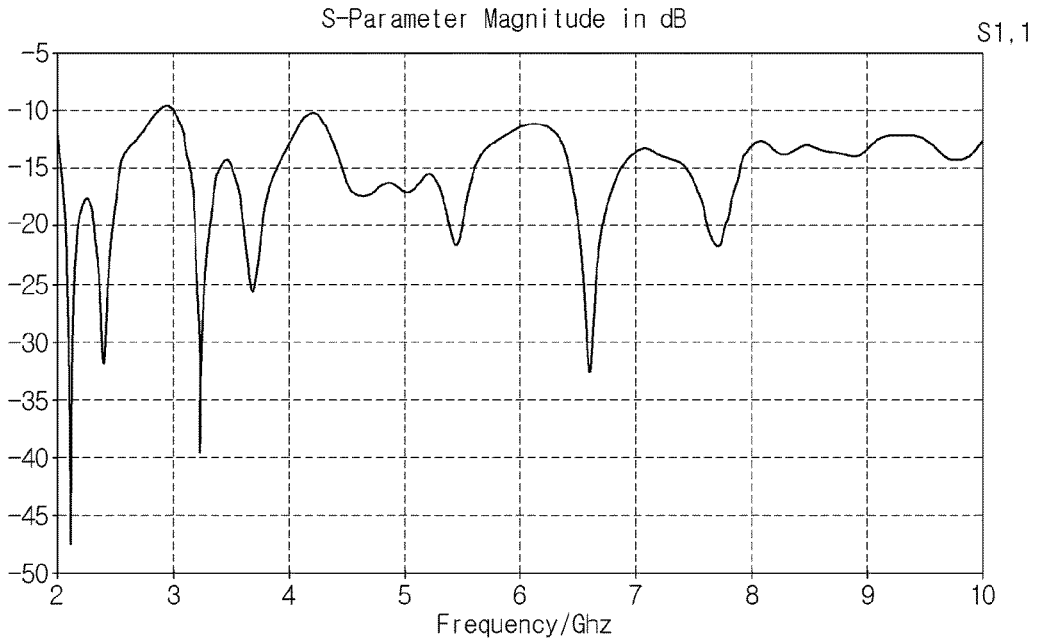
Figure 47:
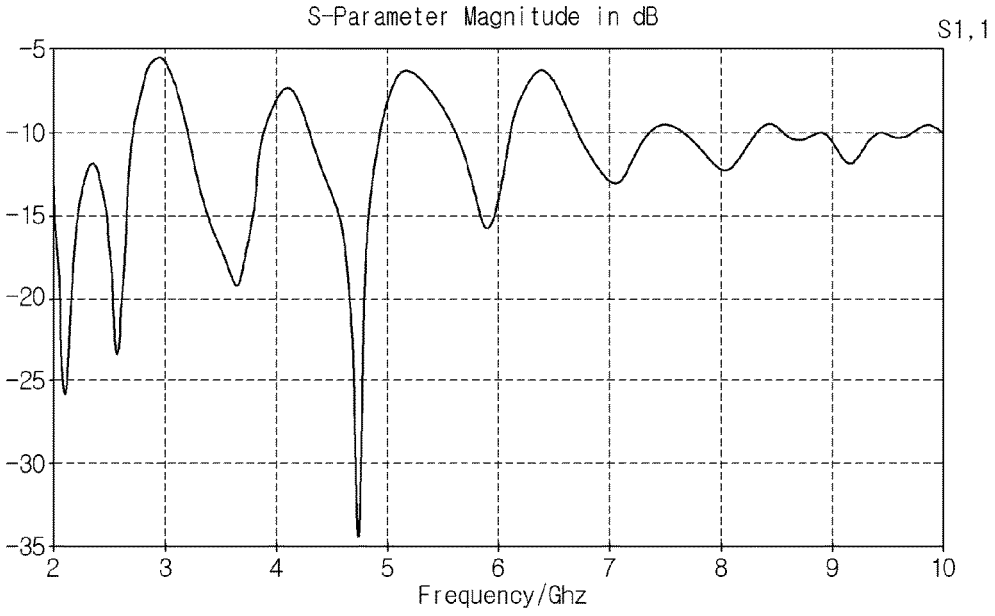

FIGS. 41 to 43 are views showing states in which a radiator of a UWB antenna shown in FIG. 35 is rotated by 90°, 180°, and 330°, respectively.

FIGS. 44 to 47 are graphs showing measured return losses of the antennas shown in FIG. 35 and FIGS. 41 to 43, respectively.

Figure 48:
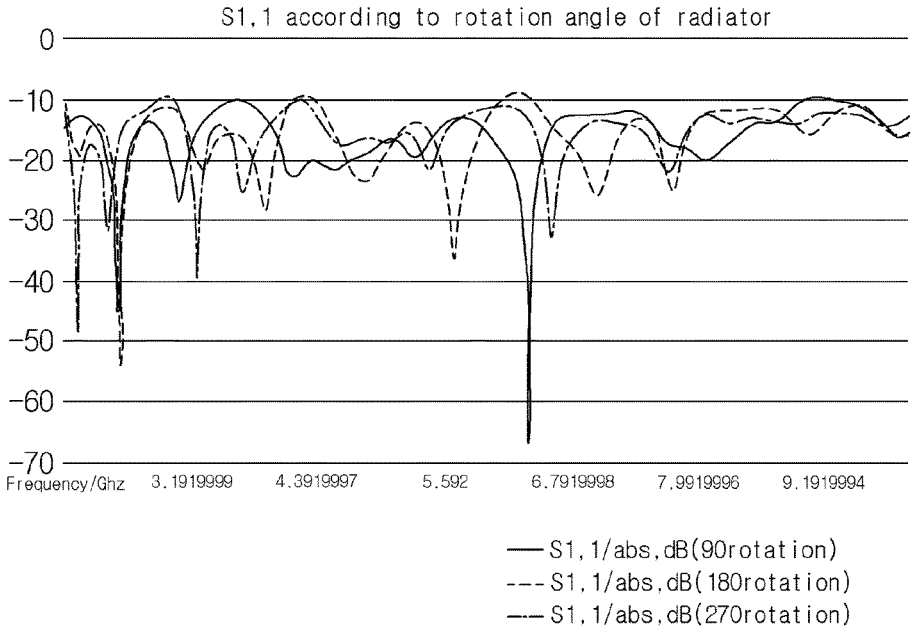
FIG. 48 is a graph showing a comparison result of the return loss according to the rotation angle of each of the rotated radiators.

FIG. 48 is a graph showing a comparison result of the return loss according to the rotation angle of each of the rotated radiators.

As can be seen from the drawings showing the measurement of return loss, the present invention can control the Q factor and bandwidth by rotating the radiator of the quasi-Moebius strip antenna.

6. Directivity Control

The present invention can control the directivity by adjusting the rotation angle of each ring provided on the radiator of the quasi-Moebius strip.

Figure 49:
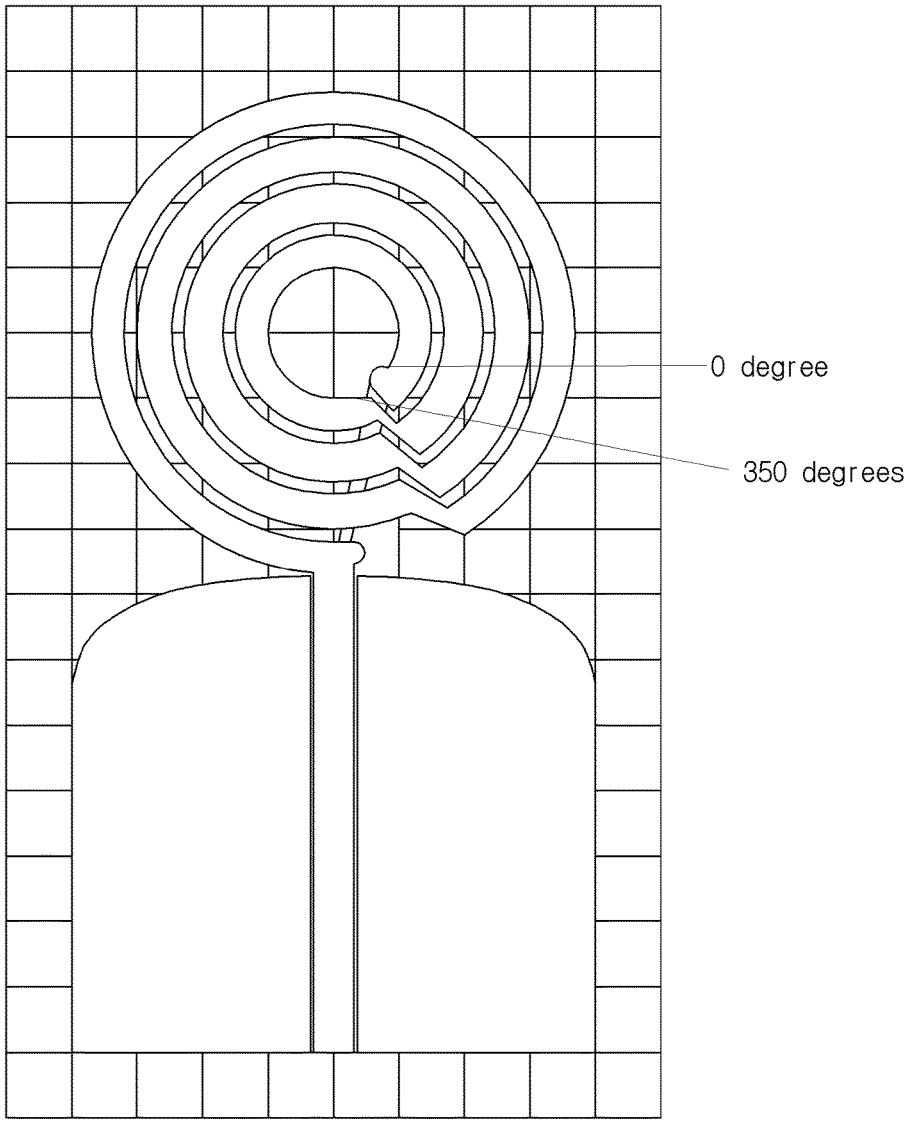
FIGS. 49 to 51 are views showing states in which each ring provided on the radiator of the quasi-Moebius strip is rotated by 300°, 330°, and 350°, respectively.
Figure 50:
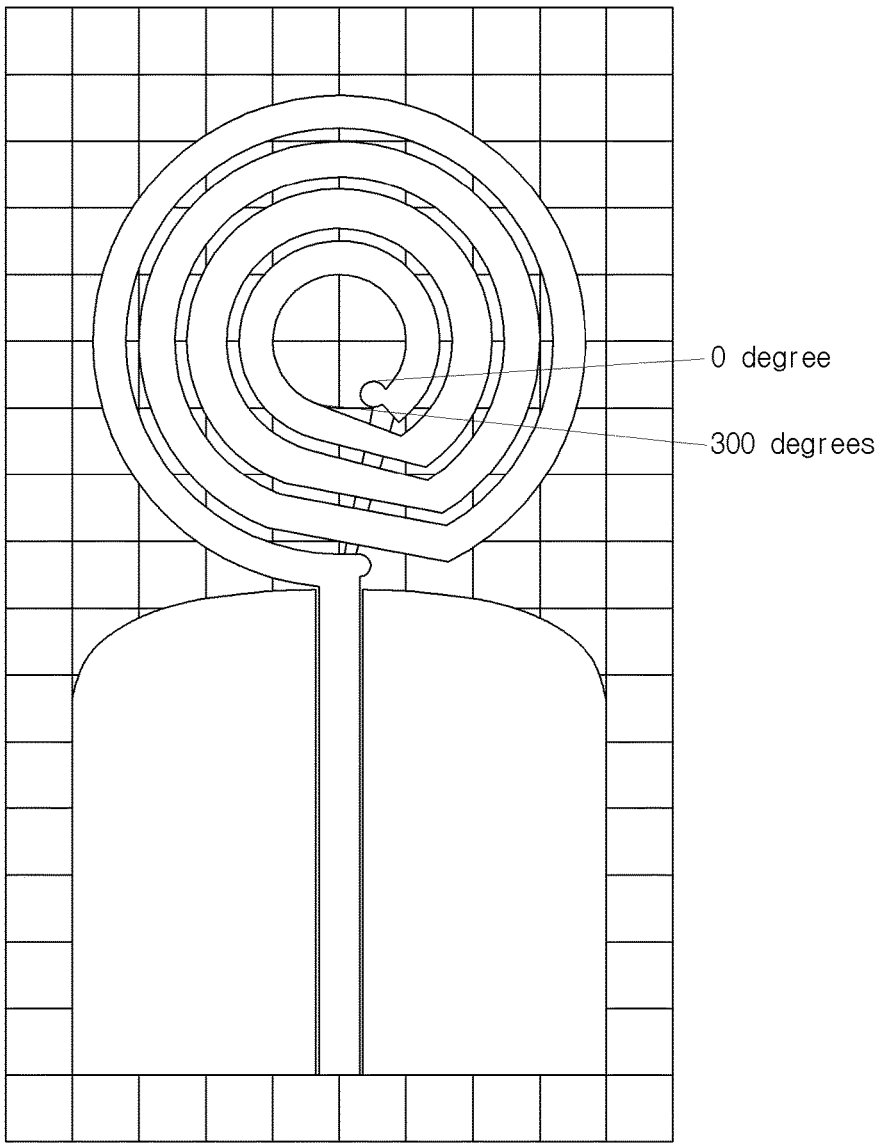
Figure 51:
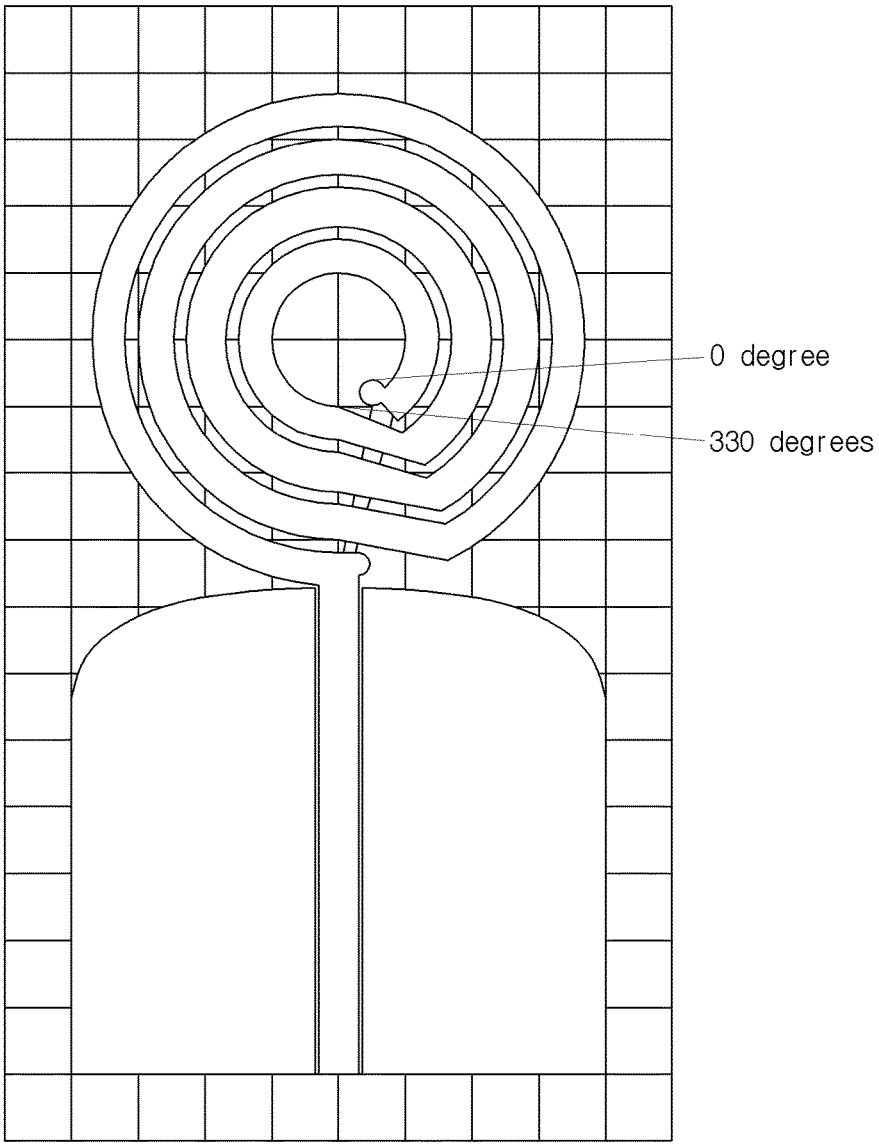
Figure 52:
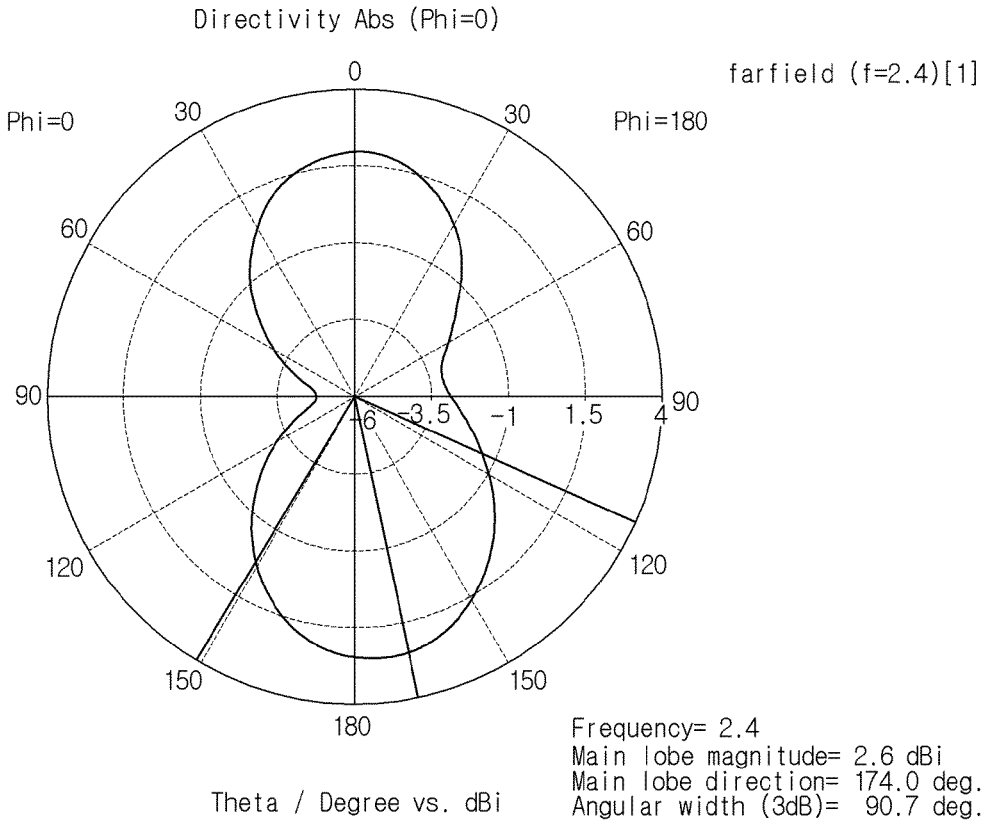
FIGS. 52 to 57 are graphs showing two-dimensional radiation patterns of the radiators shown in FIGS. 49 to 51 when $\varphi$=0° and 90°.
Figure 53:
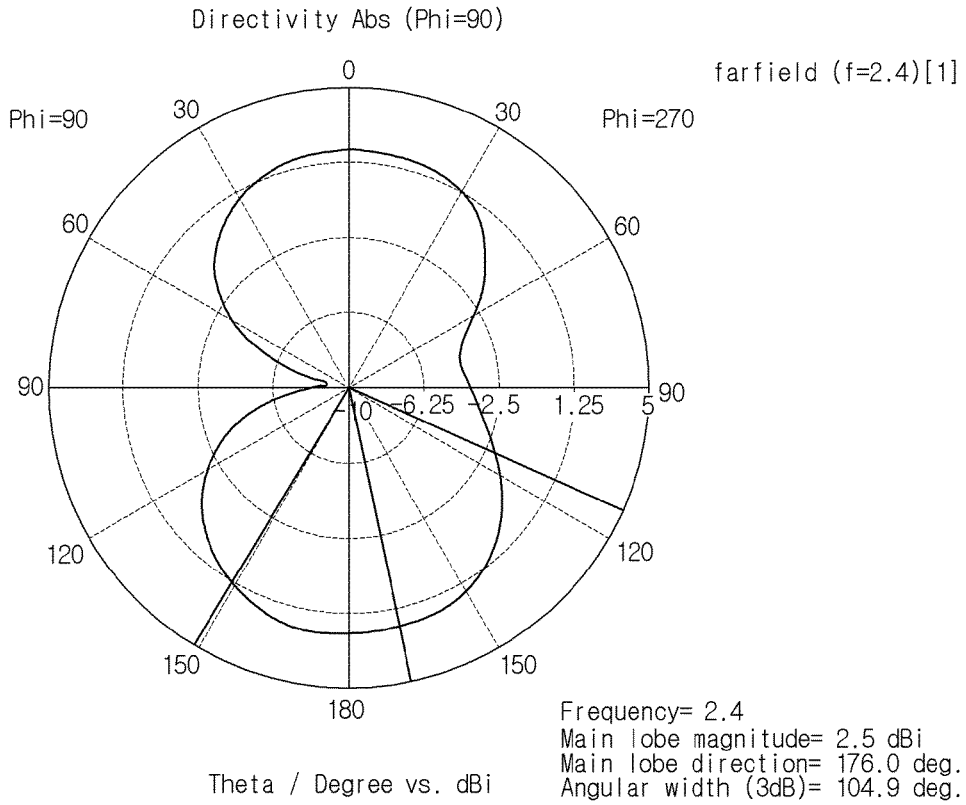
Figure 54:
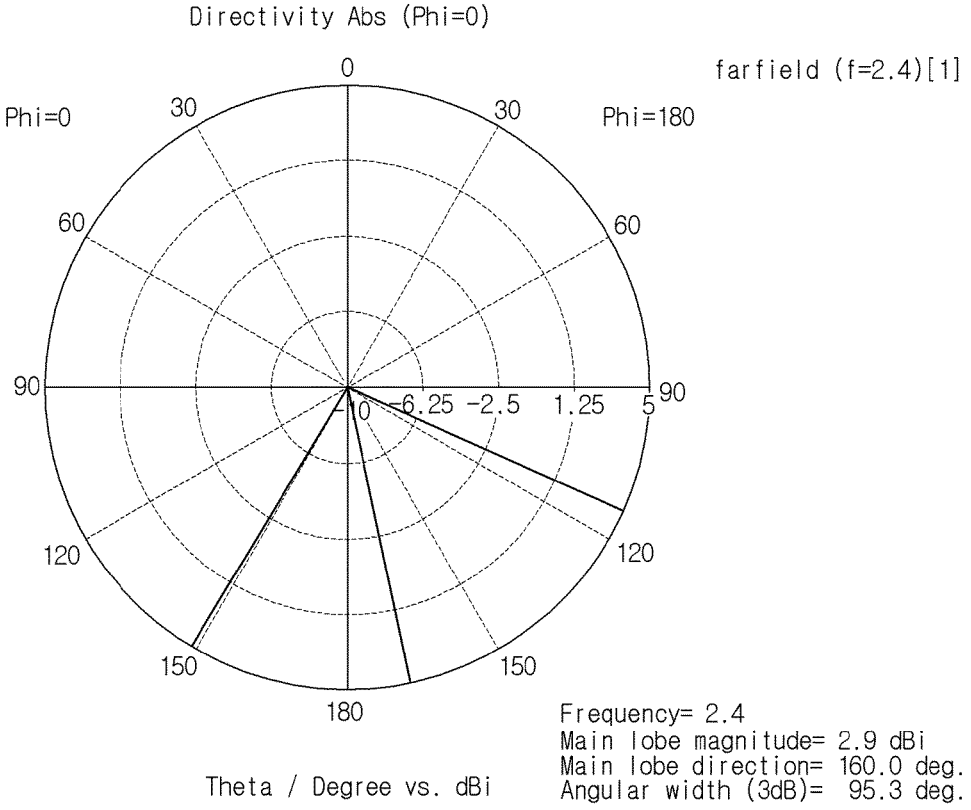
Figure 55:
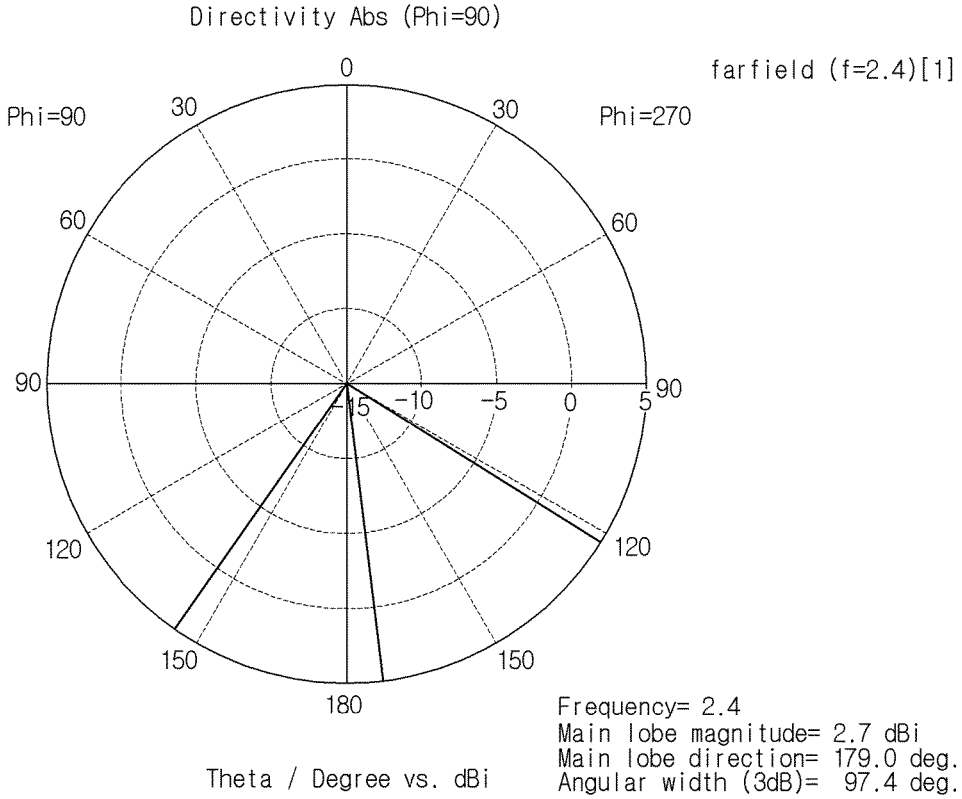
Figure 56:
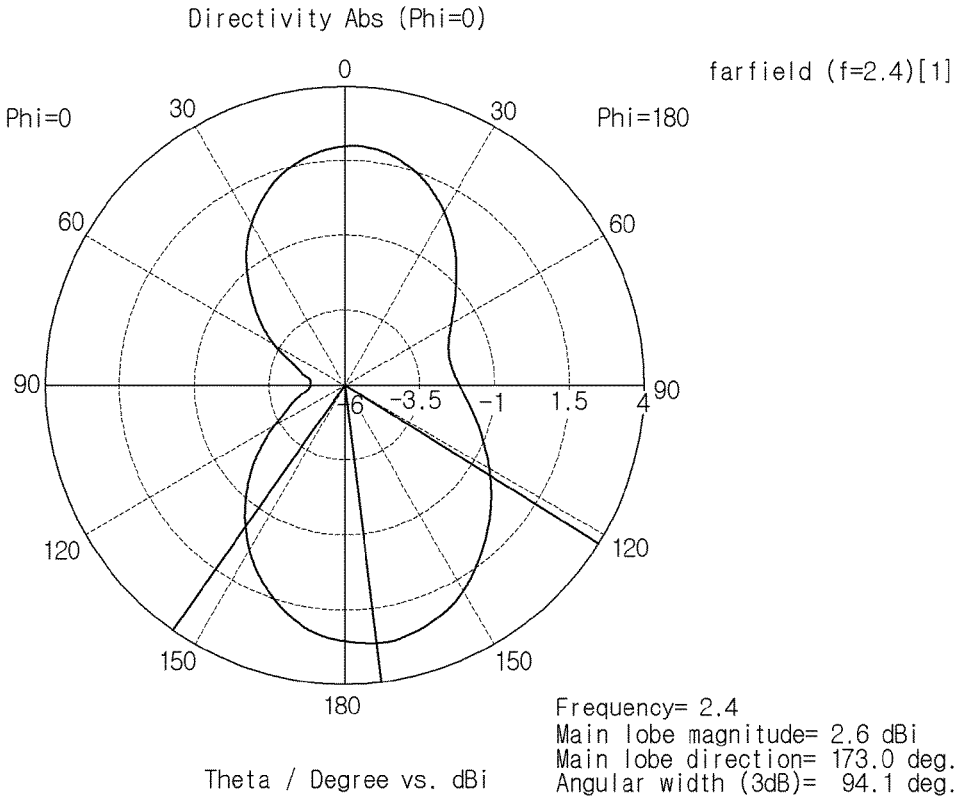
Figure 57:
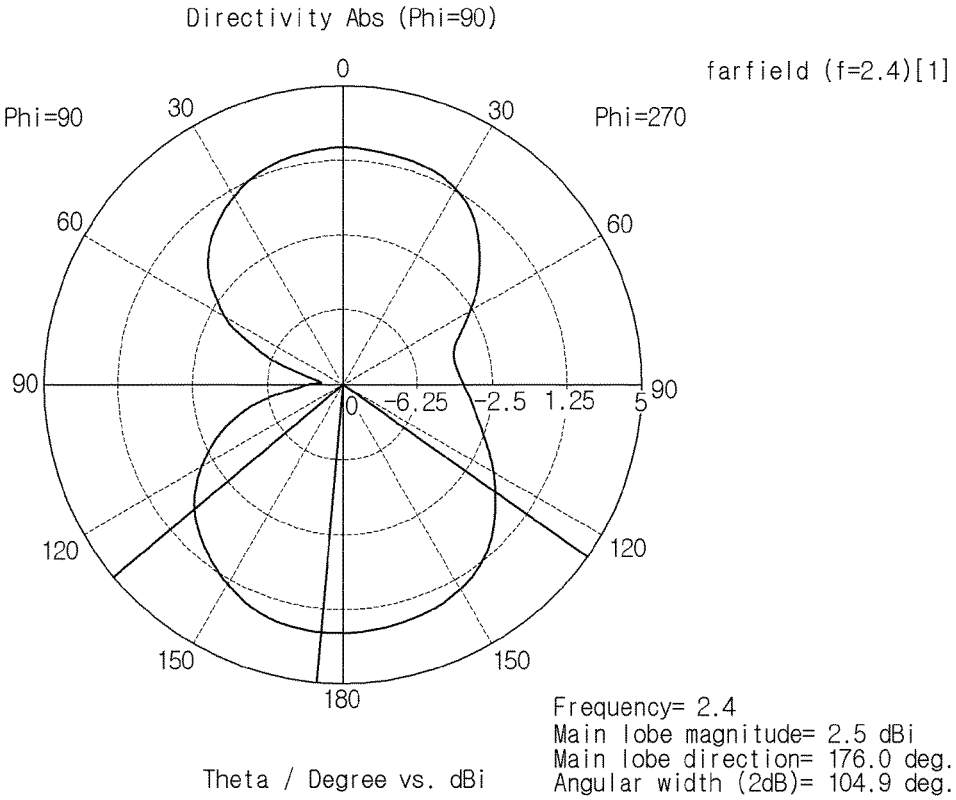

For example, FIGS. 49 to 51 are views showing states in which each ring provided on the radiator of the quasi-Moebius strip is rotated by 300°, 330°, and 350°, respectively.

FIGS. 52 to 57 are graphs showing two-dimensional radiation patterns of the radiators shown in FIGS. 49 to 51 when φ=0° and 90°.

Figure 58:
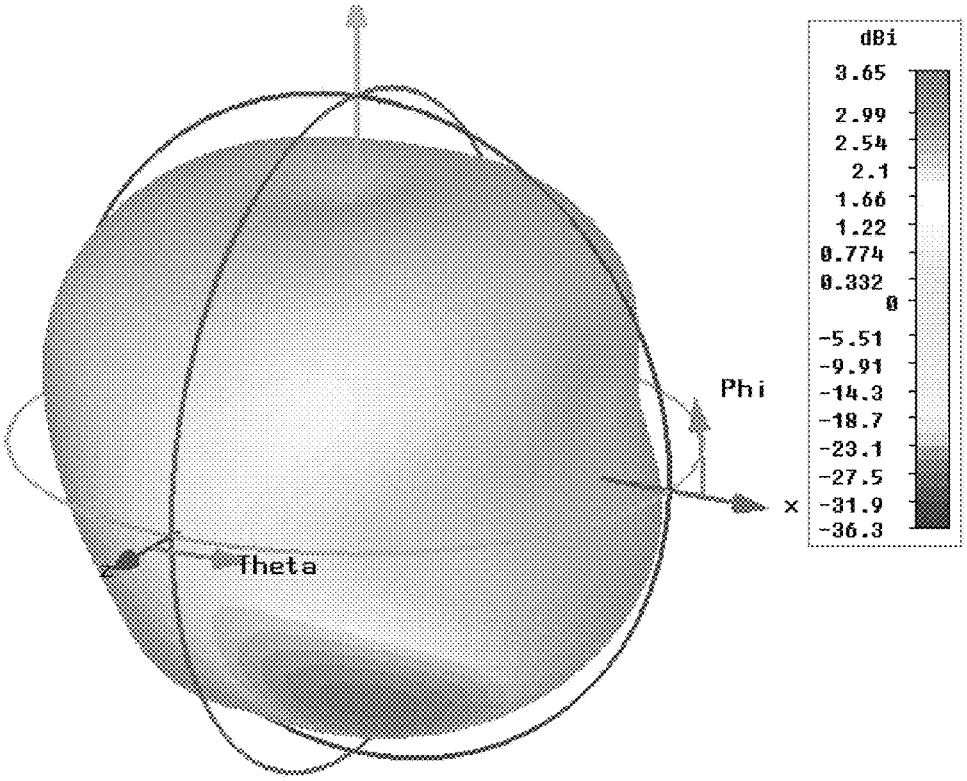
FIGS. 58 to 60 are graphs showing three-dimensional radiation patterns of the radiators shown in FIGS. 49 to 51, respectively.
Figure 59:
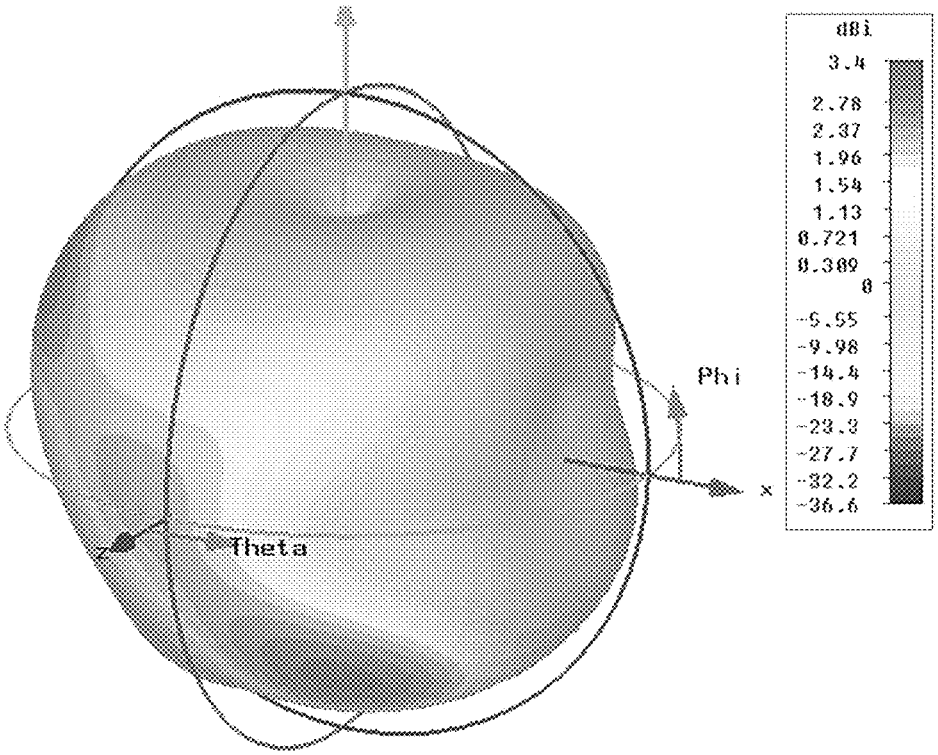
Figure 60:
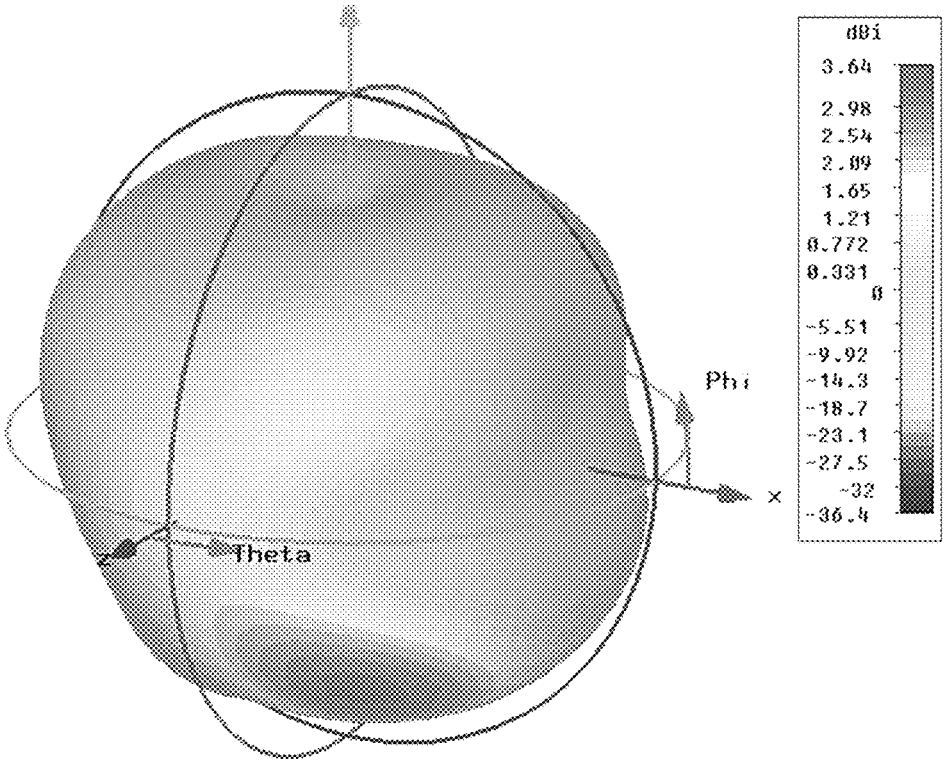

In addition, FIGS. 58 to 60 are graphs showing three-dimensional radiation patterns of the radiators shown in FIGS. 49 to 51, respectively.

That is, the present invention can control the directivity of the radiation pattern of the antenna by adjusting the rotation angle of each ring provided in the radiator of the quasi-Moebius strip to between 0° to 360°.

In detail, as the rotation angle of the ring approaches to 360°, the radiation pattern has the omni-directional characteristic, and the directivity is increased as the rotation angle becomes small.

That is, as the rotation angle of the ring approaches to 360°, the radiation pattern characteristic is similar to that of the circular disc monopole antenna.

The radiation pattern of the circular disc monopole antenna has the omni-directional characteristic. This is because the directivity is determined based on the distribution of the electric field and magnetic field according to the current feeding.

Therefore, the quasi-Moebius strip antenna according to the present invention represents the omni-directional characteristic as the rotation angle of the ring provided on the radiator approaches to 360°, and the directivity is increased as the rotation angle of the ring becomes small.

7. Small MIMO Antenna Using Monopole Antenna

The MIMO antenna is a core of 4G and 5G technologies and is applied to overcome the limitation of the channel capacity caused by multipath fading. By applying a plurality of transmitting and receiving antennas to the end of the transmitting and receiving terminals, the limitation of the channel capacity caused by the multipath is improved.

The performance parameters of the MIMO antenna are mainly divided into a diversity performance and a MIMO performance. Diversity performance parameters include balanced branch power mean gain (MEG), correlation, and diversity gain, and MIMO performance parameters include MIMO capacity and multiplexing efficiency.

In the MIMO system, the channel capacity increases in proportion to the number of transmitting and receiving antennas, but there is a correlation between the antennas because a plurality of antennas are used. The correlation between the antennas reduces the channel capacity of the entire MIMO system. When designing the MIMO antenna, a diversity technique that improves spectral efficiency is adopted and the mutual coupling relationship between antennas degrades the performance of the system.

The correlation between the MIMO antennas is one of the most important parameters related to the spectral efficiency of the communication system, and the spectral efficiency of the communication system is degraded as the correlation between the antennas becomes high.

The calculation of the envelope correlation coefficient (ECC), which is the correlation between the antennas, can be defined by Equation 12 or 13 in consideration of the three-dimensional radiation pattern.

$$\rho_e = \frac{\left|\int_{4\pi}\int[\overline{F_1}(\theta,\phi)\cdot\overline{F_2}^*(\theta,\phi)]d\Omega\right|^2}{\int_{4\pi}\int|\overline{F_1}(\theta,\phi)|^2 d\Omega\int_{4\pi}\int|\overline{F_2}(\theta,\phi)|^2 d\Omega} \quad \text{[Equation 12]}$$

wherein, $F_i(\theta, \varphi)$ denotes a radiation pattern obtained only when I is excited in a case that all other ports are terminated to 50Ω and • denotes Hermitian operation.

$$\rho_e = \left(\frac{\oint(XPR\cdot E_{\theta X}E_{\theta X}^* P_\theta + E_{\phi Y}E_{\phi Y}^* P_\phi)d\Omega}{\sqrt{\oint(XPR\cdot E_{\theta X}E_{\theta X}^* P_\theta + E_{\phi X}E_{\phi X}^* P_\phi)d\Omega \oint(XPR\cdot E_{\theta Y}E_{\theta Y}^* P_\phi)d\Omega}}\right)^2 \quad \text{[Equation 13]}$$

wherein, XPR=cross polarization ratio=Pθ(Ω)/Pφ(Ω), $E_{\Theta,\varphi}X$ and $E_{\Theta,\varphi}$ denote the crossed electric field pattern between two antennas of a plurality of antennas.

Equation 12 can be expressed in a simplified form by using an S-parameter between array antennas. If the environment of the multipath is uniform, Equation 12 can be approximated by Equation 14.

$$\rho_e = \frac{|S_{11}^* S_{12} + S_{21}^* S_{22}|^2}{(1-|S_{11}|^2-|S_{21}|^2)(1-|S_{22}|^2-|S_{12}|^2)} \quad \text{[Equation 14]}$$

Equation 14 is derived by applying an S parameter between two antennas to derive an ECC, which is simpler than the calculation using Equation 13.

Meanwhile, the next generation wireless communication requires a high capacity MIMO antenna technology for high speed data transmission. In order to realize the high capacity MIMO antenna having the high isolation characteristics, a plurality of highly isolated antennas should be implemented in a limited radiation space.

To this end, a small MIMO antenna geometry with two antenna terminals having the same radiator structure may be considered.

Since the antenna terminals are very close to each other, the signals output to a mating terminal through a long path and a short path may satisfy the phase conjugate condition, that is, the 180° phase difference condition, at the same amplitude, so that the terminal isolation characteristics may be satisfied.

This can be achieved by appropriately adjusting a diameter of a circular disc and a width S1 and a length S2 of a slot implemented in the circular disc.

The structure (width and length) of the slot may exert an influence on an input impedance and terminal isolation characteristics of the antenna.

The optimized design is achieved by using a dielectric substrate with a dielectric constant $\varepsilon_r$=2.2, a dielectric thickness H=30 mils (0.762 mm), a copper foil thickness T=0.5 oz. (0.018 mm), and a loss tangent value (tan δ)=0.001 (@ 5 GHz). In order to easily implement the input impedance matching circuit, the micro-strip feeding was used instead of the CPW feeding. In addition, each input terminal is implemented at a 1 mm offset position from the slot.

When the input return loss characteristics and the terminal isolation characteristics are considered on the basis of 10 dB, it can operate in the 3.33 GHz~5.67 GHz band. Especially, in the 3.2~5.0 GHz band, excellent input matching characteristics having the input reflection coefficient of 0.18 or less and superior isolation characteristics can be represented.

The simulation result shows that a wideband 2-terminal small MIMO antenna with high isolation characteristics can be implemented in a space of about $0.54\lambda_o \times 0.69\lambda_o$.

The signal input from each terminal appears weakly to the counter terminal due to the slot structure. As can be understood from the terminal isolation characteristics shown in a picture 3.4.3 (a), the terminal isolation characteristic in the 5.5 GHz band is about 11.3 dB, which is not better than 22 dB to 28 dB in the other frequency band (3.5 GHz & 4.5 GHz), so it is confirmed that the counter signals are strongly coupled relatively.

In addition, the two-terminal small MIMO antenna described in the present embodiment has a very low correlation between antennas within a frequency range of 3 GHz to 8 GHz, and can be utilized for a massive MIMO antenna for UWB.

As described above, when the miniaturized UWB antenna according to the present embodiment is applied to the MIMO antenna, it is confirmed that the ECC value indicating the correlation between the antennas is 0.02 or less in the frequency range of 3 GHz to 8 GHz, thereby improving the spectral efficiency.

Although the invention made by the present inventors has been described concretely with reference to the above embodiments, the present invention is not limited to the above embodiments, and various changes can be made without departing from the scope of the present invention.

That is, although the UWB monopole antenna has been described in the above embodiments, the present invention is not limited thereto. The present invention can be applied to various types of monopole antennas as well as UWB monopole antennas, and can be applied to an RF passive element, such as a resonant cell, wireless power transmission resonator, an oscillator, and the like.

INDUSTRIAL APPLICABILITY

The present invention may be applied to a monopole antenna technique adopting a quasi-Moebius strip structure.

The invention claimed is:

1. A monopole antenna comprising:

a radiator arranged on a center of a front surface of a dielectric substrate, and including a plurality of loops formed in a structure in which a quasi-Moebius strip is cut at least one time along a circumference;

a first bridge for sequentially connecting one end of each of the loops; and a second bridge for connecting via-holes respectively formed at one end of an innermost loop and an outermost loop, wherein the antenna is miniaturized through a combination of the radiator, the first bridge and the second bridge, each of the loops of the radiator is provided with ring lines having diameters different from each other, and the monopole antenna has a single resonance frequency characteristic.

2. The monopole antenna of claim 1, wherein the first bridge is disposed on the front surface of the dielectric substrate, and the second bridge is disposed on a rear surface of the dielectric substrate.

3. The monopole antenna of claim 2, wherein a Q-factor (Quality factor) and a bandwidth are controllable by adjusting a rotation angle of the radiator.

4. The monopole antenna of claim 3, wherein directivity is controllable by adjusting a rotation angle of each of the loops provided in the radiator.

5. The monopole antenna of claim 4, wherein the monopole antenna has an omni-directional characteristic as the rotation angle of each of the loops approaches to 360°, and the directivity is increased as the rotation angle of each of the loops goes below 360°.

6. The monopole antenna of claim 1, wherein the first bridge is disposed on a rear surface of the dielectric substrate, and the second bridge is disposed on the front surface of the dielectric substrate.

7. The monopole antenna of claim 6, wherein a Q-factor (Quality factor) and a bandwidth are controllable by adjusting a rotation angle of the radiator.

8. The monopole antenna of claim 7, wherein directivity is controllable by adjusting a rotation angle of each of the loops provided in the radiator.

9. The monopole antenna of claim 8, wherein the monopole antenna has an omni-directional characteristic as the rotation angle of each of the loops approaches to 360°, and the directivity is increased as the rotation angle of each of the loops goes below 360°.

10. The monopole antenna of claim 1, wherein a Q-factor (Quality factor) and a bandwidth are controllable by adjusting a rotation angle of the radiator.

11. The monopole antenna of claim 10, wherein directivity is controllable by adjusting a rotation angle of each of the loops provided in the radiator.

12. The monopole antenna of claim 11, wherein the monopole antenna has an omni-directional characteristic as the rotation angle of each of the loops approaches to 360°, and the directivity is increased as the rotation angle of each of the loops goes below 360°.

13. The monopole antenna of claim 1, wherein a resonance frequency and a reflection coefficient are adjustable by varying a thickness of each of the loops of the quasi-Moebius strip, a width of each of the first and second bridges, and a radius and a position of one or more of the via-holes.

* * * * *